US008284982B2

(12) United States Patent
Bailey

(10) Patent No.: US 8,284,982 B2
(45) Date of Patent: Oct. 9, 2012

(54) POSITIONALLY SEQUENCED LOUDSPEAKER SYSTEM

(75) Inventor: Adam H. Bailey, Bailey, CO (US)

(73) Assignee: Induction Speaker Technology, LLC, Fort Collins, CO (US)

( * ) Notice: Subject to any disclaimer, the term of this patent is extended or adjusted under 35 U.S.C. 154(b) by 750 days.

(21) Appl. No.: 12/281,979

(22) PCT Filed: Mar. 6, 2007

(86) PCT No.: PCT/US2007/063416

§ 371 (c)(1),
(2), (4) Date: Sep. 5, 2008

(87) PCT Pub. No.: WO2007/103937

PCT Pub. Date: Sep. 13, 2007

(65) Prior Publication Data

US 2009/0028371 A1 Jan. 29, 2009

Related U.S. Application Data

(60) Provisional application No. 60/900,399, filed on Feb. 9, 2007, provisional application No. 60/845,930, filed on Sep. 19, 2006, provisional application No. 60/779,846, filed on Mar. 6, 2006.

(51) Int. Cl.
*H04R 25/00* (2006.01)

(52) U.S. Cl. ..... 381/401; 381/59; 381/421

(58) Field of Classification Search ..... 381/55, 381/58, 59, 96, 117, 400, 401, 402, 403, 381/412, 414, 420, 421, 396
See application file for complete search history.

(56) References Cited

U.S. PATENT DOCUMENTS 4,075,517 A 2/1978 Adler
(Continued)

FOREIGN PATENT DOCUMENTS

DE 3936639 C1 3/1991
(Continued)

OTHER PUBLICATIONS

Bright, Andrew Simplified Loudspeaker Distortion Compensation by DSP; Nokia Corporation. Fin-00045, Helsinki Finland, Section of Acoustic Technology, Technical University of Denmark, Lyngbgy, Denmark.

(Continued)

*Primary Examiner* — Huyen D Le
(74) *Attorney, Agent, or Firm* — Santangelo Law Offices, P.C.

(57) ABSTRACT

A variety of loudspeaker arrangements may have any of multiple adjacent magnetic circuits, single magnetic circuits, an improved loudspeaker voice coil assembly, multiple voice coil windings (124-127, 315-317), and commutated current. The radial direction of flux may alternate at adjacent poles and may have a controller that commands the current through each of the windings. The position of the moving components may be measured or inferred by the controller (213). An encoding track (318*a*) applied to the surface of the assembly may allow the assembly to function as part of a position transducer to permit appropriate action based on position. Calculated or sensed actual position may be used to determine the relative current in each of the windings and the controller may have compensation such as a motion control algorithm, thermal monitoring, and management of the driver. The voice coil assembly (305*c*) may have foil conductors applied to a substrate to connect and interconnect a single or multiple voice coil windings with minimal effect on the magnetic gap (303*b*) width.

49 Claims, 46 Drawing Sheets

U.S. PATENT DOCUMENTS

| | | | | |
|---|---|---|---|---|
| 4,256,923 | A * | 3/1981 | Meyers | 381/96 |
| 4,360,707 | A | 11/1982 | Joseph et al. | |
| 4,531,025 | A | 7/1985 | Danley et al. | |
| 4,550,430 | A * | 10/1985 | Meyers | 381/96 |
| 4,564,727 | A | 1/1986 | Danley et al. | |
| 4,566,120 | A | 1/1986 | Nieuwendijk et al. | |
| 4,806,955 | A | 2/1989 | Godkin | |
| 5,345,206 | A | 9/1994 | Morcos | |
| 5,371,806 | A | 12/1994 | Kohara | |
| 5,511,131 | A | 4/1996 | Kohara | |
| 5,682,436 | A | 10/1997 | Yoshi et al. | |
| 5,748,753 | A | 5/1998 | Carver | |
| 5,828,767 | A | 10/1998 | Button | |
| 5,872,407 | A | 2/1999 | Kitaoka et al. | |
| 6,417,584 | B1 | 7/2002 | Chitayat | |
| 6,526,151 | B1 | 2/2003 | Peng | |
| 6,665,412 | B1 | 12/2003 | Mizoguchi | |
| 6,700,227 | B2 | 3/2004 | Hartramph | |
| 6,738,490 | B2 | 5/2004 | Brandt | |
| 6,756,705 | B2 | 6/2004 | Pulford, Jr. | |
| 6,768,806 | B1 | 7/2004 | Button et al. | |
| 6,770,988 | B2 | 8/2004 | Denne | |
| 6,800,966 | B2 | 10/2004 | Godkin | |
| 6,849,970 | B2 | 2/2005 | Watanabe | |
| 6,919,660 | B2 | 7/2005 | Godkin | |
| 6,965,791 | B1 | 11/2005 | Hitchcock et al. | |
| 6,977,449 | B2 | 12/2005 | Miettinen | |
| 7,057,314 | B2 | 6/2006 | Moro | |
| 7,136,459 | B2 | 11/2006 | Tanaka et al. | |
| 2005/0031132 | A1 | 2/2005 | Browning | |
| 2008/0170744 | A1 | 7/2008 | Button et al. | |

FOREIGN PATENT DOCUMENTS

| | | | |
|---|---|---|---|
| JP | 3-208497 | | 9/1991 |
| WO | 92/09180 | | 5/1992 |
| WO | 94/03026 | | 2/1994 |
| WO | 97/03536 | | 1/1997 |
| WO | 97/22226 | | 6/1997 |
| WO | 97/25833 | | 7/1997 |
| WO | 00/67523 | A2 | 11/2000 |
| WO | 0067523 | A3 | 11/2000 |
| WO | 03060220 | A1 | 7/2003 |
| WO | 2007103937 | A2 | 9/2007 |

OTHER PUBLICATIONS

Klippel, Wolfgang Active Compensation of Transducer Nonlinearities Klippel GmbH, Dresden, 01277, Germany, www.klipeel.de Abstract.

Roland Amplifiers for Guitar & Bass; Celebrating Three Decades of a Classic, New-Generation of Amps for Better Bass, Power & Tone to Go, Specifications.

International Application No. PCT/US07/63416, Search Report mailed Feb. 29, 2008.

International Application No. PCT/US07/63416, Written Opinion of the International Searching Authority mailed Feb. 29, 2008.

Bai, Mingsian R. et al. DSP-based Sensorless Velocity Observer with Audio Applications in Loudspeaker Compensation ; Audio Engineering Society, Convention Paper 6424 May 28-31, 2005. Barcelona, Spain.

Beerling, Marcel A.H. et al. Reduction of Nonlinear Distortion in Loudspeakers with Digital Motional Feedback; University of Twente, Department of Electrical Engineering Laboratory for Network Theory, Enschede, The Netherlands.

Bright, Andrew Compensating Non-Linear Distortion in an 'Equal-Hung' voice coil; Audio Engineering Society Convention Paper 5411, Sep. 21-24, 2001. New York, NY USA.

Distortion Analyzer 2 (rev. 2.0/2.1), Digital Processor Unit of the Klippel Analyzer System.

Schurer, Hans et al., Theoretical and Experimental Comparison of Three Methods of Compensation of Electrodynamic Transducer Nonlinearity ; University of Twente, Laboratory for Network Theory and VLSI Design, 7500 AE Enschede, The Netherlands.

"Novel Loudspeaker System" the specification of which was filed as U.S. Appl. No. 60/845,930, filed Sep. 19, 2006.

"Improved Voice Coil Assembly for Use in Loudspeakers" the specification of which was filed as U.S. Appl. No. 60/900,399, filed Feb. 9, 2007.

Parallel European Regional Application No. 07758008.2; Extended European Search Report dated Feb. 25, 2011.

"Improved Loudspeaker System" the specification of which was filed as U.S. Appl. No. 60/779,846, filed Mar. 6, 2006.

* cited by examiner

POSITIONALLY SEQUENCED LOUDSPEAKER SYSTEM

This application is the United States National Stage of international application number PCT/US07/63416, filed Mar. 6, 2007 which claims the benefit of U.S. Provisional Application No. 60/779,846 filed 6 Mar. 2006, U.S. Provisional Application No. 60/845,930 filed 19 Sep. 2006, and U.S. Provisional Application No. 60/900,399 filed 9 Feb. 2007, hereby incorporated by reference herein.

TECHNICAL FIELD

This invention relates to loudspeaker design and loudspeaker drivers that produce more sound and produce less distortion and offer less heat generation. Specifically it involves the technical fields of loudspeaker drivers that are intended to produce high acoustic output by utilizing a large cone excursion, voice coil formers used in loudspeaker drivers, and voice coils that have multiple coils or position sensing. Embodiments of the present invention include loudspeaker systems having multiple magnetic circuits, multiple voice coil windings, and current sequencing among coils by a controller.

BACKGROUND

Physical relations define that a moving volume of air causes a pressure wave. Sound pressure level, or SPL, is what is perceived as loudness. SPL is given in units of decibels, a logarithmic pressure relation. This means that the volume of air that must be moved to produce a given SPL goes up exponentially with SPL. The range of SPL that humans can detect without physical pain is incredibly large. The difference in intensity between the quietest sound a human is able to hear (threshold of hearing) and the loudest sound a human can stand (threshold of pain) is literally the same relative difference as the difference in light intensity you would experience if you were standing next to a lighthouse in Massachusetts staring at the beacon and then looked across the Atlantic and saw a flashlight in London.

Loudspeakers use an electrical signal appropriate for audio to create sound. The amount of air that must be moved to obtain a given SPL is proportional to the inverse square of the frequency. This means that at low frequency the volume of air that must be moved to obtain a given SPL is very large when compared to the volume of air that must be moved to obtain the same SPL at high frequency. Loud and low means a very high volume of air movement. This is the reason that low-frequency transducers (woofers) are generally large compared to high frequency transducers (tweeters).

The volume of air moved by a piston (a loudspeaker can acoustically be thought of as a piston) is proportional to the piston area times the piston stroke. Normally large volumes of air are moved by utilizing a large piston area i.e., large diameter speaker cone, and moving the piston back and forth a relatively small distance. An added challenge exists when designing drivers with small piston diameters in that the area is proportional to the square of the diameter, meaning that the piston movement length must go up with the inverse square of the piston diameter to obtain a given SPL. Displaced volume increasing with the square of cone diameter can mean larger speakers.

Compact loudspeakers intended for low-frequency use are often designed by using a small diameter cone with a large maximum excursion.

FIG. 1-1 shows a typical conventional loudspeaker driver. With conventional loudspeaker technology, maximum excursion limit 112 possible for a given loudspeaker is usually limited by a design relationship between magnet 104 length and magnetic leakage 103. FIG. 1-1 illustrates that the excursion of voice coil former 101 is limited by back plate 102. FIG. 1-1 also shows that magnetic circuit 107 passes through the back plate 102 to complete the magnetic circuit. Usually the greater the distance between back plate 102 and top plate 108, the greater the area contributing to the magnetic flux leakage 103. This leakage may reduce the amount of magnetic flux in magnetic gap 109, which in turn may reduce the speaker strength, or force per ampere of current in voice coil 110. This reduced speaker strength decreases the efficiency of the speaker and its ability to produce acoustic output.

Magnetic leakage 103 and the associated reduction of flux in magnetic gap 109 can aggravate the overall long-excursion design problem because as the excursion becomes longer, the force needed to accelerate the moving mass through the excursion can become greater. This situation can create a need for high speaker strength, hence a large amount of magnetic flux in order to avoid requiring a large current to obtain the requisite force. A large current will tend to increase heat and could even overheat the voice coil 110.

As magnetic leakage 103 becomes greater with increasing excursion limit 112, a larger magnet 104 is usually used to create the needed flux in magnetic gap 109. The larger magnet 104 usually increases the weight and cost of the speaker, which is a commercial disadvantage. A further magnetic penalty for loudspeakers with long excursion can derive from the fact that spider 105 and surround 106 usually also have limited excursion ability. Spider 105 and surround 106 perform functions including keeping voice coil former 101 centered radially in magnetic gap 109. If voice coil 110 makes contact with top plate 108, or magnet 104, the voice coil will likely be destroyed. The nature of spider 105 and surround 106 devices dictates that the longer the excursion capability is, the smaller the radial stiffness and ability to center voice coil former 101 in magnetic gap 109. Therefore, as excursion limit 112 becomes longer, magnetic gap 109 often becomes larger to avoid damage to voice coil 110. The larger gap usually has an increased magnetic reluctance, which in turn can reduce the flux in magnetic gap 109. This reduction in flux can have the negative effect of reduced speaker strength. The need to dissipate heat can also create the need for a larger magnetic gap.

Almost every inherent relationship among loudspeaker parameters works against using a small diameter cone to move a large amount of air. A traditional approach to creating an overall loudspeaker assembly with high acoustic output at low frequency is to place the driver in a tuned-resonance enclosure that emits the sound or audio. A tuned-resonance enclosure can allow reasonably large excursion without a large applied force from voice coil 110 because mechanical resonant systems can produce a large output swing with a small force input at resonance. This can reduce the need for higher speaker strength and hence, can lower magnetic leakage. Drivers with moderate excursion limits and speaker strength are available from commercial sources for this purpose. The use of a tuned-resonance enclosure can have several shortcomings; however. Resonance tuning can require the enclosure to be of a specified volume, which can be determined by the physical parameters of the driver and the frequency response desired. In general, the greater the low frequency output, the larger the enclosure size. This can be a disadvantage in terms of weight and portability among other aspects. The low-frequency performance of a conventional driver utilized in a tuned-resonance enclosure can often be limited by excursion limits 112 of the driver. Even though the driver can produce a moderate excursion with a moderate amount of magnetic leakage 103, the magnetic leakage usually reduces the overall efficiency of the driver and can limit even the mid-frequency and high-frequency performance of the driver, which do not benefit from the resonant enclosure.

The mechanical resonant system may also have a phase-frequency response function between the applied voice coil force and cone acceleration, because stored energy in the system (pressure in the enclosure) pushes on the cone in one direction or the other depending on the circumstances. Since a phase shift is the same thing as a time delay, signals of different frequencies may be delayed by different times. This "time smear" can be termed group delay, and may be audible at low frequency where the wavelengths and delay time are long. Thus, the acoustic output of a tuned-resonance loudspeaker system can be phase-shifted (a phase shift is a frequency-dependent delay) from the input signal. This can produce an audible time delay between the low-frequency and high-frequency components of the signal, and can represent a kind of unwanted distortion.

Another more common failure mode of loudspeakers can include thermal overloading of voice coil 110, which can occur when the loudspeaker is operated at high volume for extended durations. Due to the random nature of audio signals, the user has no way of knowing if and when these conditions will exist, so the speaker system must generally be operated in a conservative fashion. Sometimes, operating the speaker in a conservative fashion causes the speaker to be larger and heavier than would otherwise be required in a given application.

The high-frequency performance of the conventional driver can also be reduced by the inductance of voice coil 110. Because the impedance of the voice coil usually increases with increasing frequency, the amount of current available from the amplifier (and consequently force from the voice coil) usually decreases with increasing frequency. There is also a distortion phenomenon in many ordinary loudspeakers due to the fact that the field induced by the current in the coil may add to and/or subtract from the field created by the permanent magnet. This may also be a source of audio distortion. Furthermore, a voltage is generated by the voice coil moving in the magnetic gap. This is sometimes called the motional voltage, and its polarity may be such that it tends to create a current that will create a force that accelerates the voice coil in the opposite direction from the velocity. The motional voltage may be directly proportional to the velocity and perhaps the speaker strength.

Another problem with a conventional loudspeaker driver is that the speaker strength can change with voice coil 110 position. As voice coil 110 moves out of magnetic gap 109, the number of windings immersed in the magnetic field decreases, thereby usually reducing the speaker strength. This can cause nonlinear distortion in the acoustic output. This nonlinear distortion can even represent the largest source of distortion in the entire sound reproduction system. In fact, nonlinear distortion created in this manner is frequently fifty times the total distortion produced by the remaining components in the signal chain combined. Non-constant speaker strength can also cause distortion. There can exist a design tradeoff between the efficiency of the speaker and the distortion created by the non-constant speaker strength function. By making the voice coil overhang 205*a* longer, the speaker will have more constant speaker strength over a wider range of motion, and hence less distortion. However, this longer voice coil 204*b* will often have increased mass and resistance compared to the shorter voice coil. This can reduce the efficiency of the speaker, since the resistive losses are often increased and the increased mass may result in decreases in sound pressure output for a given current through the voice coil.

FIG. 2-1 shows a conventional loudspeaker with a basket design. The surround 201 and spider 207 serve as the suspension for the cone 206*b*. The basket 201*b* provides the support structure for the suspension and magnetic circuit. Dust cap 206 prevents debris from accumulating in the magnetic gap 203*b*. The magnetic circuit is composed of the magnet 202*b*, top plate 202, back plate 203, inner pole piece 204*a*, and magnetic gap 203*b*. The force to move the cone is generated by current flowing through the voice coil 204*b*, a portion of which is immersed in the magnetic gap 203*b*. The force created by a given current, or speaker strength which causes a magnetically generated audio force is directly proportional to the strength of the magnetic field and the number of turns of wire immersed in it. FIG. 3-1 shows a cross-section of a typical dynamic loudspeaker. The basket 301*b* serves as a structure for mounting the surround 301, spider 307, and magnet structure 303*c*, which consists of the top plate 302*a*, magnet 302*b*, back plate 303, and inner pole piece 304. The annular magnetic gap 303*b* is formed by the top plate 302*a* and inner pole piece 304. For optimum magnetic performance, the magnetic gap 303*b* must be kept as narrow in the radial direction as possible. The magnetic gap must be somewhat wider in the radial direction than the voice coil assembly 305*c* in order to allow movement of the moving components without interfering with the magnetic structure 303*c*. The flying leads 305*a* carry current to and from the terminals 305*b* to the voice coil assembly 305*c*.

DISCLOSURE OF INVENTION

To address the mentioned aspects, as well as others, the present invention includes a variety of embodiments that may be used and configured in different combinations based upon the particular application or needs to be addressed.

Embodiments of the present invention can include a loudspeaker system having multiple magnetic circuits, multiple voice coil windings, current commutated by a controller, single magnetic elements, multiple magnetic elements, surface mount current traces, copper foil interconnections, voice coil position sensing, and perhaps even an imprinted position transducer encoding track.

In some embodiments, the radial component of the magnetic flux density field produced by a magnet assembly may not form a perfect sine wave along the axis of the magnet structure. In some embodiments it may be desirable for the radial component of the flux density field to form a more perfect sine wave. There may also be a need to minimizing cogging (small variations in strength within the range of movement of a cone or traveling assembly. It may also be desirable for the radial magnetic field distribution to have exaggerated peaks, perhaps coincident with pole pieces, so that the speaker strength can be increased within a small range of motion. This can increase the overall operating efficiency of the driver, which may experience infrequent large excursion peaks. Also embodiments can address instances in which the magnetic field may have non-uniform variations due to manufacturing tolerances in the magnetic components.

Objects of various embodiments of the invention can include:

- Providing a loudspeaker driver with reduced overall size for a given acoustic output.
- Providing a loudspeaker driver with high acoustic output at low frequency with a small diameter cone.

Providing a loudspeaker driver with an excursion limit independent of the speaker strength and magnetic losses.

Providing a loudspeaker driver that has a less restrained excursion limit

Providing a loudspeaker driver with low magnetic losses.

Providing a loudspeaker driver with reduced inductance.

Providing a loudspeaker speaker with high speaker strength capability.

Providing a loudspeaker driver with a low-frequency response more easily affected and perhaps independent of the enclosure volume.

Providing a loudspeaker speaker with force more linearly proportional to an input. Providing a loudspeaker with speaker strength that changes less with voice coil position relative to the magnetic gap.

Providing a speaker that is less susceptible to or perhaps even impossible for the user to damage by manipulation of the input signal.

Providing a loudspeaker that has reduced low-frequency phase shift.

Providing a loudspeaker with reduced nonlinear distortion.

Providing a loudspeaker that does not require as large a magnetic gap to accommodate a large excursion limit.

Providing a loudspeaker that can be operated with a two-channel amplifier.

Providing a loudspeaker that is producible with ordinary production means.

Providing a loudspeaker driver with reduced power consumption for a given mechanical design and acoustic output.

Providing a loudspeaker with low heat generation for a given acoustic output.

Providing a loudspeaker with reduced harmonic distortion.

Providing a loudspeaker with reduced physical size and weight.

Providing an loudspeaker system that is enhanced relative to conventional technologies.

Providing a voice coil assembly with the ability to electrically connect a single voice coil to the lead such as flying with low increase in the magnetic gap width.

Providing a voice coil assembly with the ability to connect multiple voice coils to leads with minimal increase in magnetic gap.

Providing a voice coil former capable of interconnecting multiple coils in multiple circuits with minimal increase in magnetic gap width.

Providing a voice coil assembly that allows for convenient assembly of multiple coils in multiple circuits.

Providing a voice coil assembly that allows the convenient use of pre-formed coils during assembly.

Providing a voice coil assembly where the coils may be wound on the former.

Providing a voice coil former that can be used as the encoding track for a position measurement transducer.

Providing a voice coil former that may be manufactured by ordinary flexible printed-circuit techniques.

Further objects and advantages will become apparent from consideration of the ensuing description and drawings.

BRIEF DESCRIPTION OF DRAWINGS

FIG. 1-2A shows a cross-section of a driver portion of an embodiment of the invention.

FIG. 1-2B shows a close-up cross-section of the voice coil speaker of an embodiment of the invention.

FIGS. 1-3A to 1-3D show a sequence of some positions of the voice coil assembly in the magnetic structure as it moves a distance, such as equal to the axial pitch, between pole pieces.

FIG. 1-4 shows a set of graphs that describe some current commutation functions for voice coil windings.

FIG. 1-5 shows a block diagram of some control and electrical components for an embodiment of the invention.

FIG. 1-6 shows a cross-section of an embodiment with a conventional suspension.

FIG. 1-7 shows a cross-section of an embodiment with a fixed outer magnetic shorting element FIG. 1-8 shows a cross-section of an embodiment with a moving outer magnetic shorting element.

FIG. 1-9 shows a cross-section of an embodiment with both an inner and outer magnetic stator.

FIG. 1-10 shows a cross-section of an embodiment with an outer magnetic stator and an inner magnetic shorting element.

FIG. 1-11 shows a cross-section of an embodiment with concentric, opposed motion armatures on a common stator.

FIG. 2-1 shows a cross section of a convention loudspeaker design.

FIG. 2-2 shows a cross-section along the axis of symmetry of the mechanical arrangement of an embodiment of the invention.

FIG. 2-3 shows a block diagram of a controller for embodiment of the invention.

FIGS. 2-4A to 2-4D show a graph of a large-amplitude, low-frequency input signal and the resulting acceleration, velocity, and position of the voice coil assembly.

FIGS. 2-5A to 2-5C are graphical descriptions of the force commutation functions of an embodiment of the invention.

FIGS. 2-6A to 2-6D show a graphical description of the force applied by the voice coil assembly to achieve the motion described in FIG. 2-4A-D, as well as the force applied by the individual coils that make up a voice coil assembly.

FIGS. 2-7A to 2-7C show the current applied to each of the voice coils of embodiment of the invention to achieve the forces described in FIGS. 2-6A to 2-6D.

FIGS. 2-8A to 2-8C show the voltage applied to each of the voice coils of embodiment of the invention to achieve the currents described in FIGS. 2-7A to 2-7C.

FIGS. 2-9A to 2-9C show graphs of the speaker strength of each of the voice coils with respect to the position of a voice coil assembly.

FIG. 2-10 shows an alternate embodiment that requires only two amplifiers to operate.

FIG. 2-11 shows the commutation of the alternate embodiment shown in FIG. 2-10.

FIG. 2-12 shows the controller portion of the alternate embodiment shown in FIG. 2-12.

FIG. 2-13 show an alternate embodiment that has reduced physical size and mass.

FIG. 2-14 shows the controller portion of the embodiment shown in FIG. 2-13.

FIG. 2-15 shows the commutation of the embodiment shown in FIG. 2-13.

FIG. 3-1 shows a cross section of a conventional loudspeaker.

FIG. 3-2 shows a detail view of a typical voice coil assembly.

FIG. 3-3 shows a detail view of a conventional voice coil assembly with two voice coils.

FIG. 3-4 shows an assembled view an embodiment of the invention.

FIG. 3-5 shows an electrical schematic of the assembly shown in FIG. 3-4.

FIG. 3-6 shows a plan view of a voice coil former unwrapped with the outer surface facing the reader.

FIG. 3-7 shows a plan view of a voice coil former unwrapped with the inner surface facing the reader.

FIG. 3-8 shows a cross section of a driver utilizing a position transducer encoding track of an embodiment of the invention.

FIG. 4-1 shows a perspective cross-section of embodiment of the invention.

FIG. 4-2 shows an exploded view of embodiment of the invention showing the main components of the speaker: voice coil assembly, magnets, pole pieces, and outer shorting tube.

FIG. 4-3 shows a conceptual plot of the relationships between sound pressure level and frequency for a more conventional design.

FIG. 4-4 shows a conceptual plot of the relationships between sound pressure level and frequency for an embodiment of the invention.

FIG. 4-5 shows magnetic flux density for a more conventional design.

FIG. 4-6 shows magnetic flux density and cross section depiction for an embodiment of the invention indicating the magnetic field and the windings.

FIG. 4-7 shows more complete magnetic flux density for an embodiment of the invention.

FIG. 4-8 shows an exploded view of a voice coil assembly according to one embodiment of the invention showing multiple windings and a method of interconnecting multiple coils.

MODE(S) FOR CARRYING OUT THE INVENTION

As mentioned earlier, the present invention includes a variety of aspects, which may be combined in different ways. The following descriptions are provided to list elements and describe some of the embodiments of the present invention. These elements are listed with initial embodiments, however it should be understood that they may be combined in any manner and in any number to create additional embodiments. The variously described examples and embodiments should not be construed to limit the present invention to only the explicitly described systems, techniques, and applications. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

Figure 1:
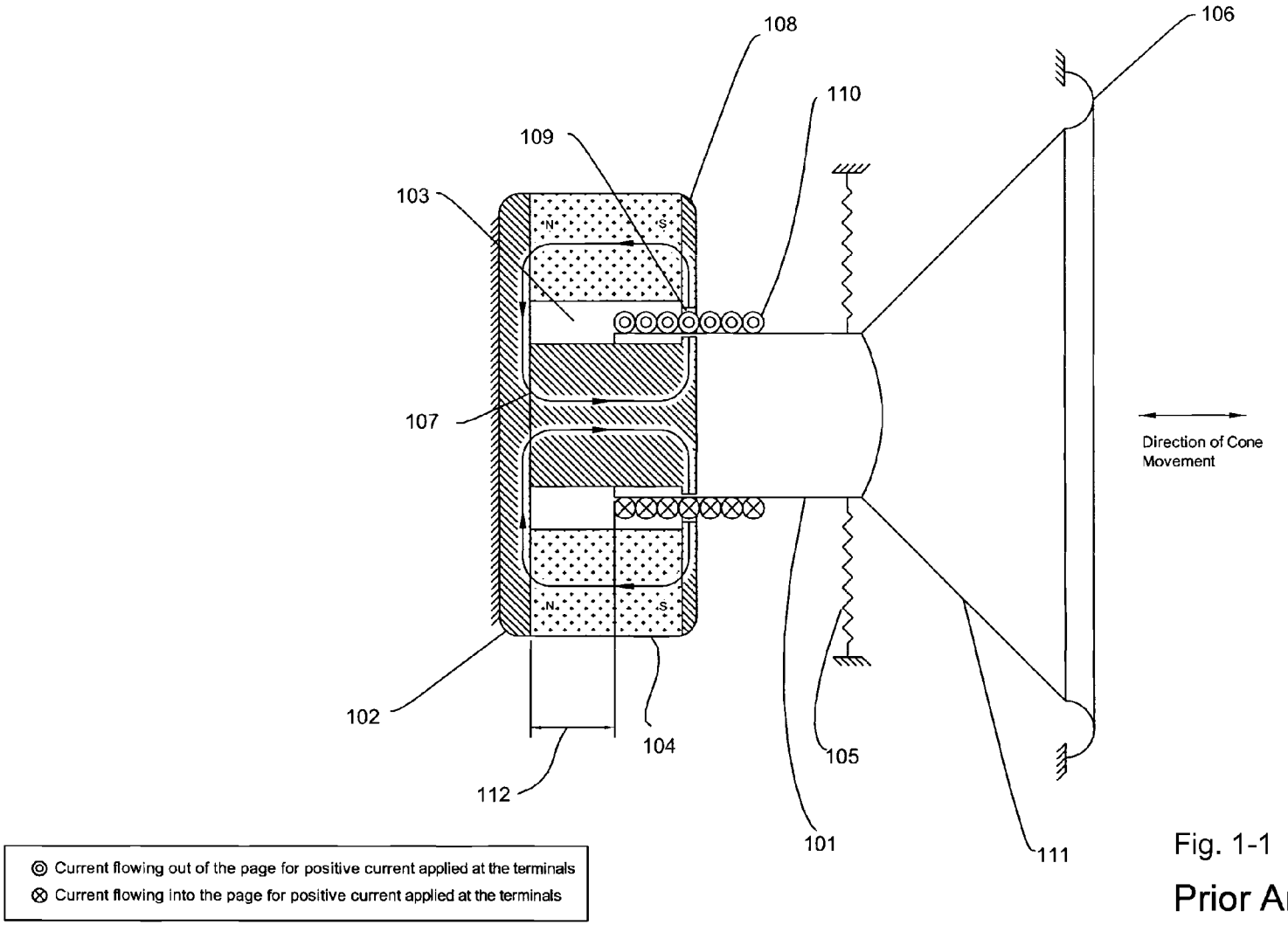
Fig. 1-1 Prior Art
FIG. 1-1 shows a cross-section of a conventional loudspeaker driver.
Figures 1, 2, 2A:
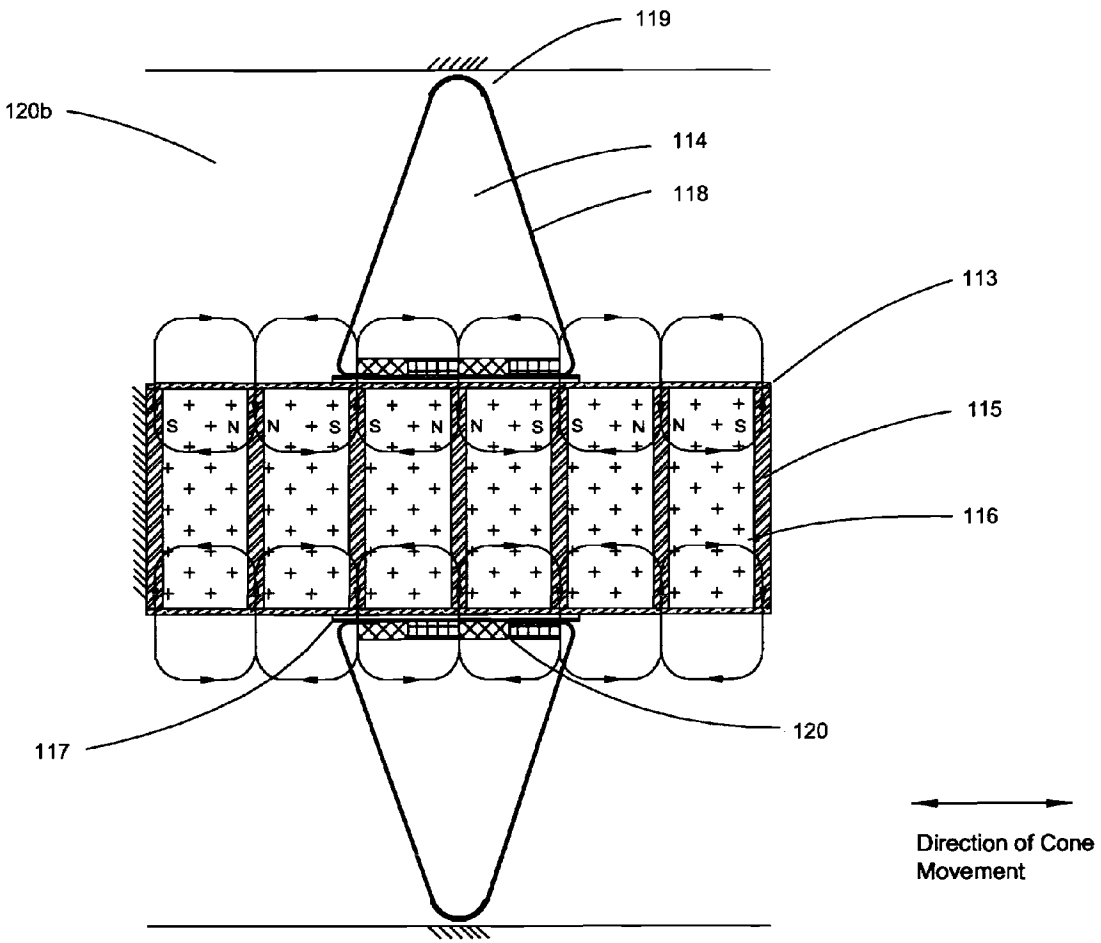

FIG. 1-2A shows a cross-section of the driver portion of an embodiment. The major components of the driver shown include a magnet component, perhaps a permanent magnet material and perhaps such as a magnet assembly 113 and a traveling assembly 114, which may slide along the magnet assembly which may be positioned as a fixed drive component. It may also be a coil centered traveling assembly as shown. The magnet assembly 113 may consist of a cylindrical magnetic structure, perhaps even with adjacent magnets and perhaps coaxial magnets with alternating axial layers of disc-shaped steel pole pieces 115 and magnets 116, which may be bonded together. Alternate layers of inner magnets 116 may be arranged with alternating pole magnets so that like poles of adjacent magnets face each other i.e., North to North, South to South, North to North, etc. The poles of the alternating axial layers may be adjacent or even immediately adjacent with the smallest practical distance in between.

Voice coil former 117 can slide on perhaps a smooth outer surface of the magnet assembly 113. This may act on and apply force to a movable transfer to relay force perhaps attached to an air movement element. This may transfer the magnetically generated audio force to an air movement element. In an embodiment, the air movement element may be a cone or other such assembly 118 and may even be mechanically rigid. It may be a free movement element and not attached by any membrane (spider or surround) and as such present a membraneless suspension system. The weight of the cone can rest entirely on voice coil former 117, which may be supported by magnet assembly 113 and so substantially supported by a moveable drive component. The voice coil assembly may be a mechanical support for an acoustic diaphragm. Cone assembly 118 may serve the purpose of moving the volume of air, somewhat similar to a conventional loudspeaker. It can even be merely an air movement element of any configuration. An annular gap may be formed, perhaps by magnetically permeable material, to present a piston air gap 119. This may form an annulus of any shape around the cone and may thus form a coaxial annular gap. Piston air gap 119 may be small enough to disallow any substantial leakage of air during normal operation but large enough to allow free movement of the cone. As can be appreciated, the air movement element may be a mechanically rigid free movement element and may thus more efficiently achieve its desired effect of air movement.

Figures 1, 2, 2B:
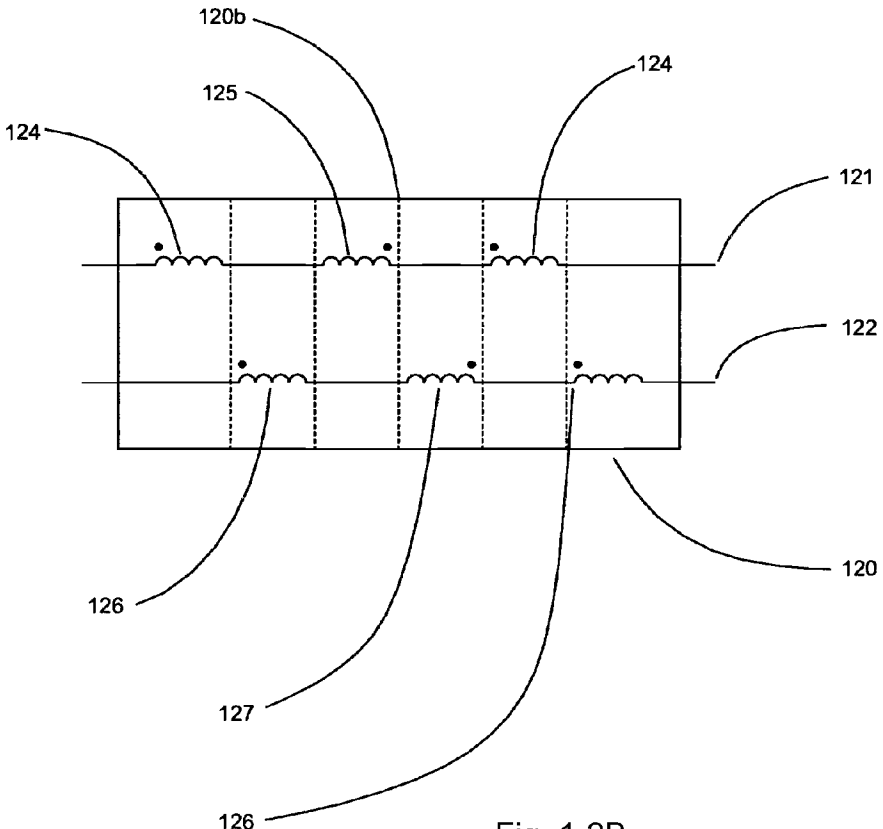

FIG. 1-3A shows a detailed cross section of a voice coil assembly 120 in a magnetic field of a magnet assembly 113. This portion of a driver may have induction elements such as electrical coils that may even be coaxially adjacent coils that may be interconnected. The elements may present coaxially adjacent induction elements. In this embodiment, phases may be physically laid out on the voice coil former in an alternating counter-wound arrangement that present opposing induction elements (perhaps even in pairs so each cancels the other) such as counterwound coils. As can be seen, the magnets can have a magnet pitch dimension. The pitch between a winding and its counter wound complement can be exactly the distance between adjacent north and south pole pieces or the magnet pitch dimension. The distance between like-wound windings can be twice the distance between the pole pieces. The coils may be separately circuited coils and there may also be two or more winding circuits. Two circuits may offer a good tradeoff between efficiency and cost of implementation. FIG. 1-2B shows one embodiment of a winding circuit for a voice coil assembly such as shown in this embodiment. Axial division lines 120*b* along the axis are used to indicate the axial positions of the winding segments in voice coil assembly 120. Voice coil assembly 120 may be made up of two separate winding circuits or phases, a U winding circuit (121, FIG. 1-2B) and V winding circuit (122, FIG. 1-2B). Each winding circuit (121, 122, FIG. 1-2B) may be made up of two types of alternately placed winding segments. The winding segments may be individual coils of wire wrapped around a voice coil former 117 that may occupy an interval of axial length that can even be less than the magnet pitch dimension (123, FIG. 1-3A), an axial length about equal to a magnet pitch dimension, an axial length greater than a magnet pitch dimension, or even an axial length that is just less than the excursion limit distance. Counter-wound winding segments may be wound or connected such that current flows around the voice coil former 117 in the direction opposite the current flows in the normally-wound or perhaps, adjacent (electrically or physically) winding segments. Winding the phases and exciting the coils can be such that the force per ampere in the windings does not change very much with voice coil position. This can creates an inherently linear transducer. A controller can also act to compensate positional or field nonlinearity or non-constancy.

The U winding circuit (121, FIG. 1-2B) may be made up of alternately placed normally wound U winding segments (124, FIGS. 1-2B, 1-3A) with a winding direction (such as clockwise and counterclockwise) and counter-wound U winding segments (125, FIGS. 1-2B, 1-3A). The winding direction may be the same or common or may be reversed and thus polarity as well (whether or not winding direction is such by current direction). Likewise, the V winding circuit (122, FIG. 1-2B) may be made up of alternately placed normally wound V winding segments (126, FIGS. 1-2B, 1-3A) and counter-wound V winding segments (127, FIG. 1-2B, 1-3A). While the winding segments are shown in the FIG. 1-3A as having only one segment present at a particular axial location, the segments may overlap each other such that multiple segments may be present at a given axial location.

In embodiments, the voice coil inductance may be designed to be very low. Of course, an inductor is a coil of wire that can store energy by creating a magnetic field. In embodiments, the voice coils may be composed of alternating counter-wound segments. These may be co-axially adjacent and even immediately adjacent to each other. This may substantially eliminate a significant amount of what may be referred to as parasitic inductance because the counter-wound coils produce opposite magnetic fields. This reduced inductance not only may reduce or perhaps substantially eliminate the impedance increase at high frequency but may remove distortion caused by magnetic coupling with the magnetic circuit. Because of the alternating, counter-wound arrangement of coils, the magnetic field generated by adjacent winding segments may be polarized in a different direction and opposite and may tend to cancel each other. This can reduce the effective inductance of the winding circuits and may aid in permitting the existence of a low inductance drive system.

The drive system can even have an optimum range of linear excursion. This may have parameters such as:

- a peak to peak linear excursion limit that is at least 0.15 times said piston diameter;
- a peak to peak linear excursion limit that is at least 0.2 times said piston diameter;
- a peak to peak linear excursion limit that is at least 0.3 times said piston diameter;
- a peak to peak linear excursion limit that is at least 0.4 times said piston diameter;
- a peak to peak linear excursion limit that is at least 0.5 times said piston diameter;
- a peak to peak linear excursion limit that is at least 0.8 times said piston diameter;
- a peak to peak linear excursion limit that is at least said piston diameter;
- a peak to peak linear excursion limit that is at least said piston diameter to about twice said piston diameter;
- a peak to peak mechanical excursion limit that is at least 0.15 times said piston diameter;
- a peak to peak mechanical excursion limit that is at least 0.2 times said piston diameter;
- a peak to peak mechanical excursion limit that is at least 0.3 times said piston diameter;
- a peak to peak mechanical excursion limit that is at least 0.4 times said piston diameter;
- a peak to peak mechanical excursion limit that is at least 0.5 times said piston diameter;
- a peak to peak mechanical excursion limit that is at least 0.8 times said piston diameter;
- a peak to peak mechanical excursion limit that is at least said piston diameter; and
- a peak to peak mechanical excursion limit that is at least said piston diameter to about twice said piston diameter.

Embodiments of the invention may have advantages over prior art in terms of reduced parasitic inductance. In many conventional designs, and even those with counter-wound coils, the coils are usually spaced apart by the distance between the pole pieces. The inductive coupling coefficient between the counter-wound coils decreases with distance between the coils because of magnetic leakage. Linear excursion is thus often substantially less than half the distance between the pole pieces (at the midpoint between pole pieces the net B field is zero, beyond the halfway point the B field is in the wrong direction). Therefore, the coupling coefficient is frequently limited by the linear excursion limit, and the two design goals of long linear excursion limit and low inductance are competing. Low inductance and drives can have values such as:

- a maximum inductance of less than about 7 millihenries;
- a maximum inductance of less than about 1 millihenries;
- a maximum inductance of less than about 7 to less than about 0.5 millihenries;
- a maximum inductance of less than about 7 millihenries with mechanical parameters that generate about a 10 millihenries for a conventional design;
- a maximum inductance of less than about 1 millihenries with mechanical parameters that generate about a 10 millihenries for a conventional design;
- a maximum inductance of less than about 7 millihenries with mechanical parameters for a conventional 400 W, 12" design;
- a maximum inductance of less than about 1 millihenries with mechanical parameters for a conventional 400 W, 12" design;
- a maximum inductance of less than about 7 millihenries for a single magnet, multi coil system;
- a maximum inductance of less than about 1 millihenries for a five magnet, multi coil system;
- a maximum inductance of less than about 90% of a mechanically similar conventional design;
- a maximum inductance of less than about 80% of a mechanically similar conventional design;
- a maximum inductance of less than about 70% of a mechanically similar conventional design;
- a maximum inductance of less than about 60% of a mechanically similar conventional design;
- a maximum inductance of less than about 50% of a mechanically similar conventional design;
- a maximum inductance of less than about 40% of a mechanically similar conventional design;
- a maximum inductance of less than about 30% of a mechanically similar conventional design;
- a maximum inductance of less than about 20% of a mechanically similar conventional design;
- a maximum inductance of less than about 10% of a mechanically similar conventional design;
- a maximum inductance of less than about 70% of a mechanically similar conventional design for a single magnet, multi coil system; and
- a maximum inductance of less than about 10% of a mechanically similar conventional design for a five magnet, multi coil system.

As can be appreciated, embodiments can have a commutator to perform a commutation function of selectively acting on individual coils or the line. This may be a current commutator that may act on coils separately and thus be a separately controllable coil commutator. With an electronically activated, positionally sequenced drive system, coils may be sequentially responsive based on position and there may be a position dependent commutator. This may act in a manner that electronically controllably position sequences delivery of power to individual coils.

In embodiments such as the multiple-pole commutated embodiments, the windings may also be spaced apart by the distance between the poles. However, because of commutation, the linear excursion limit may not be related to the distance between the poles. The linear excursion limit can be large compared to the distance between the pole pieces, and therefore the inductive coupling constant may be higher and can now be closely coupled for a given linear excursion limit as compared to prior art. Of course, a single-pole configuration may not feature counter-wound coils and therefore may not have such reduced parasitic inductance relative to the ordinary loudspeaker.

FIG. 1-3A shows that the winding segments in a given winding circuit may be located periodically along the length of the voice coil former 117 and thus present periodic coils. In this manner the coils and the magnets may vary periodically or anti-periodically and there may be a periodic or antiperiodic commutator. The axial pitch between normally-wound and counter-wound winding segments in the same winding circuit 128 can be the same as magnet pitch dimension 123. The pitch between like-wound winding segments in the same winding circuit 129 may be twice a magnet pitch dimension 123. Due to the alternately placed normally-wound and counter-wound segments, the tangential direction of the current in a given winding may be reversed at each adjacent segment when a fixed polarity current is applied at the terminals. The two sets of winding segments may be evenly spaced along the voice coil former so that each winding circuit (121, 122 FIG. 1-2B) can have either one normally-wound segment (124, 126) or one counter-wound segment (125, 127) every distance equal to magnet switch 123.

The winding segments (124, 125, 126, 127) can be wired in series or parallel in order to obtain the desired electrical impedance and thus there may be series or parallel connected coils. Also, for manufacturing purposes, the counter-wound windings (125, 127) may be wound in the same direction as the normally wound segments (124, 126), but connected to the circuit with reversed polarity so that the current flows in the opposite direction as the normally-wound segments for the same applied current at the winding circuit terminals.

Because the number of magnetic gaps can vary, voice coil assembly 120 can be as long as desired. The number of turns of wire immersed in the magnetic field may be directly proportional to the speaker strength. The fact that the voice coil can be very long can make a very high speaker strength possible. This can be understood from the magnetic flux involved in certain embodiments as shown in FIGS. 4-5, 4-6 and 4-7. As is well understood, a current moving through a conductor immersed in a magnetic field produces a force proportional to both the magnetic flux density and the current (Law of Biot and Savart). Of course, a voice coil consists of a number of such conductors acting together. Ultimately the translation of electrical signals into the mechanical domain happens because of current in (not voltage across) the voice coil.

In many conventional systems, the magnetic field may be designed to be as constant as possible. In embodiments of the present invention, the magnetic field may be designed to change radically during the normal excursion of the cone or the like. Unlike traditional systems, embodiments can have altered fields to achieve goals that were not possible in conventional systems. Further the enhanced capability of compensation control, mentioned below, can afford an overall better loudspeaker system. This may be achieved by a programmable processor, of course.

As can be appreciated from the basic physics of loudspeakers, the higher the flux density, the more force generated by a given amount of current in the coil. This can be referred to as higher speaker strength. Further, the heat dissipated by the voice coil, which is just wasted energy and tends to damage the voice coil, may be proportional to the current squared times the resistance. So to produce an efficient, cool speaker it may be desirable to have high flux density and low current. The design tradeoff for high flux density can be magnet size—a long magnetic field may be desirable.

The useable length of the magnetic field in a moving-coil loudspeaker is usually occupied by some combination of windings which create motor strength and axial clearance for voice coil movement which defines the linear excursion limit. Any practical magnetic circuit that uses permeable pole pieces or magnetically permeable material to focus the flux is often limited by the saturation flux density of the permeable material. Modern magnetic circuits are generally designed to run in saturation to reduce motor weight and reduce inductive coupling with the coil. Often increasing the pole piece axial length to increase the useable length of magnetic field also increases the minimum axial-plane area of the pole piece and magnet in order to allow increased flux through the saturated pole piece. Therefore, the volume and mass of the motor often vary as the square of the useable magnetic field length. In embodiments such as the multiple-pole commutated loudspeaker invention, the useable magnetic field length may be changed by simply keeping the same pole piece dimension and increasing the number of pole pieces. Therefore, the minimum axial-plane area of the pole pieces may be understood as not dependent on the useable field length, and the volume and mass of the motor may vary in direct proportion to the useable magnetic field length.

Further, in a conventional moving-coil loudspeaker, there can be a specific length of voice coil that may give optimal thermal voice coil efficiency for a given magnetic circuit. For some conventional loudspeakers, this is often approximately twice the thickness of the pole piece. The optimization balances the number of windings immersed in the magnetic field, which create motor strength, and the resistance of the winding. If the coil is shorter than the optimal length the resistance is lowered but the motor strength is lowered also and this reduces the efficiency. If the voice coil is longer than the optimal length the resistance is increased but the motor strength is not increased enough to balance the increased resistance. High-excursion loudspeakers generally have an overhung voice coil, meaning that the voice coil is longer than the useable magnetic field in order to allow a larger linear excursion limit. In this case long linear excursion limit and low voice coil resistance are often directly competing design goals. An under-hung voice coil, in which the coil is shorter than the magnetic field, is not practical for non-commutated high excursion loudspeakers because of the need for a very large magnet. In addition, the under-hung voice coil is often much shorter than the optimal length. In embodiments such as the commutated loudspeaker invention, the multiple coils may be selectively energized based on the voice coil position relative to the magnetic field. The coils that are not energized do not contribute to the effective resistance of the coil, because no current is flowing and therefore no power is dissipated. As the number of commutated circuits increases, the effective resistance decreases because of increasing ability to optimally energize the windings. In certain commutated loudspeaker embodiments, the effective coil resistance may even not be directly related to the linear excursion limit. Also, in the multiple-pole commutated loudspeaker, the under-hung design may be practical for high-excursion drivers.

As mentioned, a major source of distortion in loudspeakers can result from the fact that the voice coil may travel out of the magnetic field. This can present a variable efficacy drive system. Nonlinear stiffness of the suspension can also produce a similar effect. In order to reduce this type of distortion, it may be desirable to make the field as long as possible so that the voice coil can travel a large distance before it starts to leave the field. In conventional speakers, increasing the magnetic field length usually, if not always, requires increasing the magnet size. Furthermore, the magnet structure of a conventional speaker usually forms a mechanical limit to the excursion possible. The path the magnetic flux must travel through becomes longer as the excursion becomes longer. The flux has to go around the end of the voice coil. An inherent problem with many conventional designs is that the longer the flux path, the greater the surface area of the circuit, and the greater the magnetic leakage. This can ultimately mean that as the excursion becomes longer the magnetic circuit becomes less efficient, and a greater volume of permanent magnet material is required to obtain the same speaker strength. This has weight and cost implications.

A magnetic design goal is often to keep the gap radius to a minimum. As the magnetic air gap (the annular gap that the voice coil is centered in) becomes smaller in radial thickness a larger flux density occurs, which increases the speaker strength. In terms of the magnetic circuit, it is generally desirable to keep the thickness of the air gap to a minimum. However, the heat generated by the voice coil must be dissipated, and the larger the gap is, the better the cooling. It is often difficult to get air circulation near the voice coil. The conventional loudspeaker design is somewhat limited in its ability to introduce ambient air to the area immediately surround in a voice coil because the optimal magnetic circuit has as narrow a gap as possible. Increasing the magnetic gap radius allows for better convection, but carries the cost of increased magnetic circuit weight. Often holes are added to the pole pieces to allow more air to circulate. Generally the introduction of these holes comes at the expense of magnetic efficiency, since the holes are part of the magnetic circuit. Generally, the designer must balance the cooling needs with efficiency, size, and weight considerations. Embodiments can also have the ability to dissipate more heat. Unlike many traditional drivers, both ends of the speaker structure can be configured to be open to air. This can allow more air to circulate around the voice coil and can even permit the possibility of forced-air cooling. The speaker structure can easily have many vent holes without significantly affecting the speaker strength or magnet requirements.

Some embodiments of the invention can have magnetic design properties far superior to more traditional drivers. One advantage may be that there may be very little leakage in the magnetic circuit. Embodiments can present a low leakage circuit. A large percentage of the magnetic flux created by the magnet(s) may be properly located and oriented to create force in conjunction with the voice coil current. The end result can be that to obtain a given efficiency less magnet material may be needed.

Significant from some regards is the fact that with such designs it is now possible to increase the speaker strength to achieve the high efficiency necessary for a very long excursion driver. Extremely long magnetic fields are possible. Instead of increasing the diameter of the voice coil and also increasing the leakage, embodiments can simply increase the length of the speaker by adding more pole pieces. Surprisingly, this can even decrease the percentage of leakage. Most of the leakage flux occurs at the ends, so magnets added in the middle operate at very little loss. To create more linear excursion, embodiments of the invention permit a designer to add more pole pieces and magnets. This can be accomplished with little or no tradeoffs and thus the invention can present an intransigently extensile drive system. Embodiments can even have as much travel as the suspension will allow. This scability can afford a variety of design advantages. Systems may be configured to provide an excursion limit that is substantially independent of audio sensitivity, to provide an excursion limit that is substantially independent of magnetic losses, so that for a given field strength per linear dimension magnetic weight increases substantially linearly with the length of magnetic field, or the like. From a mechanical perspective, the magnetic layout of some embodiments can even have geometric advantages over a conventional design. Because both ends of the magnetic circuit are open in some embodiments, there may be no mechanical excursion limitation imposed by the magnetic circuit. From the design standpoint, this can mean that the speaker strength and excursion can be independent variables. This may allow for alternative design optimizations, such as high peak excursion. Incidentally, the open end designs such as a dual open ended drive system may allow for better air circulation, better cooling, and may also enable the possibility of locating the spider on the back end of the speaker, which perhaps could reduce cone breakup and prevent rubbing.

Consider the efficiency to produce a force necessary for a speaker to move the piston and air. The force generated by the coil of wire is current times the speaker strength. The heat dissipated by the coil is the current squared time the resistance. Efficiency can be considered in terms of the ratio of force output squared to heat dissipated. An efficiency figure of merit for a loudspeaker motor may be:

$$\eta=(BL)^2/R=F^2/P \text{ where:}$$

$\eta$ is the efficiency figure
BL is the motor strength (newtons/amp)
R is the coil resistance (ohms)
F is the force generated
P is the thermal power dissipated.

$\eta$ may be the ratio of the square of the force produced to the thermal power dissipated. (ohmic losses) and may be expressed in units of $N^2/W$ of its equivalent kg/sec. In the single-pole embodiment, the efficiency may be increased relative to the equivalent prior art because of the effective reduction of resistance. In the multiple-pole configuration, the efficiency may be increased relative to the equivalent prior art both because of the reduced effective resistance and because of increased motor strength available for the same motor weight. In embodiments, it can now be easy to create high speaker strength or a high efficiency drive system. This alone can give the technology an upper hand in efficiency.

Embodiments can increase efficiency by de-energizing the inactive coils, effectively reducing the resistance. It can also act to de-energize at least one of the interconnected banks of coils. The voice coil 245 moves back and forth in the magnetic gap 203*b*, and may conventionally be longer than the length of the magnetic gap 203*b* by the length of the voice coil overhang 205*a*, so that a portion of the voice coil remains immersed in the magnetic field when the coil moves. As long as the number of turns of wire immersed in the magnetic field is constant, the voice coil speaker will theoretically produce a constant force per ampere of current (speaker strength), and will theoretically have linear response. When the voice coil travels outside of the magnetic gap, the speaker strength begins to change. The longer the voice coil overhang 205*a* is, the greater the range of linearity for the loudspeaker.

Efficiency advantages can be implemented and used in a variety of manners. Systems may be configured to consume low power for a given sound pressure level output, may be configured to produce low heat for a given sound pressure level output, may produce more power for a given size of enclosure, may produce more audio sensitivity for a given amount of power, or the like. Efficiency and drives can have values such as:

a greater than about 120 kg/s efficient drive system at a field centered location;

a greater than about 95 kg/s efficient drive system at a field centered location;

a greater than about 75 kg/s to about 200 kg/s efficient drive system at a field centered location;

a greater than about 80 kg/s efficient drive system at an off field location;

a greater than about 40 kg/s efficient drive system at an off field location;

a greater than about 30 kg/s to about 100 kg/s efficient drive system at a field centered location;

a greater than about 120 kg/s efficient drive system at a field centered location with mechanical parameters that generate about a 70 kg/s efficient drive system at a field centered location for a conventional design;

a greater than about 95 kg/s efficient drive system at a field centered location 70 kg/s efficient drive system at a field centered location;

a greater than about 80 kg/s efficient drive system at an off field location 25 kg/s efficient drive system at a field centered location;

a greater than about 40 kg/s efficient drive system at an off field location 25 kg/s efficient drive system at a field centered location;

a greater than about 120 kg/s efficient drive system at a field centered location with mechanical parameters that generate about a 70 kg/s efficient drive system at a field centered location for a conventional 400 W, 12" design;

a greater than about 95 kg/s efficient drive system at a field centered location 70 kg/s efficient drive system at a field centered location for a conventional 400 W, 12" design;

a greater than about 80 kg/s efficient drive system at an off field location 25 kg/s efficient drive system at a field centered location for a conventional 400 W, 12" design;

a greater than about 40 kg/s efficient drive system at an off field location 25 kg/s efficient drive system at a field centered location for a conventional 400 W, 12" design;

a greater than about 120 kg/s efficient drive system at a field centered location for a five magnet, multi coil system;

a greater than about 95 kg/s efficient drive system at a field centered location for a single magnet, multi coil system;

a greater than about 80 kg/s efficient drive system at an off field location for a five magnet, multi coil system;

a greater than about 40 kg/s efficient drive system at an off field location for a single magnet, multi coil system;

a field centered efficiency value that is at least about 170% of a mechanically similar conventional design;

an off field efficiency value that is at least about 320% of a mechanically similar conventional design;

a field centered efficiency value that is at least about 135% of a mechanically similar conventional design;

an off field efficiency value that is at least about 160% of a mechanically similar conventional design;

a field centered efficiency value that is at least about 135% to about 200% of a mechanically similar conventional design;

an off field efficiency value that is at least about 160% to about 400% of a mechanically similar conventional design;

a greater than about 80 kg/s efficient drive system at a field centered location;

a greater than about 100 kg/s efficient drive system at a field centered location;

a greater than about 120 kg/s efficient drive system at a field centered location;

a greater than about 140 kg/s efficient drive system at a field centered location;

a greater than about 160 kg/s efficient drive system at a field centered location;

a greater than about 180 kg/s efficient drive system at a field centered location;

a greater than about 200 kg/s efficient drive system at a field centered location;

a greater than about 220 kg/s efficient drive system at a field centered location;

a greater than about 30 kg/s efficient drive system at a field centered location;

a greater than about 40 kg/s efficient drive system at an off field location;

a greater than about 50 kg/s efficient drive system at an off field location;

a greater than about 60 kg/s efficient drive system at an off field location;

a greater than about 70 kg/s efficient drive system at an off field location;

a greater than about 80 kg/s efficient drive system at an off field location;

a greater than about 90 kg/s efficient drive system at an off field location;

a greater than about 100 kg/s efficient drive system at an off field location;

an efficiency value that is at least about 120% of a mechanically similar conventional design;

an efficiency value that is at least about 150% of a mechanically similar conventional design;

an efficiency value that is at least about 200% of a mechanically similar conventional design;

an efficiency value that is at least about 250% of a mechanically similar conventional design;

an efficiency value that is at least about 300% of a mechanically similar conventional design;

an efficiency value that is at least about 350% of a mechanically similar conventional design;

an efficiency value that is at least about 400% of a mechanically similar conventional design.

The driver 120*b* can be used in combination with some type of controller 150 as shown in FIG. 1-5. Electronic or perhaps digital control can have significant advantages. Acoustic advantages can exist by a proper controller. In embodiments involving electronic commutation a controller may be useful. This controller can also be used for linearization and protection with no significant increase in hardware cost. Digital control can remove a possible requirement that the mechanical resonance be tuned to approximate constant SPL for constant input voltage. The resonance can now be tuned to minimize the power consumed by a typical program. Because of relaxed excursion limits and high speaker efficiency, embodiments can have high acoustic output at very low frequency without the need to have a very low resonant frequency. Bass response can even be largely independent of mechanical resonance. In fact with embodiments, resonance may not limit sound frequency at low output. Resonance may no longer be a determining factor in the acoustic roll-off frequency. The term roll-off (a characteristic of a dynamic system determined by resonance) may not even apply in the traditional sense. In embodiments, a controller may compensate for the resonant characteristics of the system, and the mechanical resonance may have less or even no effect on the movement profile taken by the speaker. Thus systems can have mechanical resonance that does not coincide with a low frequency rolloff of the driver.

A function of a controller can include controlling the current in the voice coil circuits (121, 122, FIG. 1-2B). A controller can implement commutation functions and thus be a commutation controller, perhaps as shown in FIG. 1-4, (144, 145). This may be positionally sequential so that coils are sequenced based on some position consideration (such as actual position) and thus there may be a positionally sequential controller, or more generally positionally dependent controller. In embodiments, the commutation functions may be position-dependent multipliers for a current command signal such as a master current command signal 151 that is responsive to such a controller. Each winding circuit (121, 122 FIG. 1-2B) may have its own commutation function, which can be a function of the position of voice coil assembly (120, FIGS. 1-2B, 1-3A) relative to the magnet assembly (113, FIGS. 1-2A, 1-3A). The output of a commutation function can directly control the current in an associated winding circuit (121, 122, FIG. 1-2B). The master current command signal 151 may be directly proportional to the force desired to be produced by winding assembly (120, FIG. 1-3A).

Commutation functions 144 and 145 of FIG. 1-4 can be provided by a current magnitude controller or a polarity controller which can determine the appropriate relative magnitude and polarity of current for each of the windings perhaps at every position of the winding assembly (120, FIG. 1-2A). It may be desirable to measure the position of the voice coil during operation for linearity or other compensation or for commutation or selective control of the coils. Care may need to be taken to avoid drift and the position signal may preferably not sense an item only indirect to or not closely coupled to the coils, such as the dust cap or cone (306*a*, 306*b* FIG. 3-1). Preferably it will sense or even be attached or applied to a movable drive component such as the voice coil assembly (305*c*, FIG. 3-1) or the voice coil former as a target. This may cause error in the measurement of voice coil position relative to the magnetic structure perhaps because of cone deflection or perhaps due to wobble caused by high accelerations experienced during operation. It may be applied to attached to an inside or an outside of a movable drive component. Some methods of sensing position can also be sensitive to acoustic noise from the environment, that is, they may be microphonic. The microphonic noise can then be introduced into the program signal. By integrally sensing a position the system can be configured to avoid this problem as well. One example is shown schematically in FIG. 1-5, a position sensor 152*a* can be used to measure the position of voice coil assembly (120, FIG. 1-2A) relative to the position of magnet assembly or perhaps at just the ends (113, FIG. 1-3A). This sensor may be an optical position sensor, accelerometer, software, linear encoder, pressure sensor, microphone, or any other type of sensor from which the position of traveling assembly (114, FIG. 1-2A), or perhaps the voice coil or the voice coil former 117, can be calculated or inferred by the position calculation 153. The sensor may also be of the discrete output type. It may provide a motion feedback input 152*f*. The position calculation can use a dynamic model of the driver to determine the position. A discrete sensor can merely determine a reference position, and all other positions can be calculated by knowledge of the controller output. A controller can use a calculated position as the input to the commutation functions (144, 145, FIG. 1-4), which can also be used to determine the relative current in each of the winding circuits (121, 122, FIG. 1-2B). For commutation, a voice coil discrete resolution sensor drive system can provide actual input to permit reliable commutation action among various coils or the like. This can provide an output that is discrete to each coil and thus act as a discrete output position sensor.

Commutation functions 144 and 145 perhaps as shown in FIG. 1-4 can have several important characteristics. First, they can be periodic with a period equal to twice the magnet pitch dimension (123, FIG. 1-3A) (or anti-periodic with anti-period equal to the magnet pitch dimension). The commutation functions may have both positive and negative peaks, and the positive and negative peak values may be equal in magnitude and opposite in polarity. The positive peak may be located at the position where the winding associated with the commutation function is aligned with the pole pieces, and the negative peak may be located a distance of one magnet pitch (123, FIG. 1-3A) away. The average value for one complete period can also be zero. Commutation functions can be optimized to give both optimal efficiency and linear output by controlling both the overall current and the distribution of current among the winding circuits. As can be understood, drivers can act with a positional period about equal to twice a magnet pitch dimension, with a positional peak aligned with magnet poles, with a negative positional peak aligned one magnet pitch dimension away from a positive positional peak, with a full period average value of zero, and even just within the range of linear motion.

One way to describe the operation of an embodiment of the invention is to examine one type of operation when a voice coil assembly (120, FIG. 1-2A) is producing a constant force while moving axially. Master command signal (151, FIG. 1-5) may be constant in the case of constant force. Since the commutation function can be a multiplier for the master current command signal (151, FIG. 5), the commutation functions and current in the winding can have the same shape. The only significant difference between the current waveform and the commutation function in this case may be the scale, which is not shown anyway. FIG. 1-4 shows a commutation function for each of the windings (144, 145).

FIGS. 1-3A through 1-3D show a sequence of the relative position of voice coil assembly 120 such as when traveling assembly 114 moves a distance of one magnet pitch 123. Lines A through D (141A, 141B, 141C, 141D) of FIG. 1-4 intersect current commutation functions (144, 145) at the positions shown in FIG. 1-3A through 3D, respectively.

FIG. 1-3A shows voice coil assembly 120 positioned so that normally-wound U winding segments 124 are aligned with magnetic gaps with outward flux 130, and counter-wound U winding segments 125 are aligned with magnetic gaps with inward flux 131. In this embodiment, the V winding segments (126, 127) are shown as located midway between the pole pieces. In FIG. 1-4, Line A 141A intersects U winding circuit commutation function 145 at its positive peak. Notice that the direction of current flow around voice coil former 117 is opposite in magnetic gap with outward flux 130 and magnetic gap with inward flux 131. Because both the magnetic flux and current flow are opposite or opposing, the forces produced by both U winding segments 124 and 125 may be in the same direction. Also notice that Line A 141A intersects the V winding commutation function 144 at zero. In instances where the magnetic field is substantially anti-symmetric about the midpoint between the poles, any current in the V winding circuit may produce zero force anyway.

Using element numbers from FIG. 1-3A, FIG. 1-3B shows the voice coil assembly 120 when it has moved slightly along the axis of motion. Line B 141B in FIG. 1-4 intersects the commutation functions (144, 145) at this position. Notice that the U commutation function 145 has decreased from its positive peak value and that the V commutation function 144 has increased towards its positive peak value. The force load on the voice coil assembly is gradually being transferred from the U winding circuit (121, FIG. 1-2B) to the V winding circuit (122, FIG. 1-2B).

Using element numbers from FIG. 1-3A, FIG. 1-3C shows a voice coil assembly 120 when normally-wound V winding segments 126 are aligned with the magnetic gaps with outward flux 130 and counter-wound V winding segments 127 are aligned with magnetic gaps with inward flux 131. Line C 141C in FIG. 1-4 shows the values of the commutation functions for the voice coil windings at this position. Note that V winding circuit commutation function 144 is now at its positive peak. Also note that U winding circuit commutation function 145 is zero.

Using element numbers from FIG. 1-3A, FIG. 1-3D shows voice coil assembly 120 when it has moved such as the distance of one magnet pitch 123 from its original position shown in FIG. 1-3A. Line D 141D in FIG. 1-4 shows the values of the commutation functions for each of the windings at this position. Note that the U winding commutation function 145 is now at its negative peak and V winding commutation function 144 is at zero again. In the manner illustrated above, the voice coil can produce force throughout the entire range of motion of traveling assembly 114.

In actual operation voice coil assembly (120, FIG. 1-2A) may not be producing a constant force. The force or audio input 151*b* may be modulated by motion control algorithm (154, FIG. 1-5), which may change the value of master current command signal (151, FIG. 1-5). However, the commutation functions may still be applied in the same manner as described in the above analysis. From the above analysis one can see that any realizable force can be obtained at any position, which can eliminate the distortion associated with a voice coil leaving the magnetic gap such as in a conventional driver.

It can be appreciated that a variety of compensation processes and components can be implemented in embodiments of the system. As mentioned above, in embodiments of the present invention the magnetic field may be designed to change radically during the normal excursion of the cone or the like. Working in parallel with this aspect, the system can offer enhanced compensation control. In designs where the radial component of the magnetic flux density field produced by magnet assembly (113, FIG. 1-2A) may not form a perfect sine wave along the axis of the magnet structure, appropriate compensation can be achieved. It may be desirable for the radial component of the flux density field to form a perfect sine wave or otherwise by considered constant in order to maximize speaker strength while minimizing cogging (small variations in speaker strength within the range of movement of traveling assembly) (114, FIG. 1-2A). It may also be desirable for this function to be a non-constant field drive system. It may be a non-sinusoidal axial length distributed field drive system. It may even have exaggerated peaks and present an exaggerated peak field drive system where peaks may be perhaps coincident with the pole pieces perhaps so that the speaker strength can be increased within a small range of motion. This could be considered a magnet pole coincident exaggerated peak field drive system. This can increase the overall operating efficiency of a driver which may experience infrequent large excursion peaks. Also the magnetic field may inevitably have non-uniform variations due to manufacturing tolerances in the magnetic components.

If the amplifiers are not current-mode amplifiers (the output of the amplifier is a current related to the input signal, rather than a voltage) or otherwise, the controller may also compensate for the motional voltage caused by the velocity of the coils moving in the magnetic field. The controller 150 can do this by performing a velocity calculation 156. The output of velocity calculation 156 can be used by a motional voltage compensation algorithm 157, which may convert the master current command 151 to a master voltage command 158 or otherwise provide appropriate contact.

A controller may also implement a variety of compensation functions. It may have an electronic compensator or even a programmable processor compensator. Regardless how designed, it may act to compensate for a variation with position of the speaker strength for each coil. There may be an out of field compensator, an electronic coil de-energizer, or a positionally based compensator. Considering tradeoffs in cost or other practical features, it is even possible to leave coil on when out of field and as such there may be an intentionally magnetic suboptimal compensator and even an out of field coil energized compensator. Embodiment can compensate based on actual position inputs. Further, in instances where there are manufacturing variations, there may be a manufacturing imperfection countering field distribution drive system and this can even be lookup based. As mentioned, there may also be a speaker strength compensation algorithm 159. A position-dependent algorithm may compensate for all deviations of the speaker strength from a constant, and may to some extent eliminate harmonic distortion created by variations in the magnetic field. The output of some speaker strength compensation algorithm 159 may be used by the motion control algorithm 154 and even the motional voltage compensation algorithm 157.

A controller (150, FIG. 1-5) may also implement a motion control algorithm 154, which may control the movement profile of traveling assembly 114 or other element, and hence the air pressure wave associated with that movement. This control algorithm may be varied, perhaps such as a common control algorithm, perhaps including a proportional, integral, derivative (PID) algorithm or ordinary equalization. If a position control algorithm is used, the algorithm may implement software position limits to prevent the driver from being damaged by over travel. Because the motion profile is controlled, distortion and phase shift can be greatly reduced when compared to many conventional loudspeakers. A phase shift compensator can be included. The controller may be used to perhaps even substantially eliminate the audible delay of low frequency signals sometimes associated with phase shift of conventional loudspeakers.

Another possible function of a controller 150 can include monitoring a temperature, perhaps such as that of voice coil assembly (120 FIG. 1-3A). In many designs, most amplifier power turns into heat at the voice coil; only a very small fraction of the amplifier power ends up as acoustic power. Most of the voice coil force is used in accelerating and decelerating the mass of the moving components of the loudspeaker to meet the required movement profile. Moving this driver mass as opposed to the air mass has no acoustic output. Since the DC resistance and temperature coefficient of resistance for each voice coil circuit (121, 122, FIG. 1-2B) can be measured or otherwise known, the temperature can be calculated, sensed, or estimated from items such as the resistance of the voice coil. Regardless of how configured, the system may have a temperature sensor or a temperature estimator and even a temperature effect compensator. Amplifiers 155 shown in FIG. 1-5 may be voltage-mode amplifiers, meaning that the output is a voltage related to the input signal. The resistance may be measured by measuring the current through voice coil winding circuit such as by current sensor 152*e* and dividing by the commanded voltage. Since the voice coil windings will produce a motional voltage as they move through the magnetic field, the measurement can be made while traveling assembly (114, FIG. 1-2A) has zero velocity or otherwise compensated. The temperature calculation 152*b* output, perhaps with current feedback 152*d*, can be used as the input to some type of a temperature protection algorithm 152*c*, which can prevent the user from and protect overheating the voice coil by applying an unacceptable audio input signal. This algorithm can implement a complete shutdown of the driver, can temporarily reduce the controller output to allow the voice coil to cool, or can otherwise act to solve the issue. There may thus be a speaker protection element, a speaker shut down component, or a reduced speaker operation component. Thermal compensation can also calculate overloading such as due to high volume for extended durations compensation. In embodiments, a controller can be used to protect the driver mechanically. The cone position may be constantly known, and the response may be known. The controller can therefore completely limit the movement of the cone to within mechanical bounds. Combined with electrical and thermal protection, Embodiments with a controller could be programmed to create a "blowout-proof" speaker. Nothing the user can do with the input signal may even damage the driver.

Compensation can also occur for movement that might exceed the excursion capability of surround 106 or spider. The controller portion of one embodiment of the system may even make it nearly impossible to damage the driver by manipulating the input signal. By directly limiting the traveling assembly excursion with software and directly monitoring the thermal state of the voice coil assembly the controller may allow operation of the improved loudspeaker system in a manner that is far less conservative than the manner in which traditional loudspeaker systems must be operated. Removing the requirement for conservative operation may allow a lighter and more compact loudspeaker system to be used in any given application.

FIGS. 1-6, 4-1 and 4-2 show embodiments of a loudspeaker and driver that may be similar in operation to the embodiment described above but that use a conventional suspension. The winding circuits may consist of only one winding segment each (135*b*, 135*c*). The driver in FIG. 1-6 may utilize a surround 135 and spider 136, similar to the conventional arrangement in FIG. 1-1. This driver can have the advantage of reduced mechanical noise because there may be no contact between the magnet structure and the voice coil former. The seal between the enclosure volume and surrounding environment can be improved, and the suspension can be manufactured with conventional suspension manufacturing techniques.

FIG. 1-7 shows a cross-section of another embodiment. This embodiment may include an outer magnetic shorting element 137, which may increase the magnetic flux density in the circuit, thereby improving the speaker strength. The system may present an intense force density drive system such that more force per length or magnet volume or driver volume or speaker volume is possible. This embodiment may be inherently magnetically shielded because of the outer shorting ring. This is convenient for a number of reasons, including handling safety and protection of magnetic storage. Force intensity and drives can have values such as:

at least about 22.4 oersted;
at least about 28.4 oersted;
at least about 20 to at least about 100 oersted;
at least about 22.4 oersted with mechanical parameters that generate about a 19.2 oersted conventional design;
at least about 28.4 oersted with mechanical parameters that generate about a 19.2 oersted conventional design;
at least about 22.4 oersted with mechanical parameters for a conventional 400 W, 12" design;
at least about 28.4 oersted with mechanical parameters for a conventional 400 W, 12" design;
at least about 22.4 oersted with mechanical parameters for a conventional 400 W, 12" design as measured at 1 watt;
at least about 28.4 oersted with mechanical parameters for a conventional 400 W, 12" design as measured at 1 watt;
at least about 22.4 oersted for a single magnet, multi coil system;
at least about 28.4 oersted for a five magnet, multi coil system;
at least about 110% of a mechanically similar conventional design;
at least about 115% of a mechanically similar conventional design;
at least about 130% of a mechanically similar conventional design;
at least about 145% of a mechanically similar conventional design;
at least about 160% of a mechanically similar conventional design;
at least about 175% of a mechanically similar conventional design; and
at least about 110% to at least about 200% of a mechanically similar conventional design.

Although this embodiment is shown with a conventional spider 136 and surround 135, it can be used with a sliding suspension similar to the earlier embodiment perhaps in one manner by slotting the magnetic shorting element 137 and designing the cone assembly (118, FIG. 1-2A) accordingly.

FIG. 1-8 shows a cross-section of an embodiment of the invention. This embodiment may feature a movable magnetic shorting element such as a moving outer magnetic shorting element 138 or even a movable magnet element. This can perform the same function as the fixed outer magnetic shorting element described above (137, FIG. 1-7). The moving outer magnetic shorting element 138 may be designed to be as thin (radially) as possible to minimize moving mass. The material may even be a high saturation flux density electrical steel or the like. The advantage of this arrangement may be that the construction of the driver may be simplified and the overall driver weight may be less. Although this embodiment is shown with conventional surround 135 and spider 136, it can be designed in a different manner, such as to utilize the sliding suspension as described in the earlier embodiment.

FIG. 1-9 shows a cross-section of another alternate embodiment of the invention. This embodiment may feature dual magnet elements. These may be both an inner magnet assembly or perhaps stator 139 and an outer magnet assembly or perhaps stator 140. The inner magnet assembly 182 may be similar to the magnet assembly (113, FIG. 1-2A) of the earlier embodiment. The outer pole pieces 181 may be aligned axially with the inner pole pieces 183. The outer magnets 180 may be arranged so that poles opposite those contacting the aligned inner pole pieces 183 are contacting the outer pole piece 181. This arrangement has the advantage of increased magnetic flux density. Although this embodiment is shown with a conventional spider 136 and surround 135, it can also be used with a different arrangement such as a sliding suspension similar to the earlier embodiment perhaps even by suitably slotting the magnetic shorting element 137 and designing the cone assembly (118, FIG. 1-2A) accordingly.

FIG. 1-10 shows another embodiment of a driver. This embodiment is shown similar to the embodiment shown in FIG. 1-9, except that the inner magnet assembly (165 FIG. 1-11) has been replaced with an inner magnetic shorting element 184. This embodiment may have the advantages of the one shown in FIG. 1-9 but perhaps with reduced complexity and cost even if with slightly less flux density.

FIG. 1-11 shows a cross-section of another embodiment. As can be appreciated magnets can be located inside or outside coaxial annular gap within which the voice coil may be disposed. Further, this driver may feature two traveling assemblies, both of which may operate in the same manner as traveling assembly 114 in the prior embodiment. A first traveling assembly 160 may slide over the smooth outer surface of an inner or first magnet assembly 165. A second traveling assembly 161 may slide inside a perhaps smooth inner surface of an outer or second magnet assembly 166. As shown, each of these magnets may actually consist of one more magnets themselves. In addition, the outside gap polarity may be opposite an adjacent inside gap polarity. There may be two hollow cylindrical voice coil assemblies, and first and second moveable drive components. Both voice coil assemblies may share the same magnetic fields, and may be energized by a common set of amplifiers or by separate sets of amplifiers. Both of the traveling assemblies 160 and 161 in FIG. 1-11 may act upon a common enclosure volume 162 such as via an inner air passage 163. An outer air passage 164 may allow fluid or perhaps air moved by second traveling assembly 161 to reach the ambient environment. The two traveling assemblies may even move in opposite directions at substantially all times or be appreciably compensated. In a situation in which the two pistons travel in opposite directions, the air moved by second traveling 161 assembly may add to the air moved by first traveling assembly 160. The advantage of this arrangement may be that the system can be designed so that the forces due to the acceleration of the two traveling assemblies may cancel, and no significant net force may be imparted to the supporting structure. This advantage may become important when the mass of the traveling assemblies is large compared to the air being moved, which may be the case when the driver diameter is very small. Such a device can even be used in combination with a pair of check valves to create a pump.

It is possible to see from the above disclosure that nearly any mechanical excursion limit may be possible with the improved loudspeaker system, and that the speaker strength may be independent of the mechanical excursion limits. Note the length of magnetic circuits 107 in FIG. 1-1 and 128 in FIG. 1-2. The length of magnetic circuit 107 in FIG. 1-1 is much longer for a given excursion limit, and hence may suffer more magnetic leakage than the circuits in FIG. 1-2A. It may be desirable to minimize magnetic field external to a volume. This may allow a higher speaker strength and efficiency for the improved driver. In addition to the improvement in speaker strength due to the reduced magnetic leakage, the speaker strength may even be arbitrarily increased by increasing the length of the voice coil assembly. Because of the improvements in both speaker strength and excursion limits, a higher acoustic output such as at low frequency may be possible with the improved loudspeaker system than is achievable with a conventional loudspeaker.

In general, the improved electromechanical arrangement can have vastly reduced distortion when compared to the traditional loudspeaker system. The significant distortion associated with the voice coil 110 leaving the magnetic gap 109 of the conventional loudspeaker in FIG. 1-1 may even be substantially eliminated. This can result in a large reduction of the distortion of the overall sound reproduction system.

The commutation functions and capabilities can even be applied to a more traditional, single magnet system. FIG. 2-2 shows the driver portion of such an embodiment. The driver may be ordinary with the exception of the voice coil assembly 210*b* which may be position operable. It may even have only a single magnet element. Voice coil assembly 210*b* may perform the same function as the voice coil 204*b* of the conventional driver shown in FIG. 2-1. In this embodiment, the voice coil assembly 210*b* may be composed of perhaps three windings or perhaps three segments of windings, the U winding 211U, V winding 211V, and W winding 211W, perhaps as a segmented electrical coil. These three windings may be arranged in sequence axially along the voice coil former 211, and all of the windings may be wound in the same direction around the voice coil former 211.

In the following description, the voice coil assembly 210*b* is considered to have moved "outwards" when the voice coil assembly 210*b* and cone 212 are displaced away from the back plate 203. The voice coil assembly 210*b* is considered to have moved "inwards" when the voice coil assembly 210*b* and cone 212 are displaced towards the back plate 203. The windings are arranged so that the V winding 211V is immersed in the magnetic gap 210 when the voice coil assembly 210*b* is centered axially. When the voice coil assembly 210*b* is displaced outwards, the U winding 210U is immersed in magnetic gap 210. The W winding 211W is immersed in magnetic gap 210 when the voice coil assembly 210*b* is displaced inwards.

FIGS. 2-9A-C show the speaker strength functions of position for each of the individual windings 211U, 211V, 211W. As shown, these may be equal in magnitude among coils. U winding speaker strength function 233U shows the variation in speaker strength of the U winding 211U with position. Likewise, the V winding speaker strength function 234V shows the positional speaker strength variation of V winding 211V, and W winding speaker strength 234W function shows the speaker strength variation of W winding 211W. FIG. 2-9A shows that U winding speaker strength function 233U has its peak when the cone is extended outwards. FIG. 2-9B shows that the V winding speaker strength function 234V has its peak when the cone is centered. FIG. 2-9C shows that the W winding speaker strength function 234W has its peak when the cone is extended inwards.

Figures 1, 2, 3, 3A:
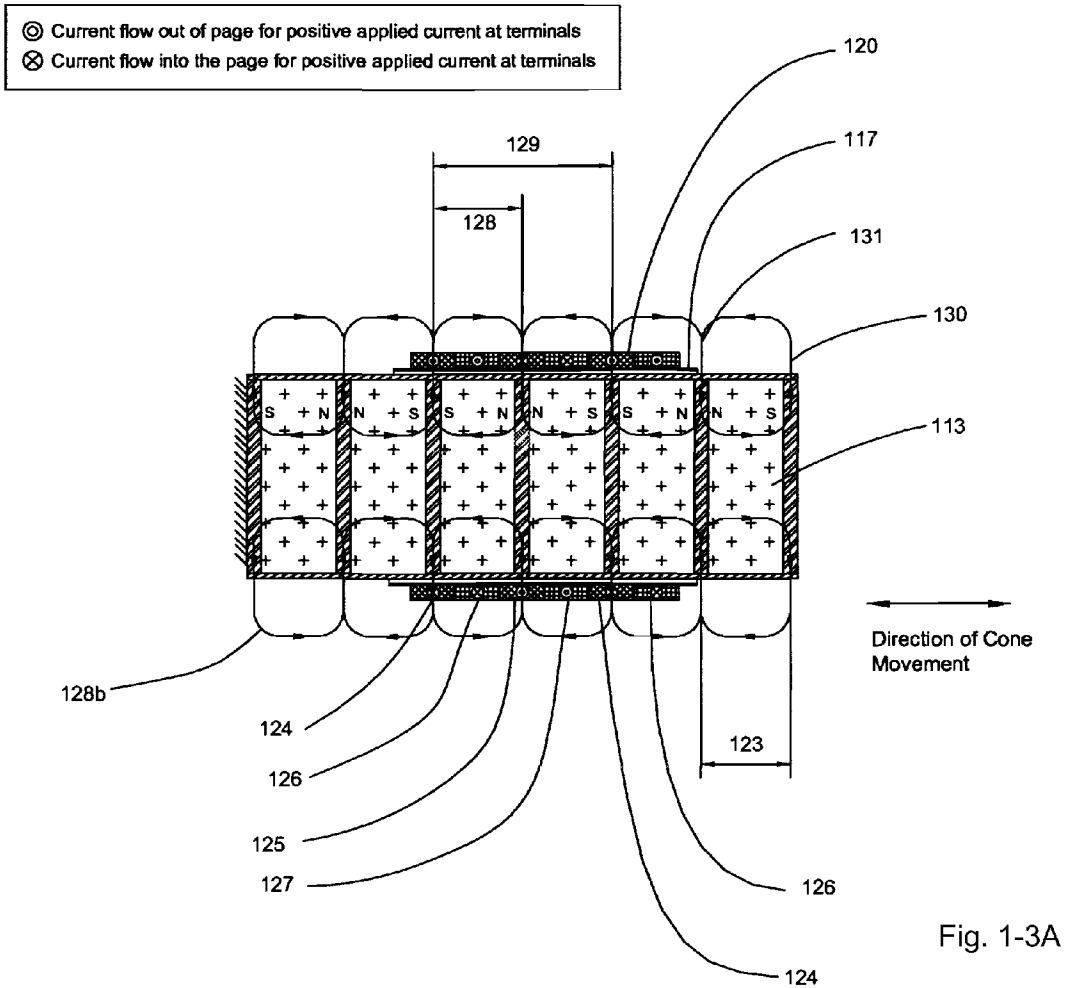
Figures 1, 2, 3, 3B:
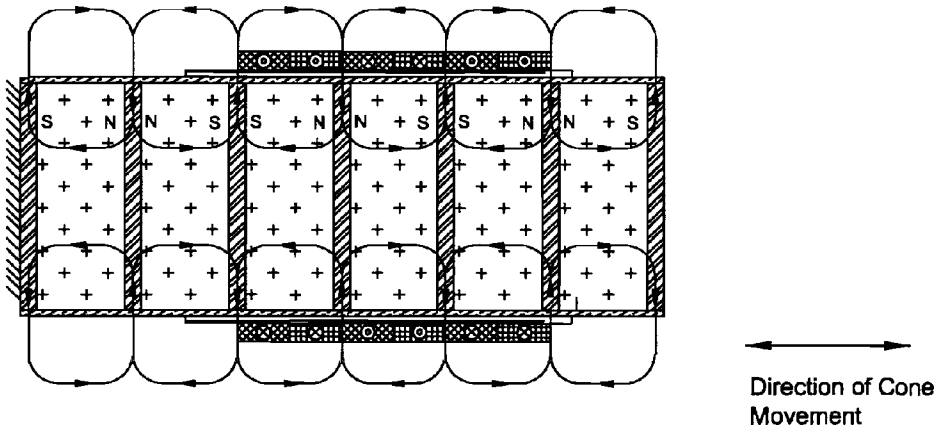
Figures 1, 2, 3, 3C:
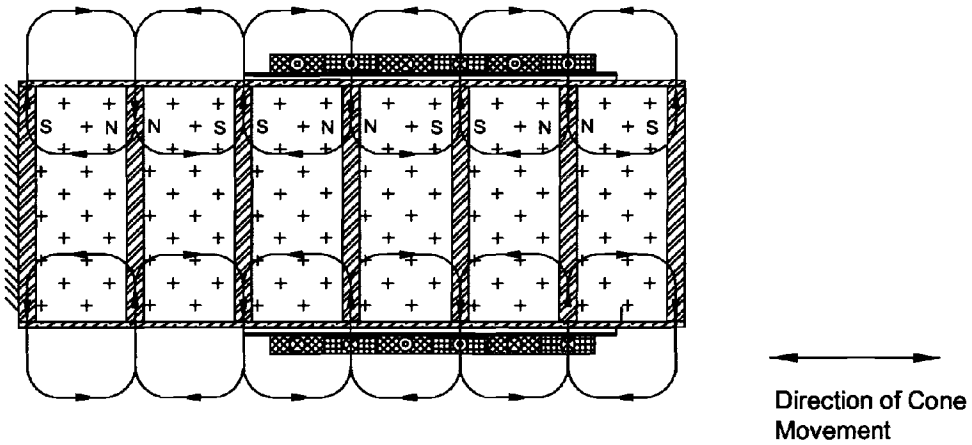
Figures 1, 2, 3, 3D:
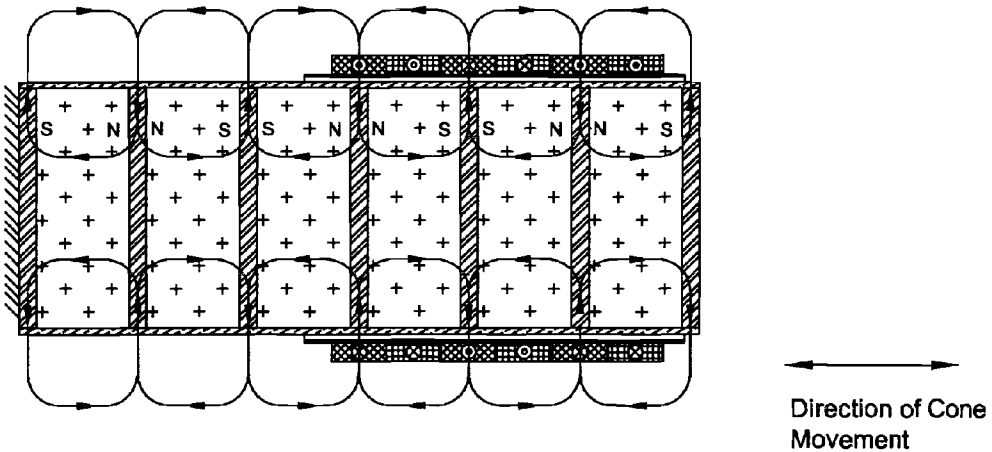

FIG. 2-3 shows a block diagram of the controller portion of the preferred embodiment. The controller may have several functions, but the primary function is to control the current in the multiple windings. The control section 213*a* may consist of a state estimator 214*b* which may act as a coil position estimator, a control algorithm 213*c*, a loudspeaker dynamic model 215*b*, a force commutator 216, a speaker strength look-up 219*a*, and a voltage calculation 219*b*. The system can have a drive efficacy lookup controller that looks up a variable drive efficacy or other value perhaps in a table. It may then apply the variable drive efficacy to provide an appropriate signal level to get the desired output. The output amplifiers 220U, 220V, 220W may be ordinary voltage-mode amplifiers or otherwise and may even be of any class or type.

The state estimator 214*b* of FIG. 2-3 may utilize a sensor as a coil position sensor perhaps such as a linear encoder or accelerometer to measure one or more of the state variables in addition to algorithmic prediction based upon past controller outputs This may be applied to a moveable drive component and the sensor may even have position indicia. Knowledge of the state may be important to positionally commutated loudspeakers because the proper commutation may depend on accurate knowledge of the position. Further, the motor strength curves can tend to be narrower and can have steeper gradients, so that error in the state estimate may have a greater effect on magnetic linearity compensation than it might for a conventional loudspeaker. There may be an integrally sensed drive system that may be a closely coupled sensor drive system to sense directly position of the coils.

In an embodiment, the audio input signal 213*b* may be taken as an unprocessed acceleration command, because sound pressure is directly proportional to the cone acceleration. By assuming that the dynamic model 215*b*, control algorithm 213*c*, and speaker strength look-up 219*a* are correctly tuned, the system may be designed to assume that the position 214*c* and velocity 215 (state) outputs of the state estimator 214*b* outputs are correct.

The control algorithm 213*c* may be an element that could include numerous functions, such as filtering, DC offset removal for acceleration, velocity, and position, and position-dependent velocity limiting to prevent the driver from exceeding its excursion limits, as mentioned above. A dynamic model element 215*b* may derive a master or other force command 215*c* from the mechanical model of the driver in its loudspeaker enclosure, the acceleration command 214, and perhaps the estimated state of the driver. A force commutator 216 may steer the force generation (hence current flow) to the winding or windings that has/have the highest speaker strength at any instantaneous position of the driver. The outputs of the force commutator may have three separate force commands: the U winding force command 216U, V winding force command 217Y, and W winding force command 217W. FIGS. 2-5A-C show an example of how one commutator might implement this function. The commutation functions 226U, 226V, and 227W may go from zero to one and may be high at voice coil assembly 210*b* positions with high speaker strength, and zero at positions with low speaker strength. Comparison of FIGS. 2-5A-C and 2-9A-C should make this apparent.

The output of the commutation function for each channel may be a type of position-dependent multiplier of the master force command 215*c*. The U force command 216U may be equal to the master force command 215*c* multiplied by the value of the U force commutation function 226U at the instantaneous position. Similarly, the V winding force command 217V and W winding force command 217W may be equal to the master force command 215*c* multiplied by the values of the V force commutation function 226V and W force commutation function 227W at the instantaneous position, respectively.

The commutation of force and current to the coil with highest speaker strength for the instantaneous position may cause the resistive losses in the voice coil assembly to be limited to the losses for the winding that is actually producing force. All other factors being equal, this could practically be approximately one half the resistive losses of an equivalent ordinary loudspeaker for a given generated force. This may be true because the ordinary loudspeaker often has current flowing through the equivalent of all three windings at all times.

The goal of commutation in such an embodiment may be to have all of the current flowing through the coil or coils with the highest speaker strength for the instantaneous position. Additionally, some crossover may be desirable to allow for error in the state estimation and/or to prevent inductive kick-back caused by rapid current transients in the inductive coils. This crossover is shown by the sloped portions of the commutation functions 226U, 226V, 227W in FIGS. 2-5A-C. This may be effected by an element that serves as an overlapping activation commutator. This may serve as a counterbalanced transient current commutator so that undesirable transitions and sharp current changes may be avoided.

The voltage calculation 219*b* may derive a voltage command 219U, 219V, 219Wb for each output channel of the controller based upon the force commands 216U, 217V, 217W, state estimate 214*b*, 215, and speaker strength values 218U, 218V, 219Wa, which may be produced by the speaker strength look-up 219*a* or other means. A wire moving in a magnetic field produces a voltage called the motional voltage. This is how a generator works. The greater the velocity of the wire is, the greater the voltage (Faraday's Law). Since the voice coil is moving at the same frequency as the applied signal, this motional voltage can be viewed as an electrical impedance to the amplifier that changes with frequency. When mechanical resonance enables large movement of the cone, the impedance curve can take the same shape as the mechanical resonance curve. Thus, it may be noted that although the current is zero in the coils that are not producing force, the voltage command may not generally be zero. This may be true because the inactive coils may have some speaker strength at all positions, and these coils may produce a motional voltage when the cone velocity is non-zero. If these motional voltages are not balanced by the amplifier, current may flow through the coils and create force in the direction opposite the velocity, which may cause distortion and consume power. Note that although the output voltage for the inactive coils may be non-zero, the current may be zero, and therefore no power may be expended in balancing the motional voltages of the inactive coils.

Figures 1, 2, 3, 4:
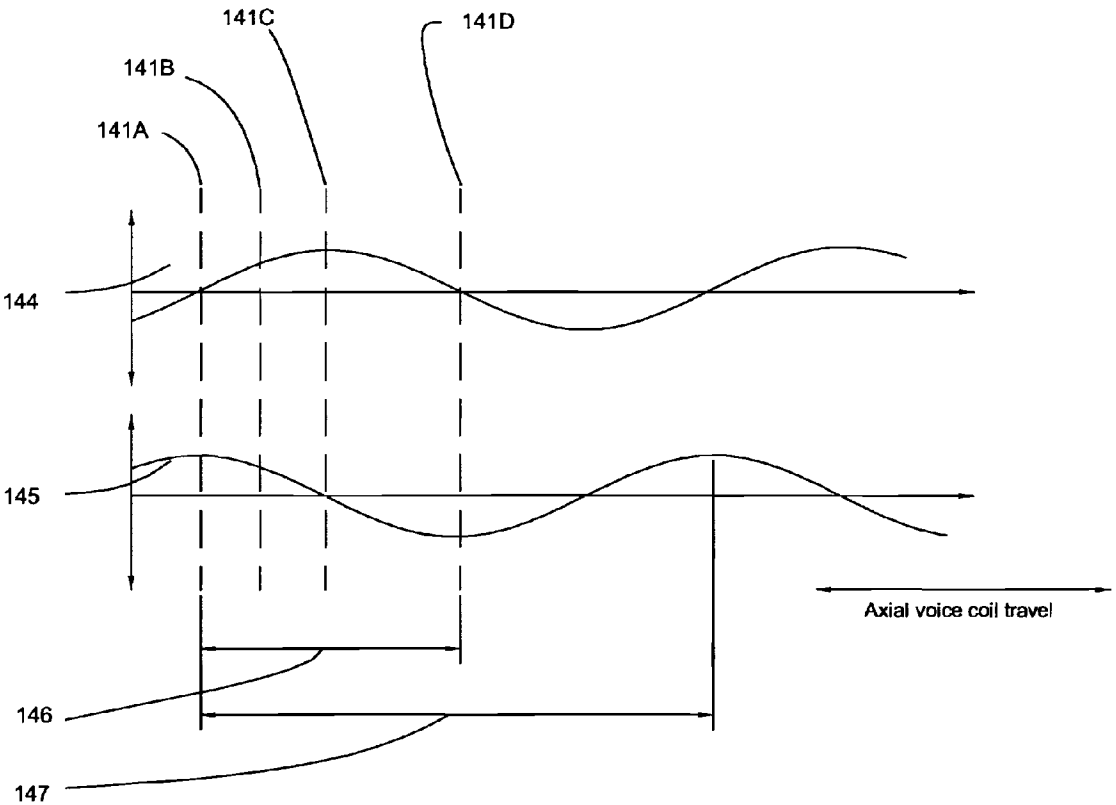

In embodiments where the voltage commands 219U, 219V, and 219Wb may be based upon look-up tables of the speaker strength curves, the speaker strength curves may be inherently compensated and the output may be substantially linear across the entire range of motion. The dynamic model 215*b* may insure that the overall frequency response of the driver in its loudspeaker enclosure is flat down to the cutoff frequency of the high-pass filter. Further, as shown in FIGS. 4-3 and 4-4, it can be understood how embodiments of the present invention may permit different tuning of the enclosure. This can be understood by considering that generally loudspeakers are used in enclosures so that the acoustic pressure output from the rear of the cone does not cancel the acoustic output from the front of the cone, since the two pressure waves are out of phase. Because the enclosure is sealed, pressure is developed behind the cone as the cone travels in and out of the enclosure. The effect is very similar to a spring acting on the cone. The moving mass of the loudspeaker in its suspension forms a resonant spring-mass-damper system. Thus, the enclosure is important to the level of sound produced.

In fact, this resonance is normally tuned by modifying the enclosure so that the resonance creates large cone movement at low frequency with a small input. If properly tuned, the resonant response curve approximates the inverse square excursion curve that is required to produce a constant sound pressure level (SPL) with constant input voltage. As frequency drops below the center of resonance the acoustic response drops off rapidly because the inverse square excursion is no longer being approximated. As can be seen in FIG. 4-3, this mechanical resonance is necessary for high output at low frequency where traditional drivers may be lacking output capacity.

It should be understood, however, that the mechanical resonance has electrical effects. As the operating frequency approaches mechanical resonance, less force is required of the voice coil to produce the required motion and output. At the same time, the electrical impedance of the speaker is increasing because the velocity is increasing, meaning that for a given applied voltage less current flows in the coil. In some designs this has been used as a beautifully convenient effect, because it has allowed more constant—but not always perfectly countering—results. It has allowed amplifier voltage output to more closely approximate a constant SPL output of the speaker down to the resonant frequency, however this has not always been an ideal balance and output has still varied in some systems.

By comparing the mechanical resonance plots of FIGS. 4-3 and 4-4, it can be understood that in embodiments, the tuning of the enclosure may be shifted to permit what might have been considered off traditional tuning of the enclosure with low frequency response less coupled to or perhaps even independent of the enclosure tuning.

For the embodiment of FIG. 2-2, the operation can be understood by examining the function of the system with a large-amplitude, low-frequency signal in the shape of a perfect sine wave applied to the audio input 213*b* of the controller. FIGS. 2-4 shows the input signal 220*a*, and the voice coil assembly acceleration 220*b*, velocity 220*c*, and position 220*d* resulting from this input signal.

Three points in time, time A 221A, time B 221B, and time C 222C are chosen for examination. These same points in time 221A, 221B, 222C are shown on FIGS. 2-4A-D, 2-6A-D, 2-7A-C, and 2-8A-C as vertical lines intersecting the various functions. At each of these points in times 221A, 221V, 222C the voice coil assembly 210*b* has a corresponding position. Position A 223A is the location of the voice coil assembly 210*b* at time A 221A. Position B 224B corresponds, to time B 221B, and position C 224C is the location at time C 222C. This relationship is shown in FIG. 2-4D. The positions 223A, 224B, 224C, are the same positions shown in FIGS. 2-5A-C and 2-9A-C as vertical lines intersecting the commutation 226U, 226V, 227W and speaker strength functions 233U, 234V, 334W.

FIG. 2-5A-C shows the commutation functions 226U, 226V, 227W that are implemented by the force commutator (216, FIG. 2-3) to steer the force among the three windings 211U, 211V, 211W (FIGS. 2-2, 2-3). The vertical lines intersect the commutation functions 226U, 226V, 227W at position A 223A, position B 224B, and position C 224C. The value of the commutation function at each position is the value at the intersection.

FIG. 2-6A shows a graph of the total force 227 that is generated by voice coil assembly 210*b* to create the motion described by FIGS. 2-4B through 2-4D. The voice coil assembly force 227 is the sum of the forces generated by each of the three windings (211U, 211V, 211W FIGS. 2-1, 2-3) because the three windings are mechanically linked together by the voice coil former 205*b* (FIG. 2-1). FIG. 2-6B shows the U winding force 228U. FIG. 2-6C shows the V winding force 228V, and FIG. 2-6D shows the W winding force 229W. The force signals for the individual windings 228U, 228V, 229W may closely approximate truncated sections of a perfect sine. The truncations may be tapered because of the crossover of the commutation functions 226U, 226V, 227W as shown in FIGS. 2-5A-C. It is apparent from examination of FIG. 2-6 that each of the windings (211U, 211V, 211W FIG. 2-1) produces force for part of the cycle of movement. Comparison of FIG. 2-4D and FIGS. 2-6B, 2-6C, and 2-6D will show that the position of the coil may determine which coils produce force at any given time.

The fact that the input signal 220A chosen for examination may be large-amplitude and low frequency may insure that the driver will travel through an excursion large enough that commutation will be needed to produce the required force. FIGS. 2-5A-C illustrates this. At position A 223A the voice coil assembly 210*b* is extended outwards and the U force commutation function 226U is one. FIGC. 2-6A-D shows that all of the voice coil assembly force 227 is being produced by the U winding 211U. The U winding force 228U at time A 221A is equal to the voice coil assembly force 227. FIGS. 2-7A-C show that current is only flowing in the U winding at time A 221A.

As the voice coil assembly 210*b* moves inward to position B 224B at time B 221B it enters a crossover region. FIGS. 2-5A-C illustrates that at position B 224B both the U commutation function 226U and V commutation function 226V are between zero and one. As illustrated in FIGS. 2-6A-D at time B 221B, some of the voice coil assembly force 227 comes from the U winding force 228U and some comes from the V winding force 228V. The voice coil assembly force 227 is equal to the sum of the U winding force 228U and V winding force 228V. At time B 221B the U winding force 228U is rapidly decreasing in absolute value and the V winding force 228V is rapidly increasing. FIG.S 2-7A-C, in a similar manner, shows that the magnitude of U winding current 230U is decreasing while the magnitude of V winding current 230V is increasing at time B 221B.

When the voice coil assembly 210*b* has reached position C 224C at time C 222C, the voice coil assembly force (FIG. 2-6A, 227) is completely generated by the V winding 211V. In FIG. 2-6C, V winding force 228V is equal to the voice coil assembly force 227 at time C 222C. Note in FIG. 2-6A that the voice coil assembly force 227 is nearly zero at time C 222C, so the V winding current 230V in FIG. 2-7B is also small.

The process of force commutation may be symmetrical as the voice coil assembly 210*b* travels to the opposite side of the center position. As the voice coil assembly 210*b* continues to travel inward, the force commutation will cross onto the W winding 211W, as shown in FIGS. 2-5A-C. FIGS. 2-4A-D through 2-6A-D illustrate this commutation for the remainder of the cycle. The current signals 230U, 230V, and 231W in FIGS. 2-7A-C may be very similar in shape to the force signals 228U, 228V, 229V shown in FIGS. 2-6A-D. However, the shapes may not be identical. Around time A 221A in FIG. 2-7A, the U winding current 230U shows a slight peak. Note from FIGS. 2-9A that the U winding speaker strength 233U is less than its peak value. The deviations in shape between the current signals 230U, 230V, 231W in FIGS. 2-7A-C and force signals 228U, 228V, 229W in FIGS. 2-6A-D are due to variations of the speaker strength curves 233U, 234V, 234W in FIGS. 2-9A-C. Because of the speaker strength look-up (FIG. 2-3, 219*a*) being taken into account in the voltage calculation (FIG. 2-3, 219*b*), the winding forces (FIG. 2-6B-D, 228U, 228V, 229W) are linearly proportional to the force commands 216U, 217V, 217W of FIG. 2-3. This linearity may result in reduced distortion of the output acoustic waveform.

FIG. 2-8A shows the U winding voltage 232U, V winding voltage 232V, and W winding voltage 233W during the same period of time. The voltage waveforms 232U, 232V, 233W in FIGS. 2-8A-C may not look very similar to the current waveforms 230U, 230V, 231W in FIG. 2-7A-C. This is true because of the need to balance the motional voltages of the inactive windings. Note that at time C 222C in FIG. 2-7 the U winding current 230U is zero, but the U winding voltage 232U in FIG. 2-8A is not. Referring to FIG. 2-9A, note that U winding speaker strength 233U is non-zero at position C 224C. Referring to FIG. 2-4C, the voice coil assembly velocity 220*c* is non-zero at time C 222C. The non-zero U winding voltage 232U in FIG. 2-8A may be due to the need to balance the motional voltage created by the U winding 211U moving at a velocity in a position of non-zero speaker strength.

From FIGS. 2-6A-D it may be apparent that there is significant current in only one winding at a given time. This winding may have a resistance which is less than the resistance of the conventional loudspeaker voice coil, which may mean that the resistive losses caused by the current required to generate a given force are less. Because these resistive losses may be less, the heat generation and power consumption may also be less than those for the equivalent ordinary loudspeaker. It should be apparent from this description that the improved loudspeaker could be implemented with more or fewer windings and channels.

FIG. 2-10 shows an alternate embodiment of the invention that can be implemented with only two amplifiers. This embodiment utilizes three windings. The V winding 237V may be located so that it is centered in the magnetic gap when the voice coil assembly is centered. The U1 winding 237U1 may be located so that it is immersed the magnetic gap 242 when the voice coil assembly 240 is displaced outwards. The U2 winding 238U2 may be located so that it is immersed in the magnetic gap 242 when the voice coil assembly 240 is displaced inwards.

FIG. 2-12 shows a block diagram of the controller for this embodiment. This embodiment uses only two channels of amplification. The controller section 235 may be similar to the controller for the preferred embodiment. The U channel amplifier 236U drives both the U1 winding 237U and U2 winding 238U, which may be connected together. FIG. 2-11 shows the commutation functions for this embodiment. As shown by the V force commutation function 239V, the force and current are directed to the central V winding 237V when the voice coil assembly 240 is centered axially. The U force commutation function 238U shows that the force and current are directed to the U windings (237U, 238U FIG. 2-10) when the voice coil assembly 240 is extended either inwards or outwards.

This embodiment has the advantage that only two amplifiers or two channels are needed. Because many commonly available amplifiers have two channels, this is a commercial advantage. This embodiment may be slightly less efficient than the preferred embodiment, because a portion of the U winding (237U or 238U) may be energized when it is not within the magnetic gap 242. However, this embodiment may be significantly more efficient than the equivalent ordinary loudspeaker. This is true because for a random input signal, the speaker spends a great majority of it's time near the center position. Under these conditions, the V winding 237V would be energized most of the time, and it may have much less resistance than the voice coil of the equivalent ordinary loudspeaker producing the same acoustic output. Even when the voice coil assembly 240 is extended away from center, the resistive losses may be less than those of the equivalent ordinary loudspeaker.

FIG. 2-13 shows another embodiment. This embodiment may allow for a smaller magnetic structure than would be possible for an ordinary loudspeaker of equivalent acoustic output. In this embodiment, top plate 243 is of reduced thickness, and magnetic gap 247 is narrower in the axial direction. This reduces the size of magnet 242 required to achieve magnetic saturation or a given magnetic flux density in magnetic gap 247. The size requirements for back plate 243*b* and inner pole piece 243*c* are also reduced. The reduced size of the magnetic structure results in reduced weight and cost for those elements.

The embodiment of FIG. 2-13 may be similar to a prior embodiment except for the voice coil assembly 244*a*, which may be composed of five windings; the V1 winding 244V1, U1 winding 245U1, V2 winding 245V2, U2 winding 246U2, and V3 winding 246V3. Voice coil assembly 440 performs the same function as the voice coil (110, FIG. 2-1) of the ordinary loudspeaker.

FIG. 2-14 shows a block diagram of one type of controller for the embodiment shown in FIG. 2-13. The windings 244V1, 245U1, 245V2, 246U2, 246V3 may be energized by a pair of amplifiers 250, 251. Multiple windings may be powered by each single amplifier. U channel amplifier 251 energizes U1 winding 245U1 and U2 winding 246U2. V channel amplifier 250 energizes V1 winding 244V1, V2 winding 245V2, and V3 winding 246V3. As discussed earlier, a significant form of distortion, especially for woofers, may occur when the voice coil moves out of the magnetic field during its normal course of operation. As the coil leaves the field, the amount of force produced for an amp of current in the coil (speaker strength, or BL product) becomes less. This creates a nonlinear distortion relative to the amplifier input signal due to nonlinear speaker strength. In some conventional loudspeaker designs, this is addressed by making the voice coil longer. The tradeoff for doing so, however, is that the longer voice coil has a higher resistance. Since the power dissipated is proportional to the resistance, this can mean that the speaker may be less efficient, the longer voice coil overhang may reduce efficiency. Further, in order to have more constant speaker strength over a range of excursion, the voice coil often overhangs the magnetic field. This may mean that at any given time, only a portion of the voice coil is immersed in the magnetic field and actually producing force. The windings that are not immersed in the field may be simply generating heat without producing any force. Embodiments of the present invention can de-energize the windings that are not producing any force. Windings not in the field may be de-energized. This may reduce the heat generated in the speaker overall. In the embodiment discussed in FIG. 2-14, switches 248V1, 248U1, 249V2, 249U2, 250V3 such as emissionless, electronic, electrically noiseless, semiconductor switches may disconnect windings which are not immersed in the magnetic gap (247 FIG. 2-13). Control section 251 may perform a function such as providing separately controlled, individually switched or separately controllable coils similar to control section 213 of FIG. 2-3, or even separately switched coils with the additional function of operating the switches 248V1, 248U1, 249V2, 249U2, 250V3. Switches can act as electronically activated coil switches or control can act similarly to de-energize either individual coils, individual coil segments, or entire phased banks of coils perhaps so that interconnected banks of coils are alternately activated. De-energizing can even occur within a normally considered operable range, such as in between magnets, magnet poles, magnet segments or the like.

FIG. 2-15 shows the commutation of force versus voice coil assembly 244*a* position between the two amplifier channels. FIG. 2-15 also shows the states of the switches 248V1, 248U1, 249V2, 249U2, 250V3 for every position. The U force commutation 252U describes how force and current are applied to the U channel amplifier 251. V force commutation 252V shows how force and current are applied to V channel amplifier 250. V1 switch state 253V1 shows the on or off status of V1 switch 248V1 for every position of voice coil assembly 244*a*. In a similar manner, switch states U1 253U1, V2 254V2, U2 254U2, and V3 255V3 show the states of the switches 248V1, 249V2, 249U2, 250 V3 respectively.

From FIG. 2-15 it may be apparent that no more than two windings are carrying current at any position, hence the need for only two amplifiers These may be current mode or voltage mode amplifiers. Further the amplifiers may be separate amplifiers or merely separate channels in a single amplifier both serving as individual electronic amplifier elements. The switch elements (248V1, 248U1, 249V2, 249U2, 250V3 FIG. 2-14) may be electronic, and perhaps even semiconductors which may operate in saturation mode to serve as a saturation mode operation semiconductor switch. Because of this, they may dissipate less heat than an equivalent amplifier, and hence may be smaller and less expensive, facilitating implementation on an integrated circuit. The switches may also not need any feedback or linearization circuitry, as an amplifier would, further reducing the cost of implementation. Further, because the inactive windings may be disconnected, there is no need to balance the motional voltages developed by them. In this fashion, the system may provide a field position electronically activated coil switch. If the phases, circuits, or coils are interleaved as shown in some embodiments, the switches may serve as interleave electronically activated coil switches.

In embodiments where the windings in the embodiment shown in FIG. 2-13 may be axially very narrow, very few turns of winding would be energized that are not immersed in the magnetic field, meaning that very little power may be consumed by windings that are not producing force. The narrow windings may also have a very low resistance for the force generated. These two factors may help compensate for the smaller magnetic gap and hence may allow the improved loudspeaker to generate acoustic output equivalent to the ordinary loudspeaker but also consume less power, be physically smaller, and have less mass. It should be apparent from this description that this embodiment could be implemented with more or fewer windings, and with different permutations and combinations of amplifiers and switches.

FIG. 3-2 shows a detail of the voice coil assembly 305 with typical construction. The former 308*a* may be used as a bobbin to wind the voice coil 204*b*, and may also serve as a mechanical link between the cone (306*b*, FIG. 3-1), spider (307, FIG. 3-1) and voice coil 304*b*. The source lead 309 and return lead 309*b* may be captured by a wrap 308*b*, which may be made of adhesive-backed paper. This can prevent the leads 309, 309*b* from rubbing in the magnetic gap (303*b*, FIG. 3-1). In some designs, (perhaps even if an odd number of winding layers is used in the voice coil 304*b*) the return lead 309*b* may pass over the voice coil 304*b* to return to the flying leads (305*a*, FIG. 3-1). This may conflict with the design goal of keeping the magnetic gap (303*b*, FIG. 3-1) as narrow as possible, since extra gap width may be needed to maintain proper clearance.

In some embodiments it may be advantageous to utilize more than one separate voice coil on the same former. FIG. 3-3 shows another voice coil assembly, which utilizes two separate windings. The voice coil assembly shown in FIG. 3-3 has two separate circuits. In this case the leads (311, 311B) for coil B 312B may pass over (or possibly under, but the effect is the same) voice coil A 312A. This can have the undesirable effect of requiring a wider magnetic gap to allow for mechanical clearance. The arrangement shown in FIG. 3-3 may also require an additional intermediate wrap 308*b* to capture the leads (311, 311B) for coil B 312B. The arrangement shown in FIG. 3-3 may make lead connections difficult and may require a labor-intensive soldering operation and perhaps even additional insulation. Further, such connections may be a point of failure. An oversize solder connection might mechanically interfere with the magnet structure and wear through the insulation, causing an electrical short.

Figures 1, 2, 3, 4, 5:
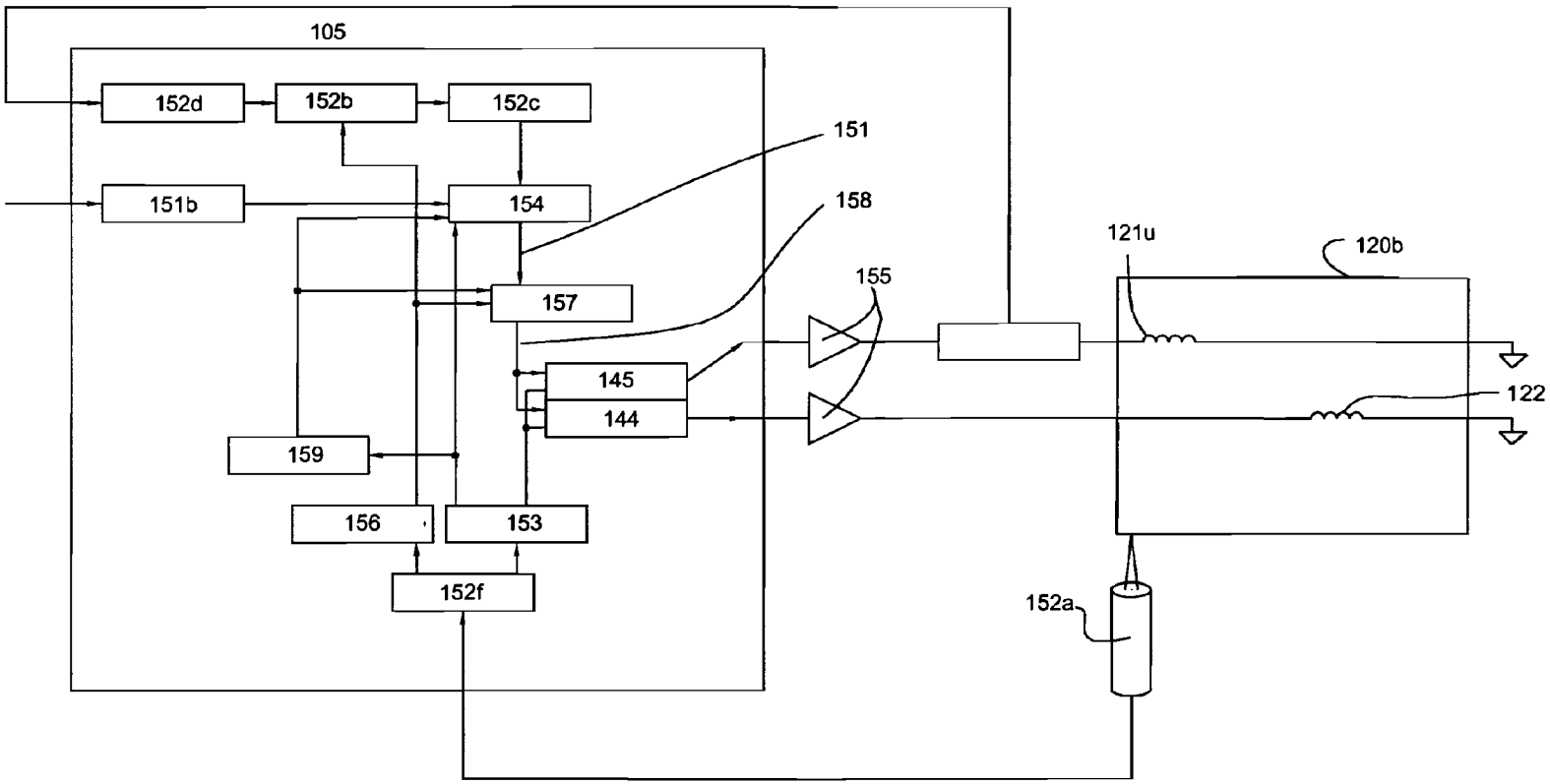
Figures 1, 2, 3, 4, 5, 6:
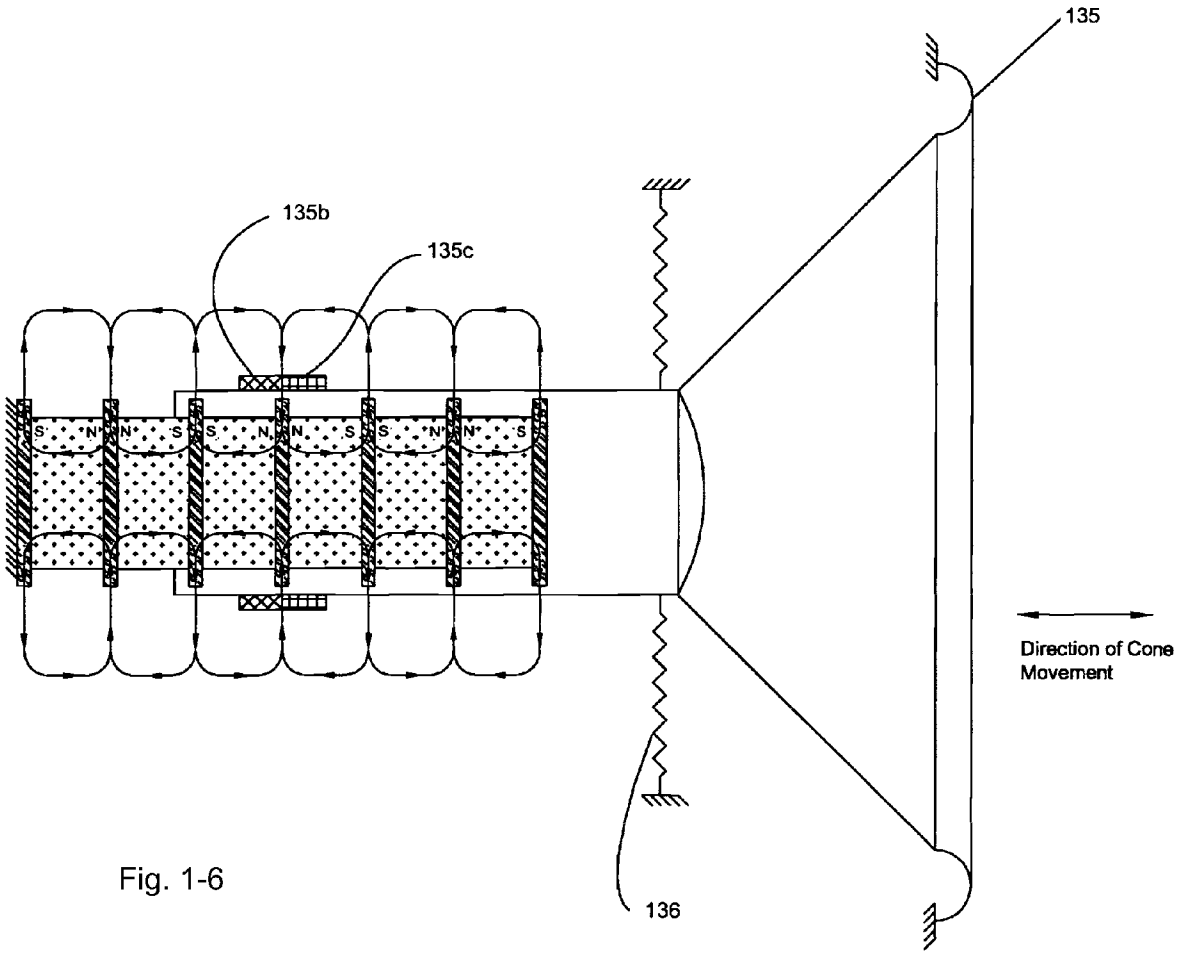
Figures 1, 2, 3, 4, 5, 6, 7:
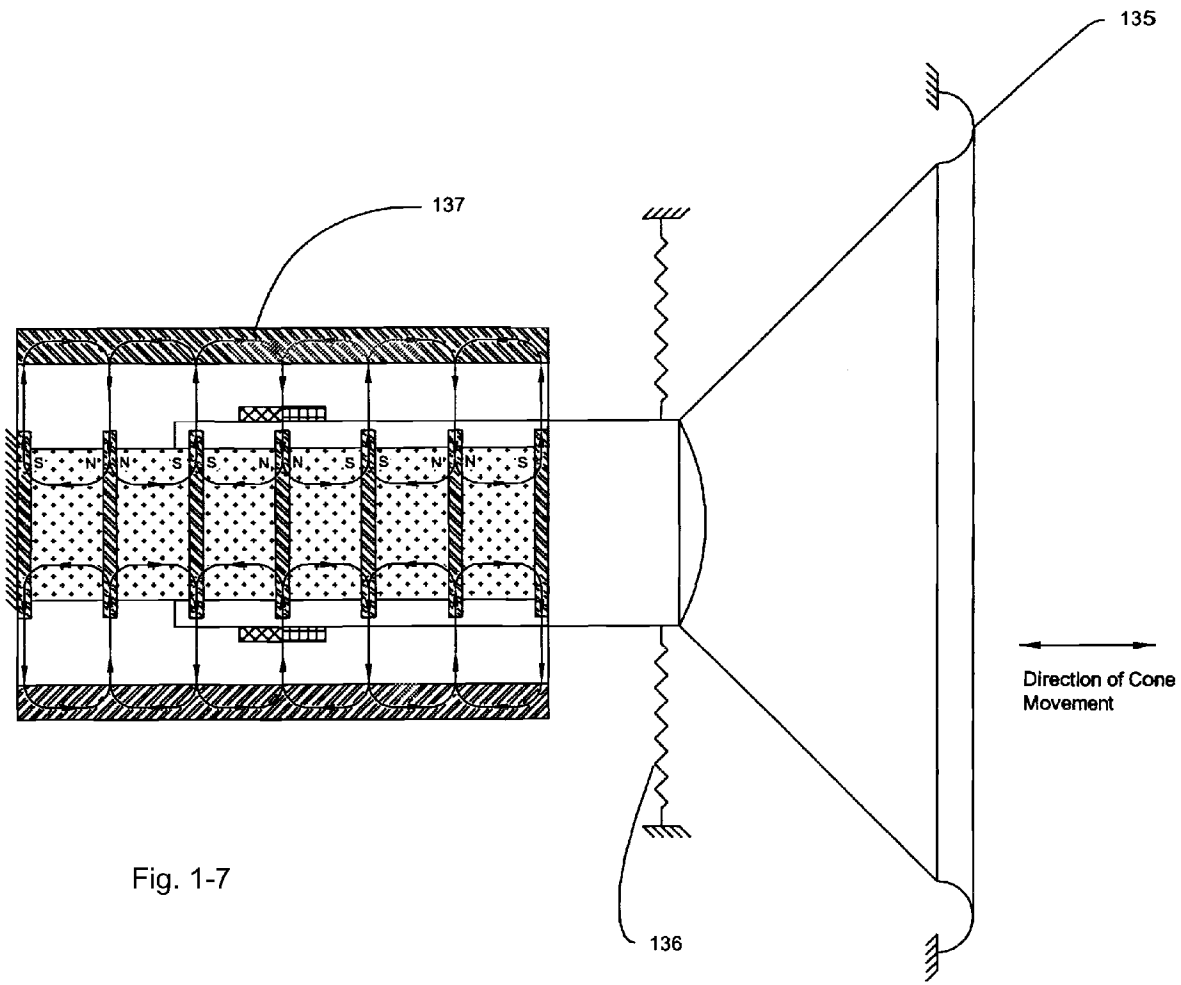
Figures 1, 2, 3, 4, 5, 6, 7, 8:
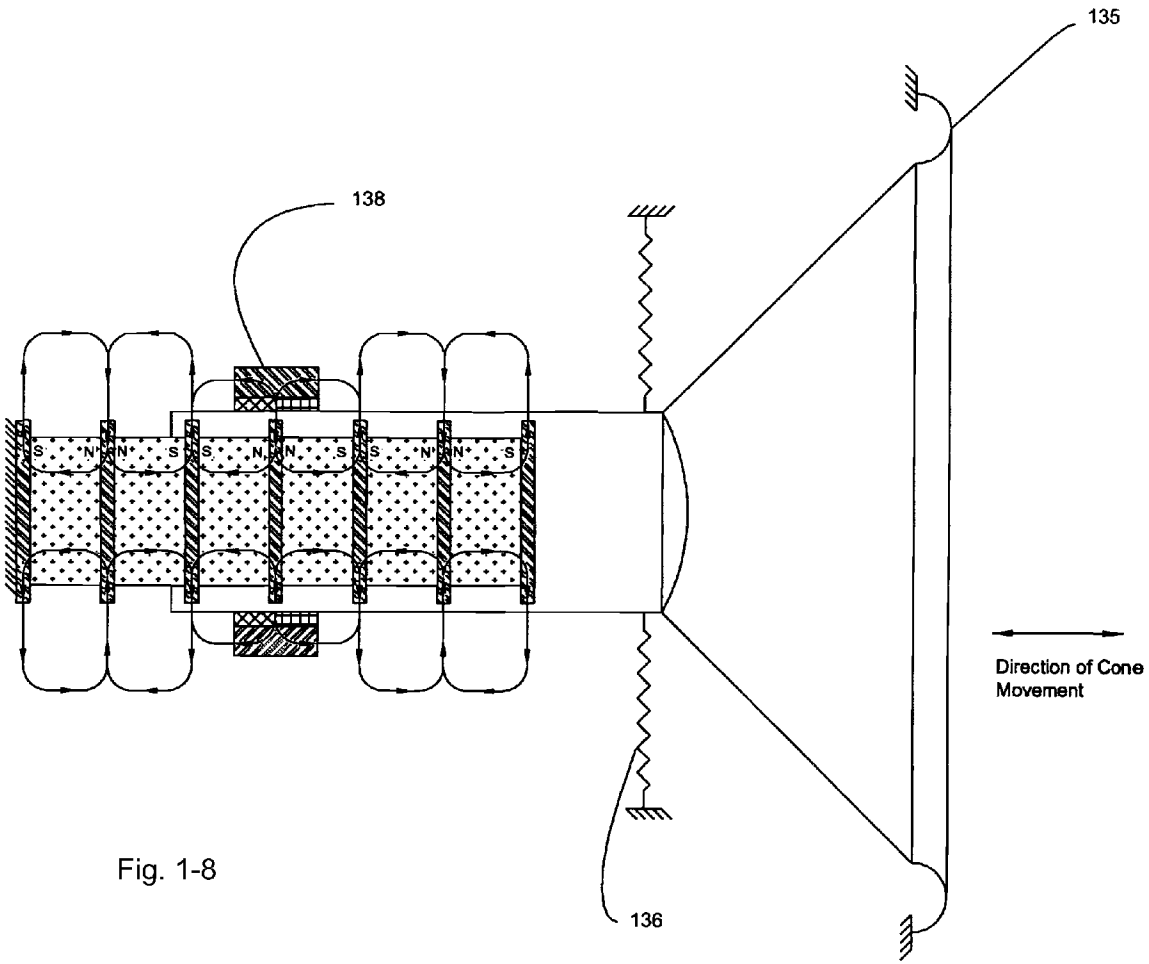
Figures 1, 2, 3, 4, 5, 6, 7, 8, 9:
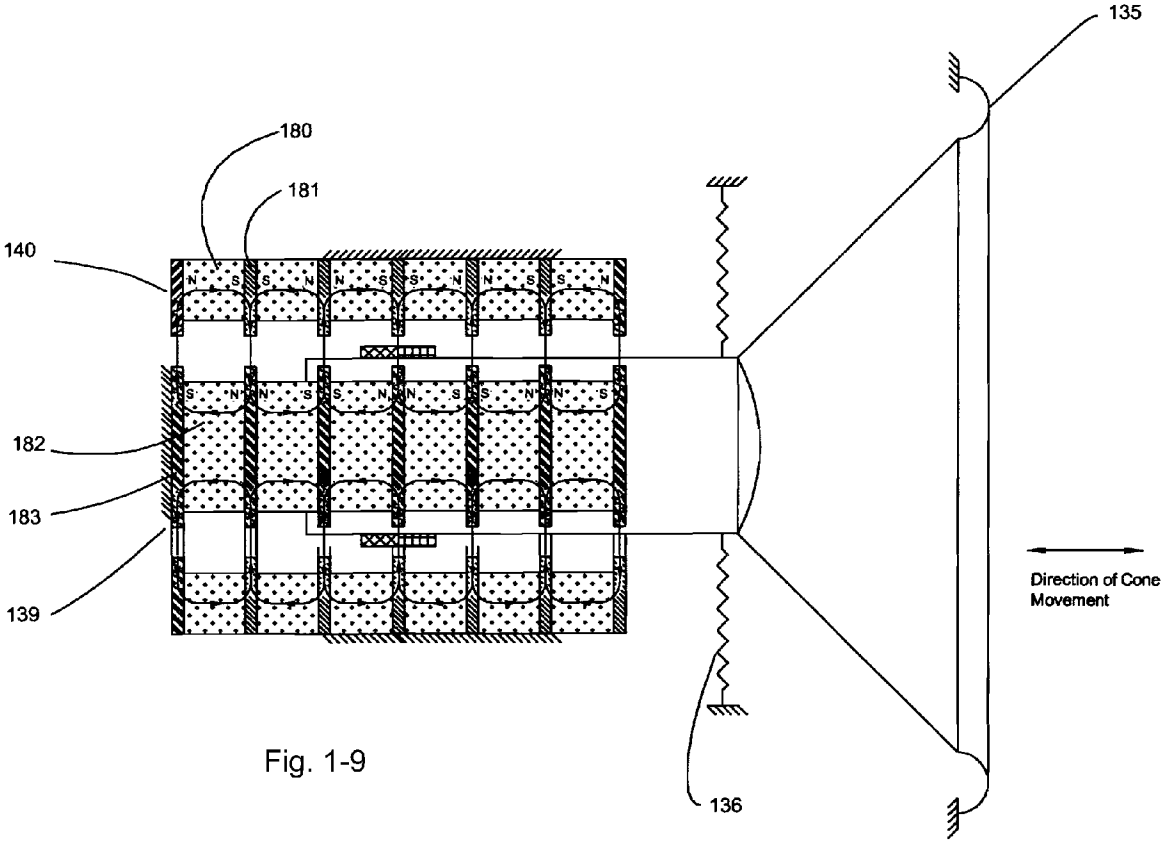
Figures 1, 2, 3, 4, 5, 6, 7, 8, 9, 10:
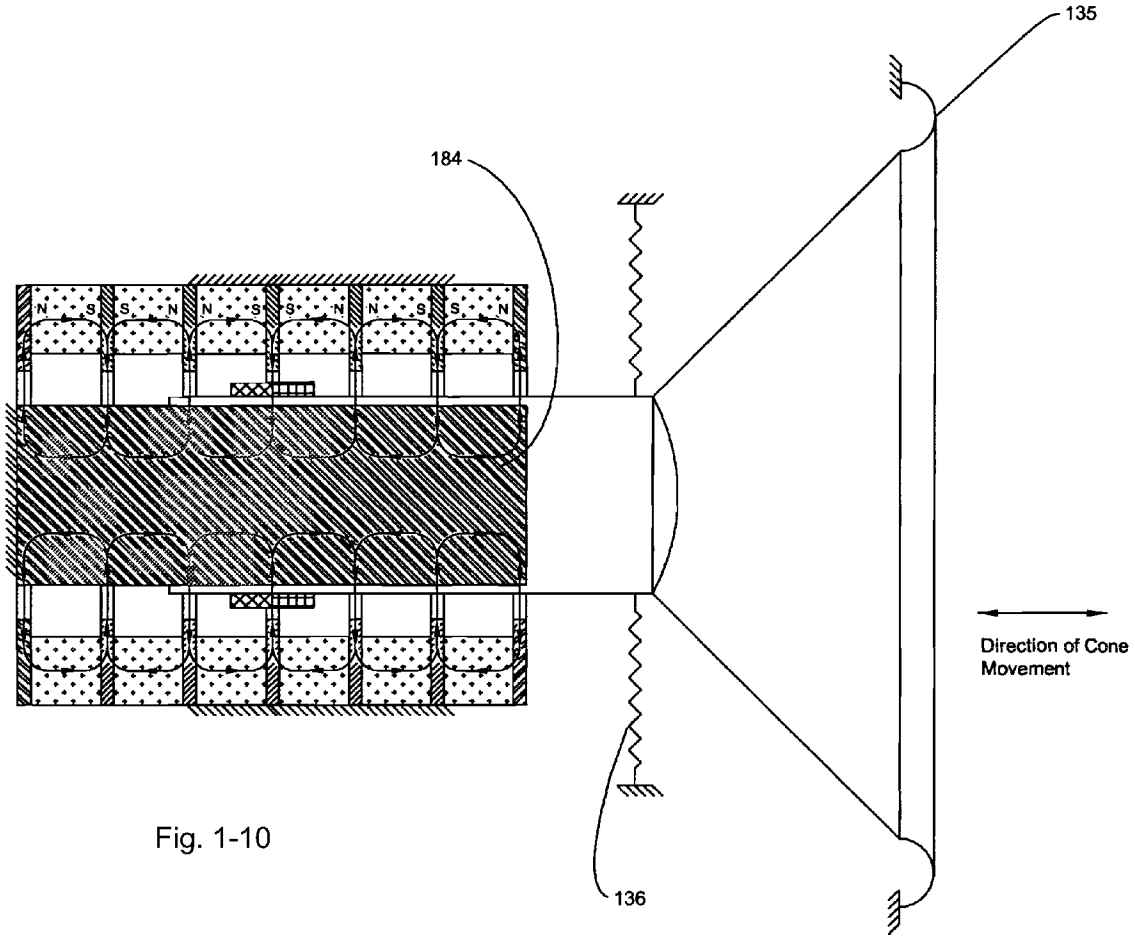
Figures 1, 2, 3, 4, 5, 6, 7, 8, 9, 10, 11:
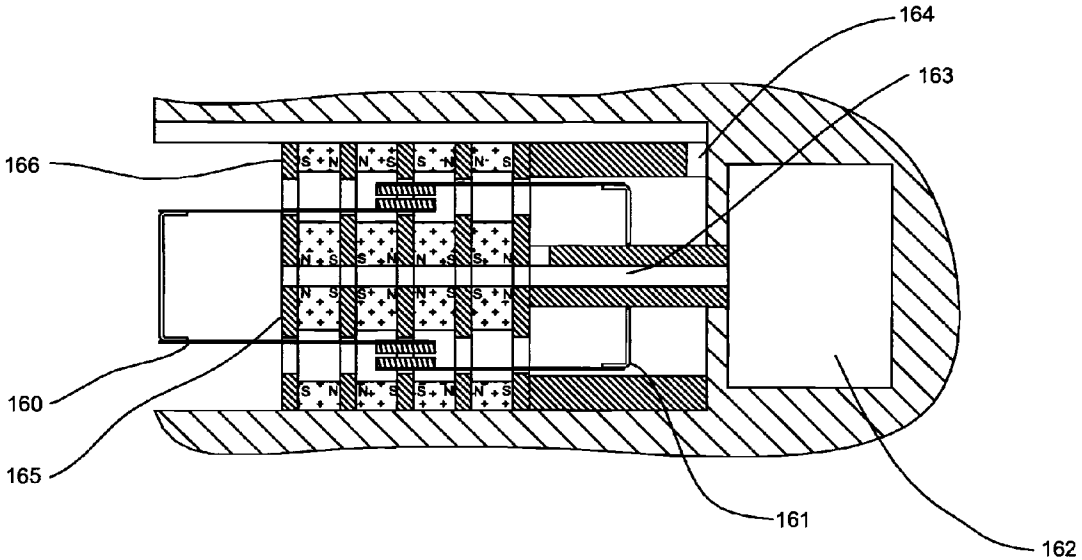
Figures 1, 2:
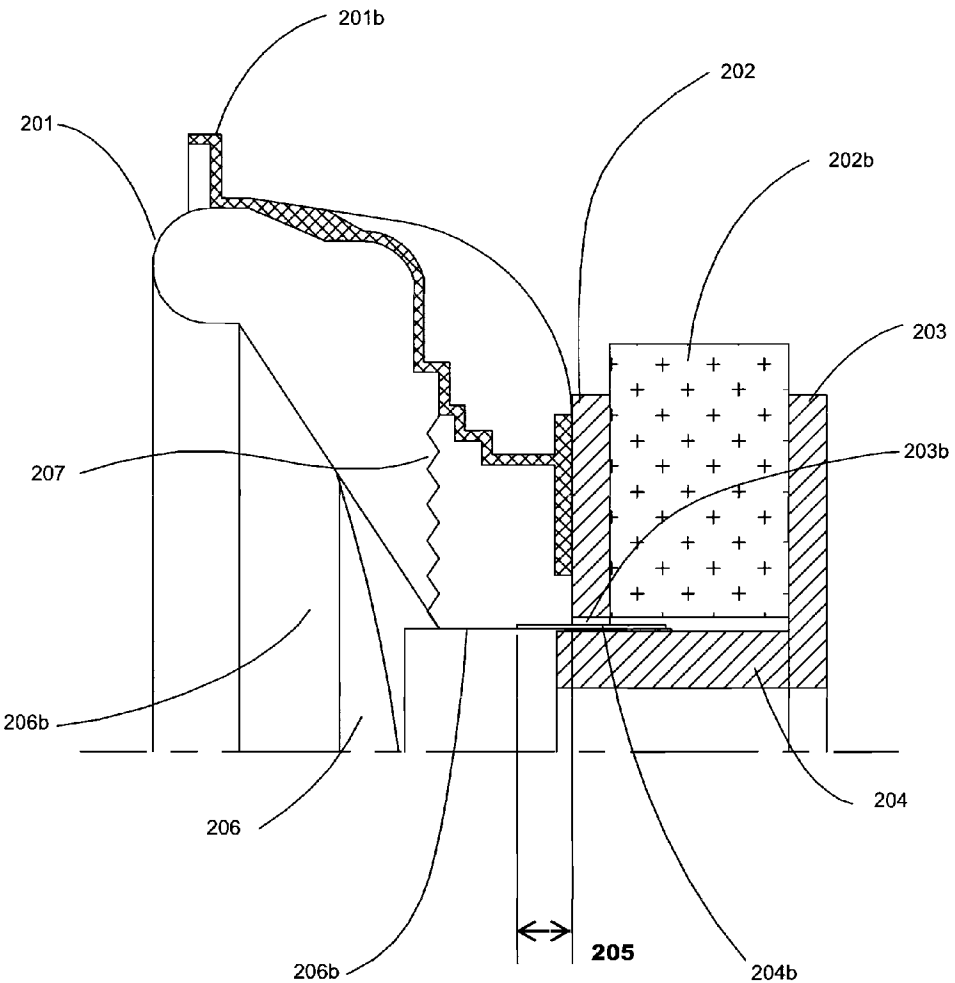
Fig. 2-1 Prior Art
Figure 2:
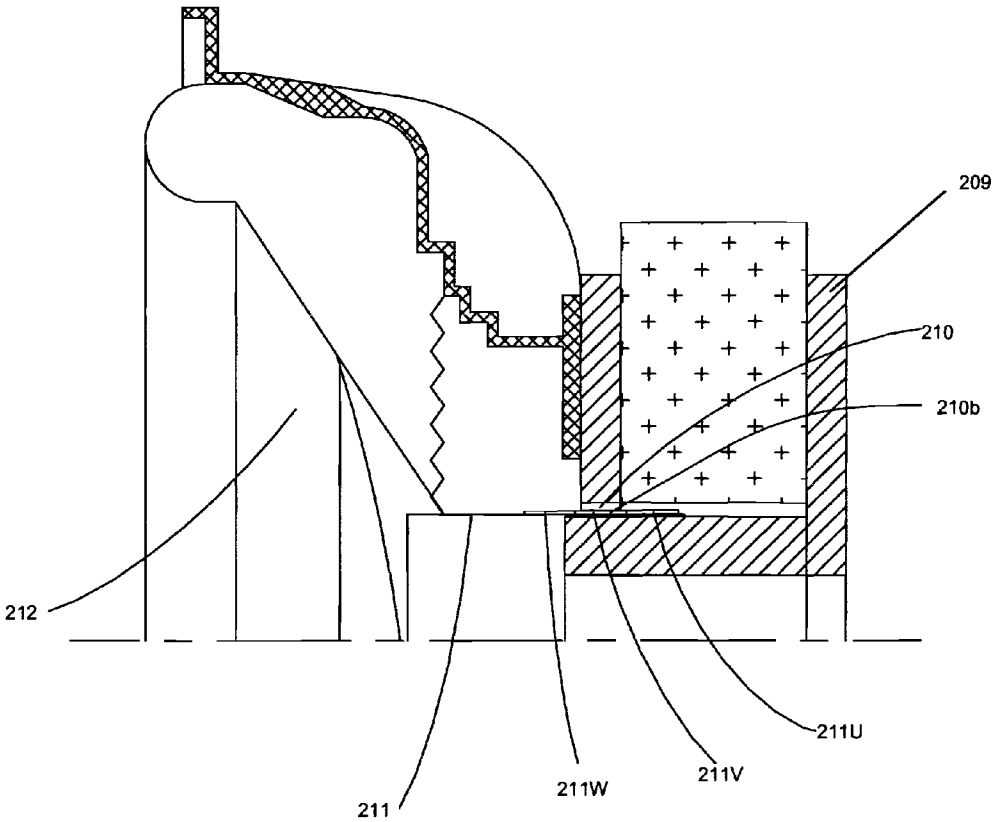
Figures 2, 3:
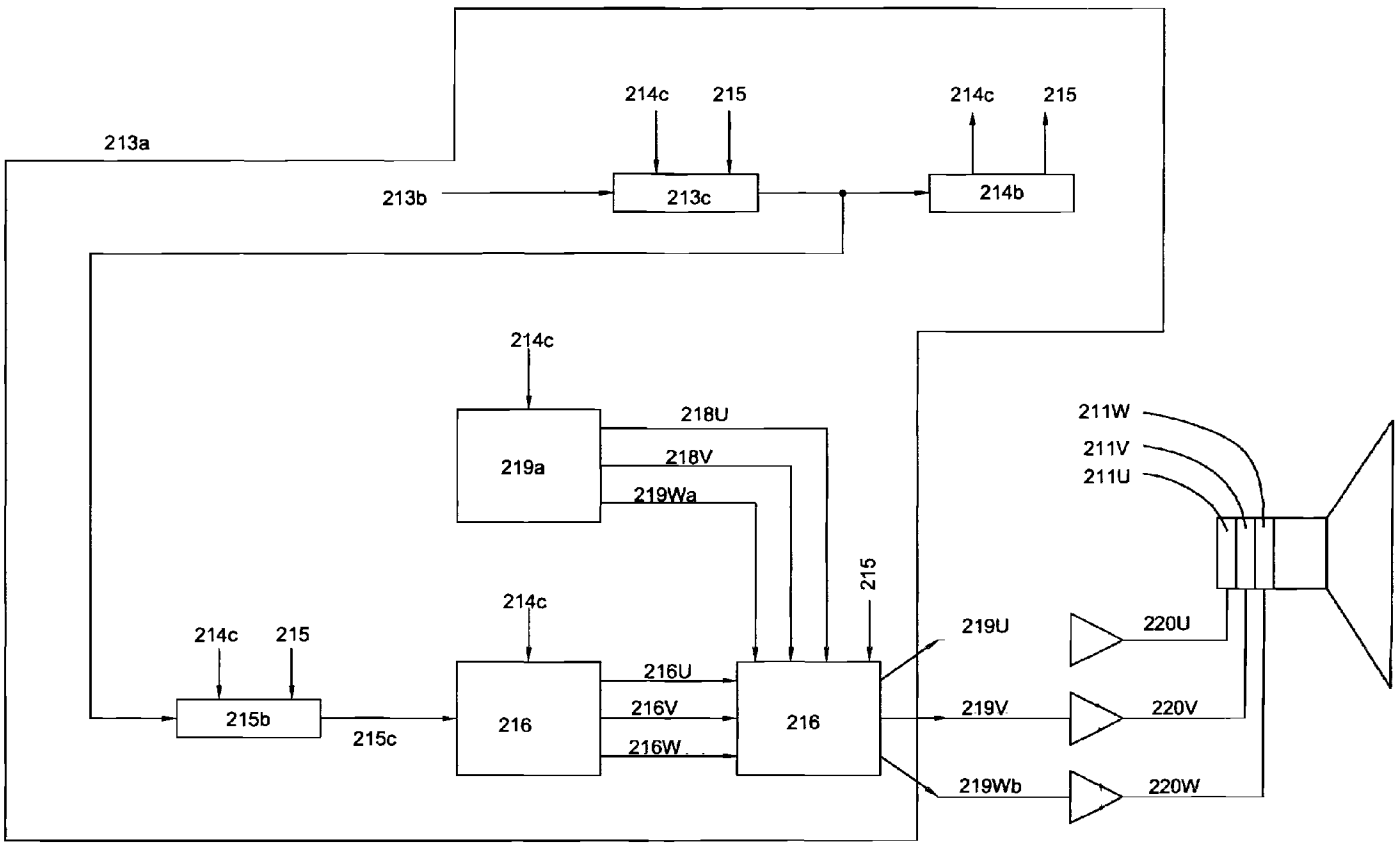
Figures 2, 3, 4, 4A:
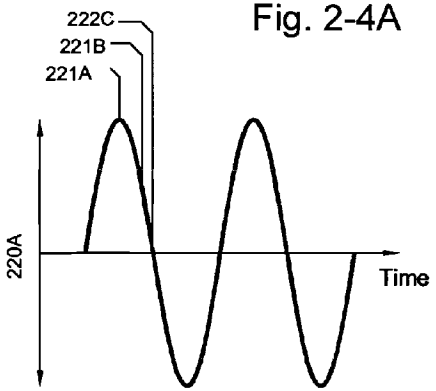
Figures 2, 3, 4, 4B:
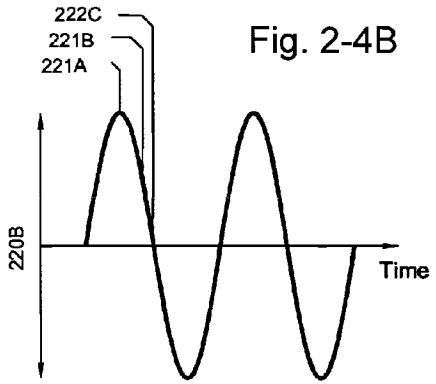
Figures 2, 3, 4, 4C:
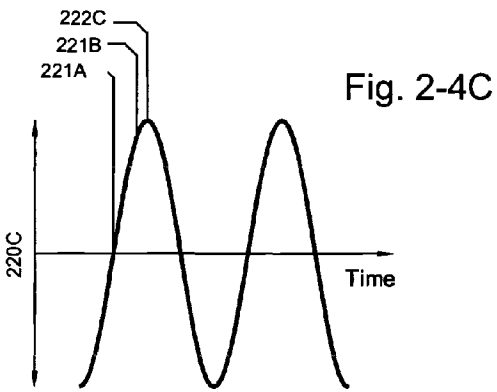
Figures 2, 3, 4, 4D:
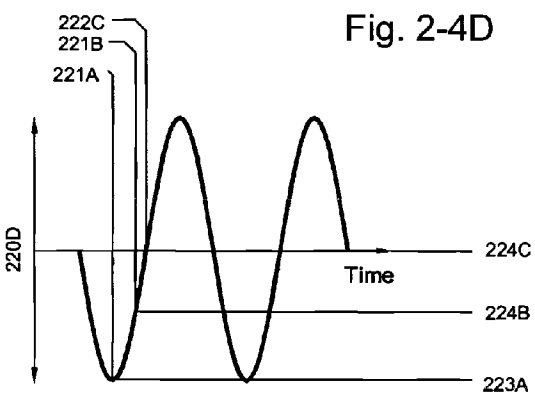
Figures 2, 3, 4, 5, 5A, 5B, 5C:
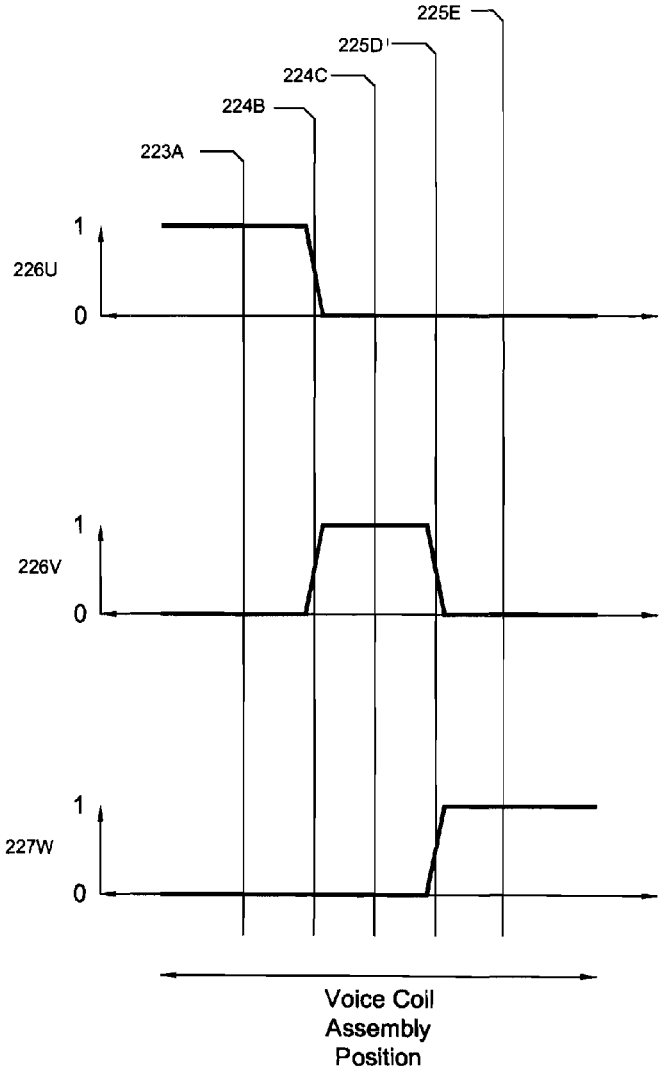
Figures 2, 3, 4, 5, 6, 6A, 6B, 6C, 6D:
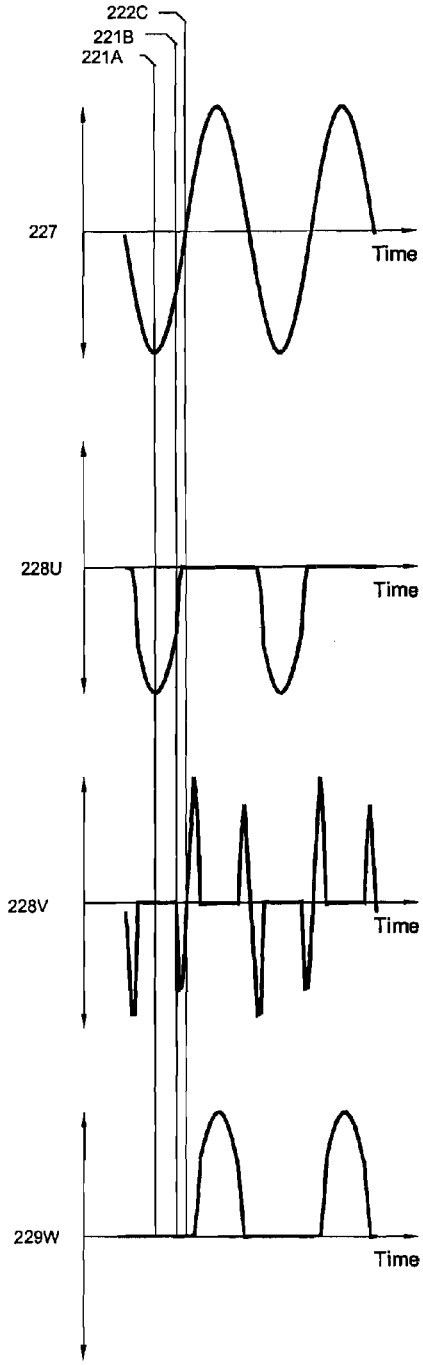
Figures 2, 3, 4, 5, 6, 7, 7A, 7B, 7C:
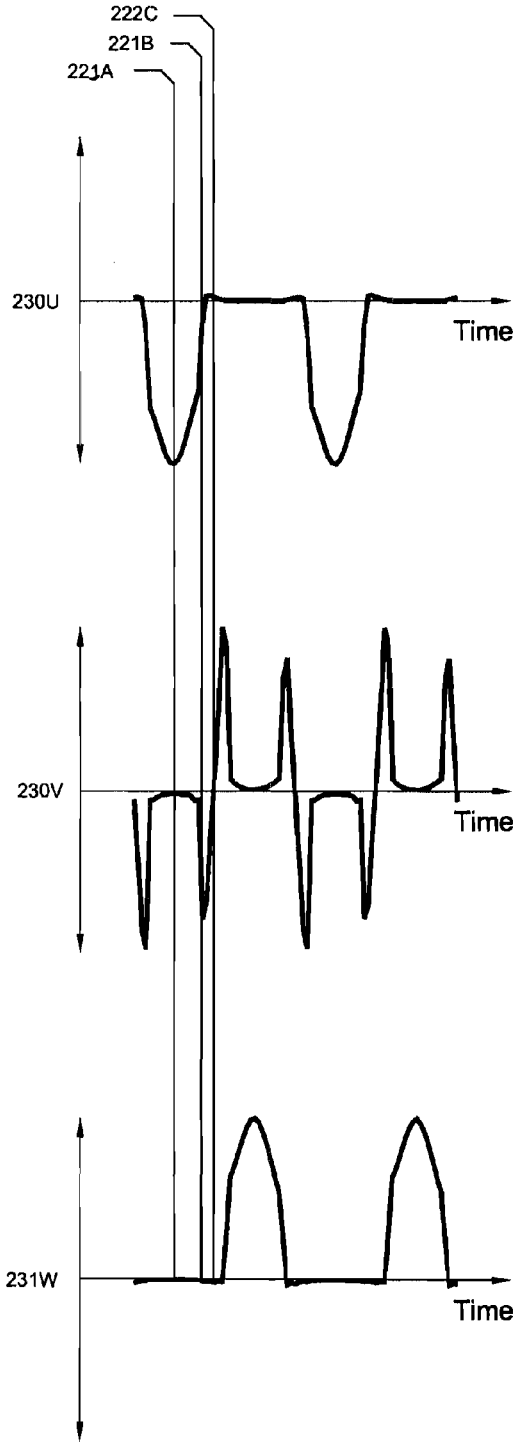
Figures 2, 3, 4, 5, 6, 7, 8, 8A, 8B, 8C:
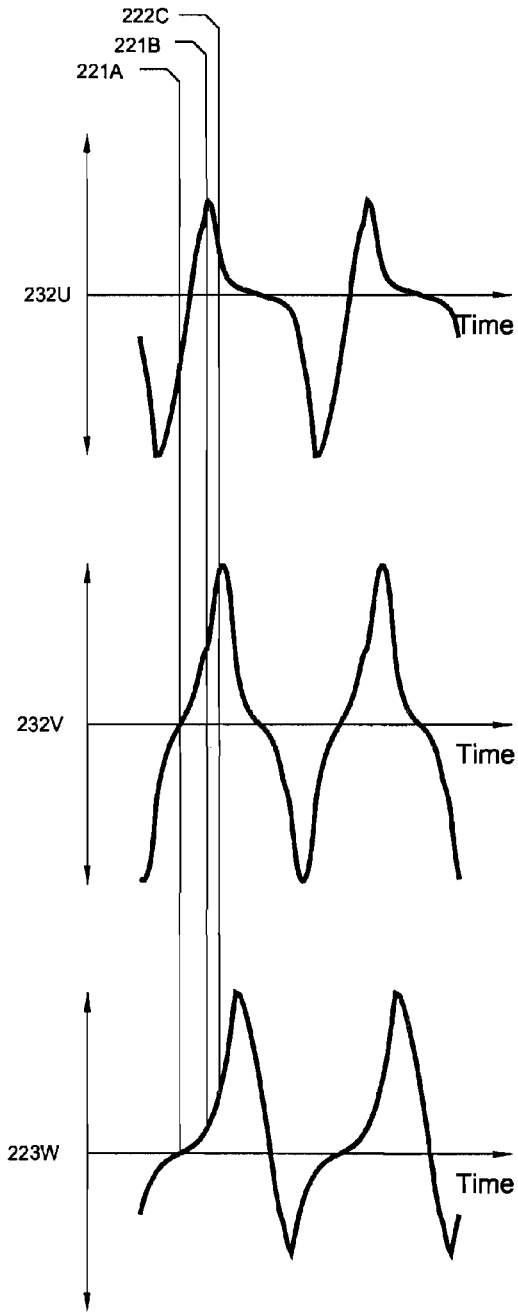
Figures 2, 3, 4, 5, 6, 7, 8, 9, 9A, 9B, 9C:
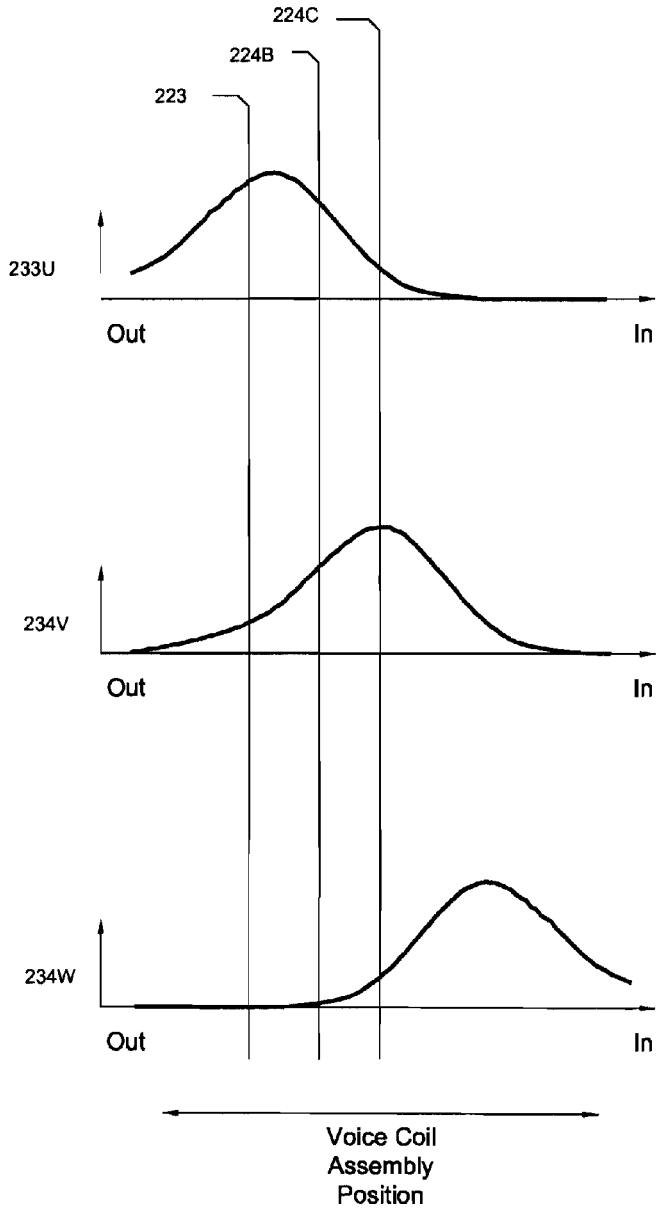
Figures 2, 3, 4, 5, 6, 7, 8, 9, 10:
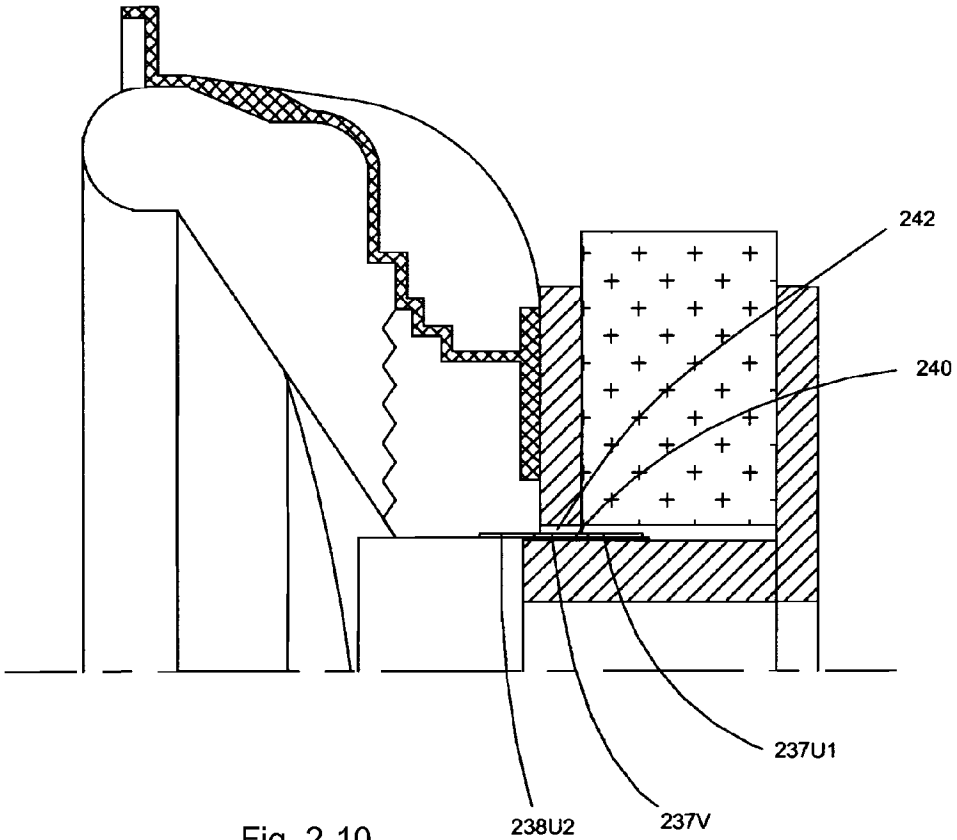
Figures 2, 3, 4, 5, 6, 7, 8, 9, 10, 11:
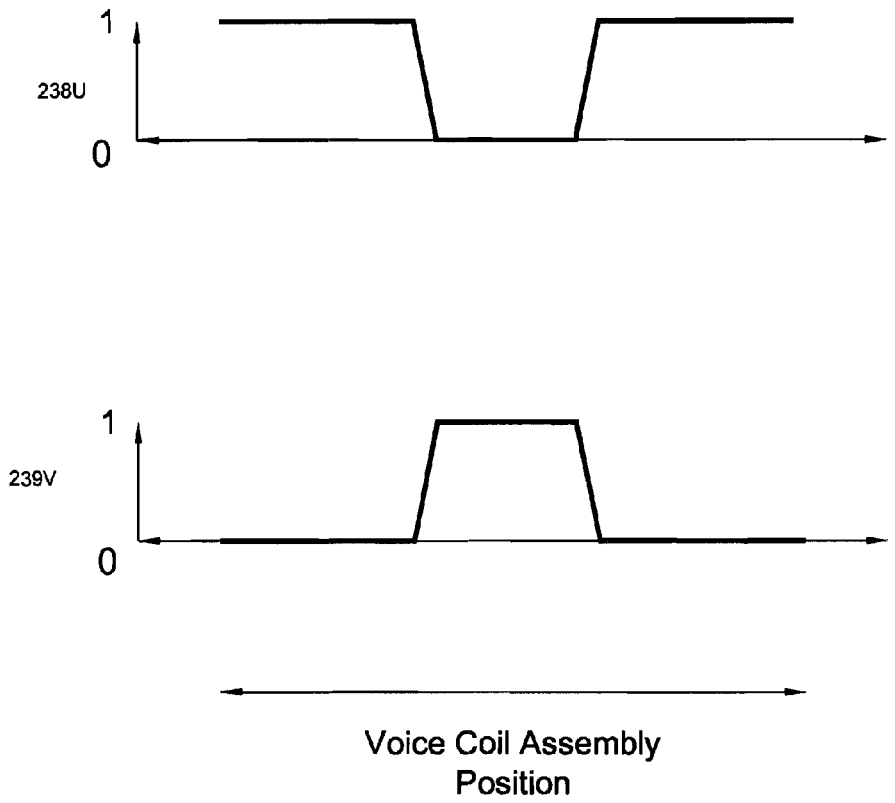
Figures 2, 3, 4, 5, 6, 7, 8, 9, 10, 11, 12:
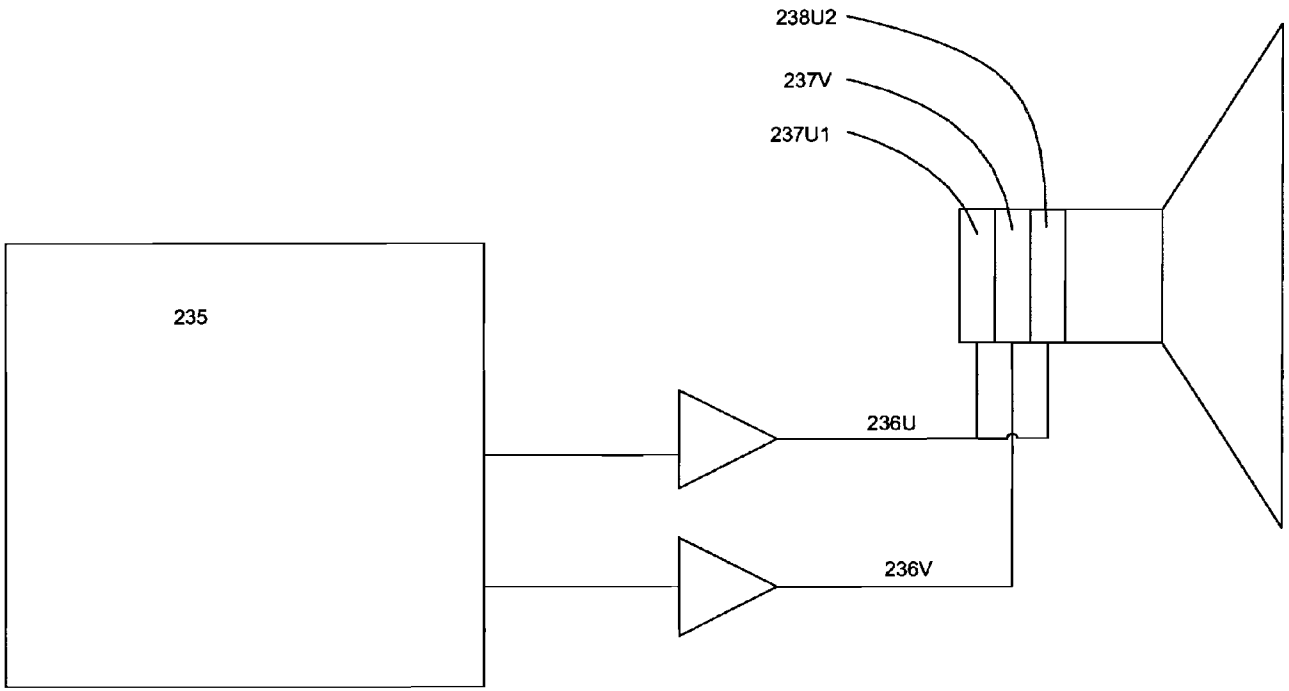
Figures 2, 3, 4, 5, 6, 7, 8, 9, 10, 11, 12, 13:
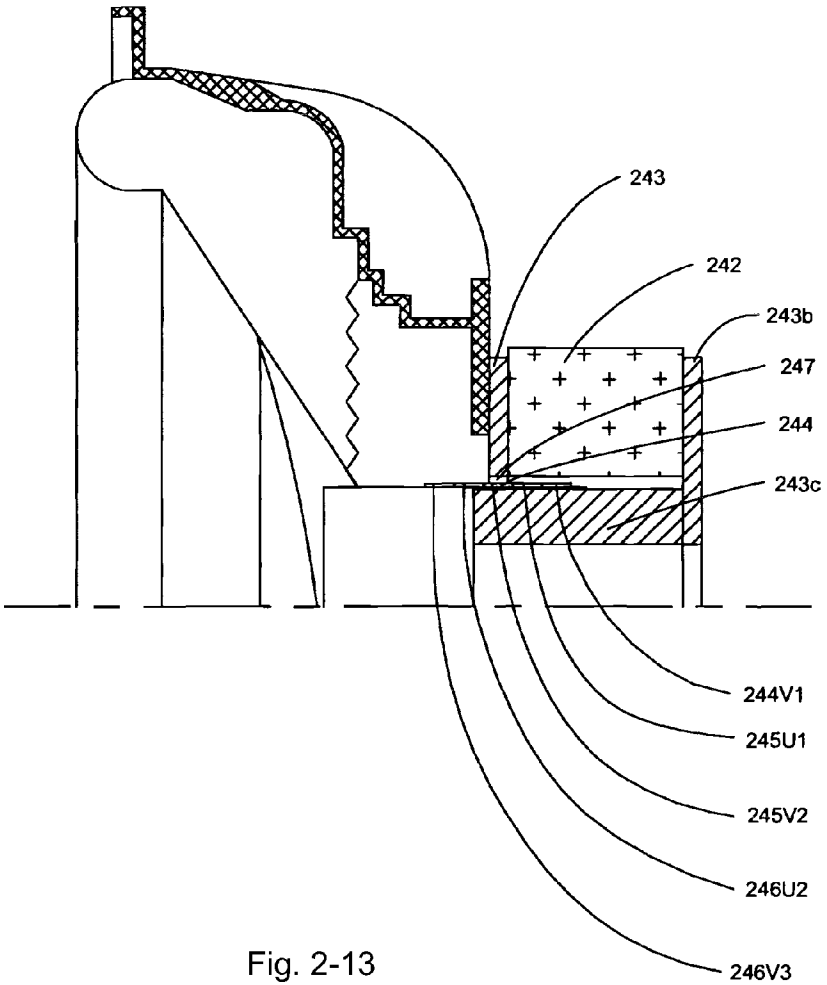
Figures 2, 3, 4, 5, 6, 7, 8, 9, 10, 11, 12, 13, 14:
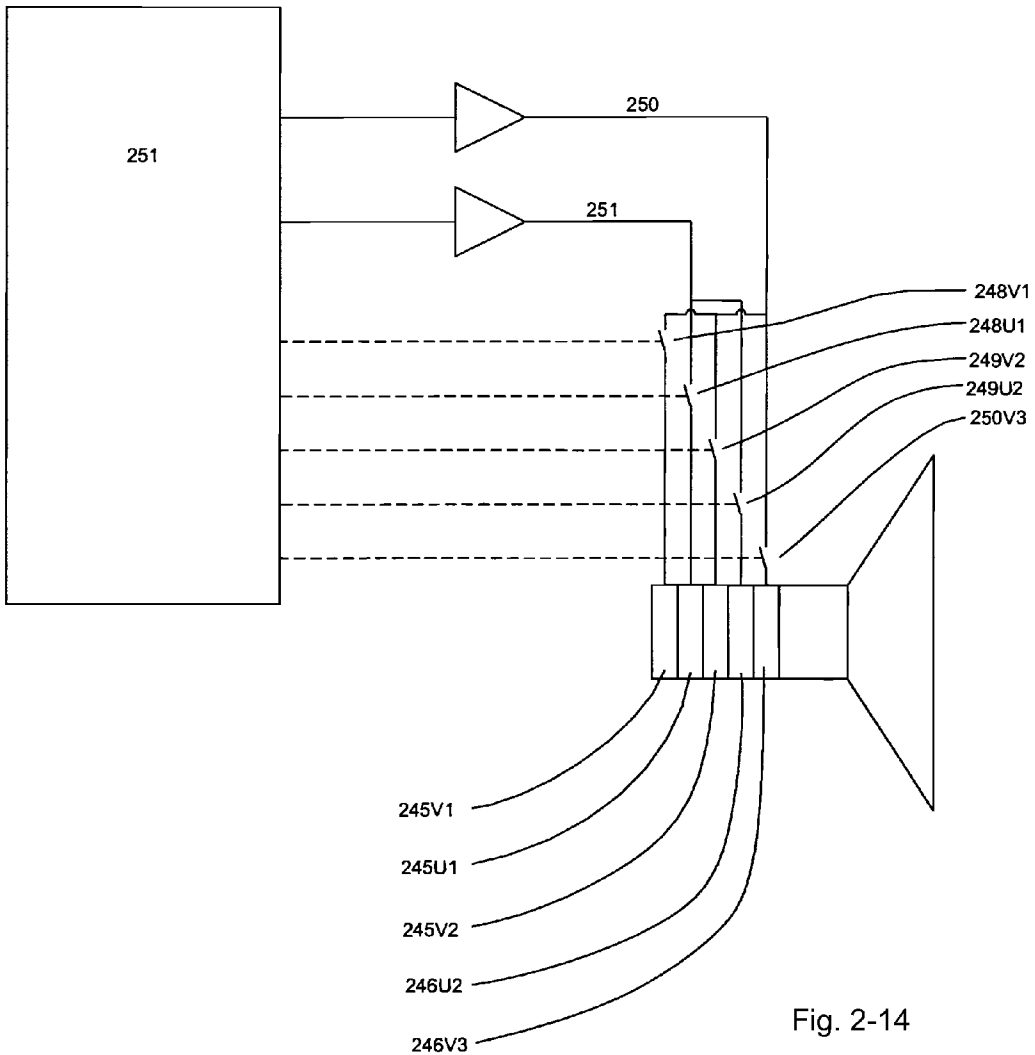
Figures 2, 3, 4, 5, 6, 7, 8, 9, 10, 11, 12, 13, 14, 15:
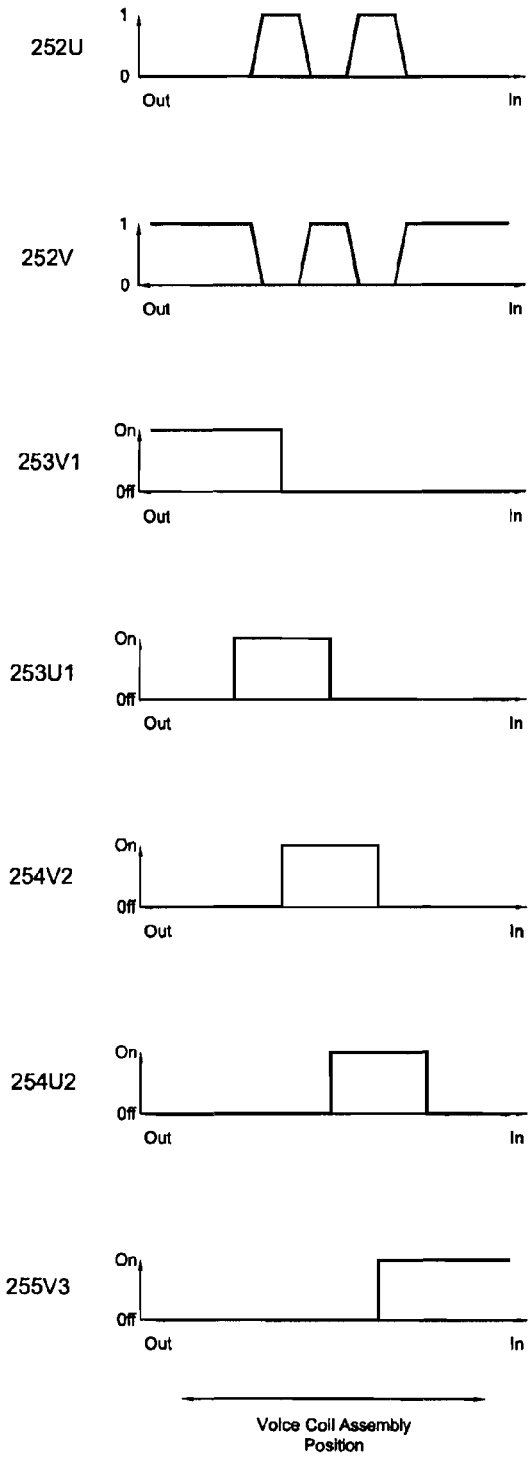
Figures 1, 3:
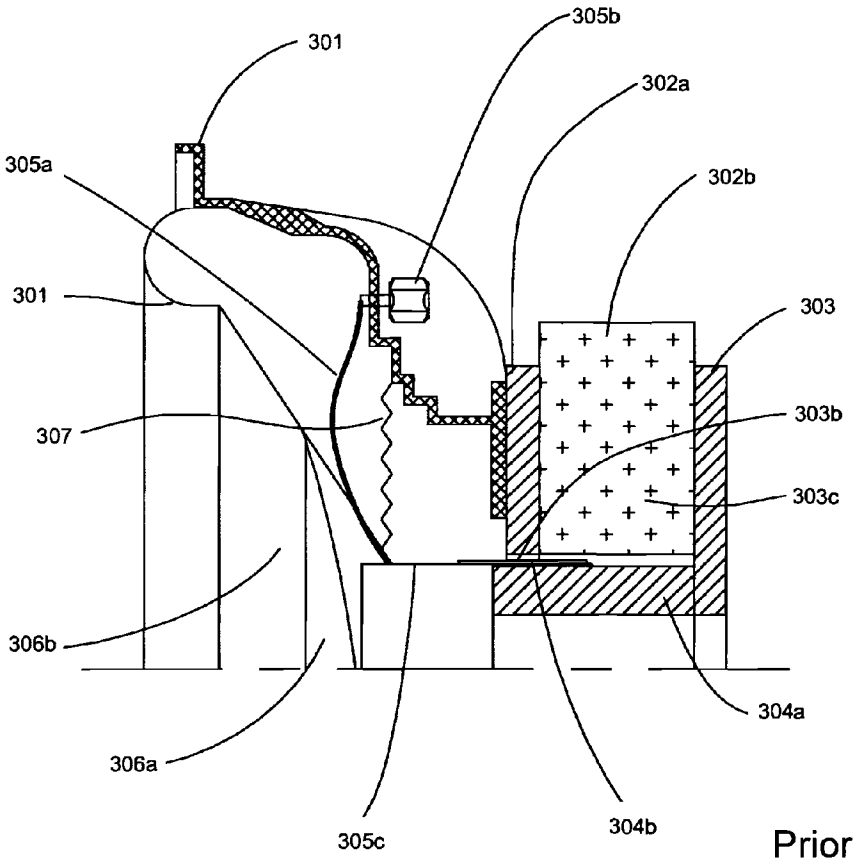
Prior Art Fig. 3-1
Figures 2, 3:
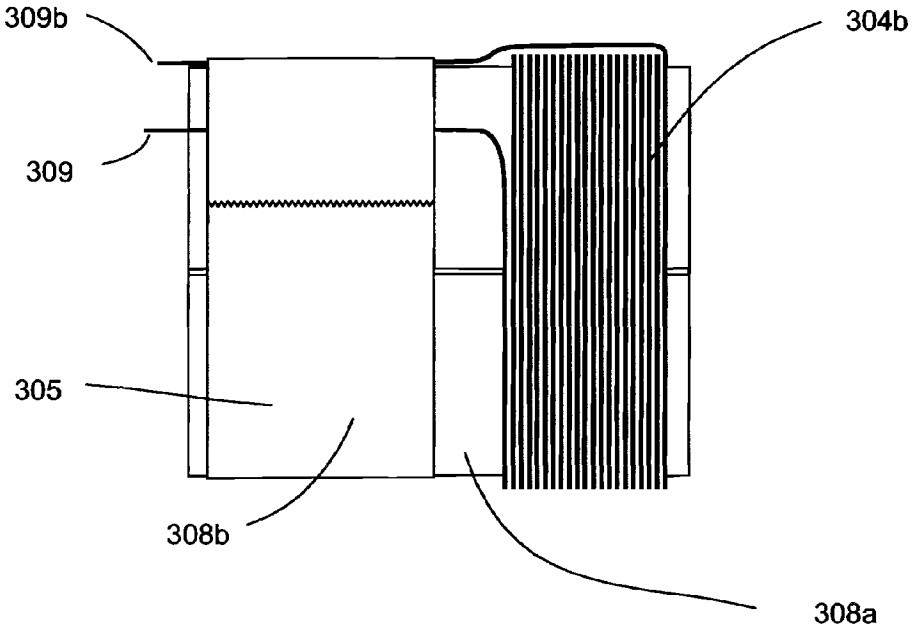
Figure 3:
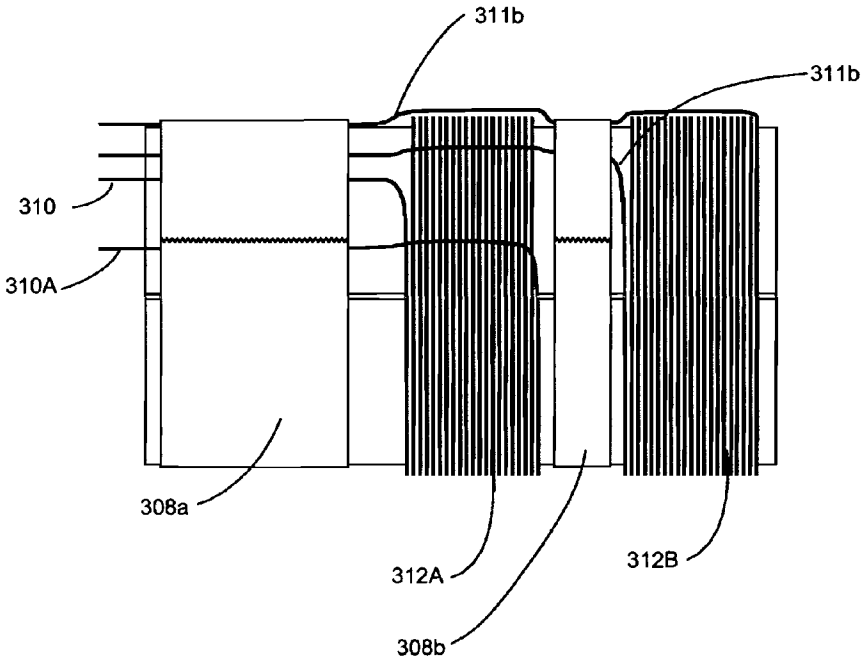
Prior Art Fig. 3-3
Figures 3, 4:
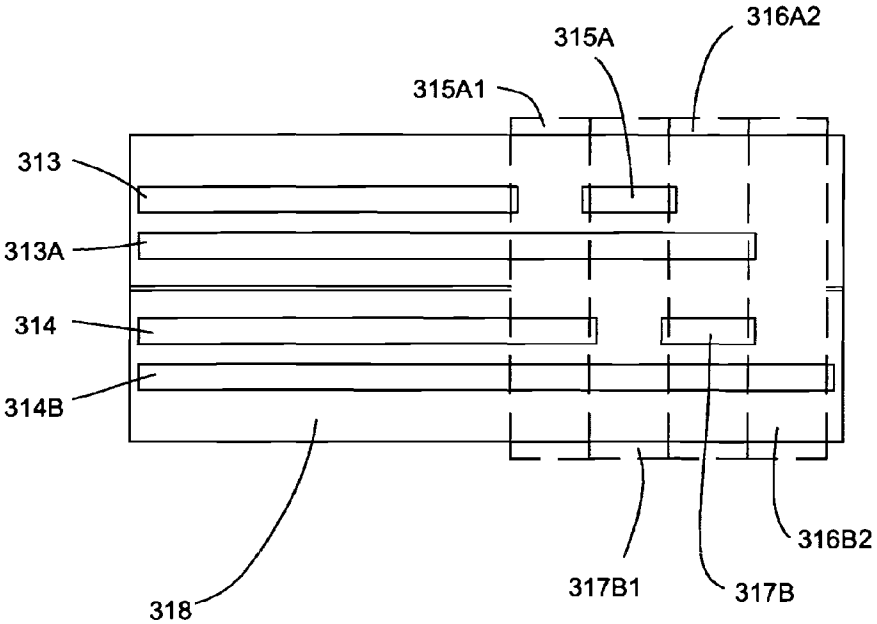
Figures 3, 4, 5:
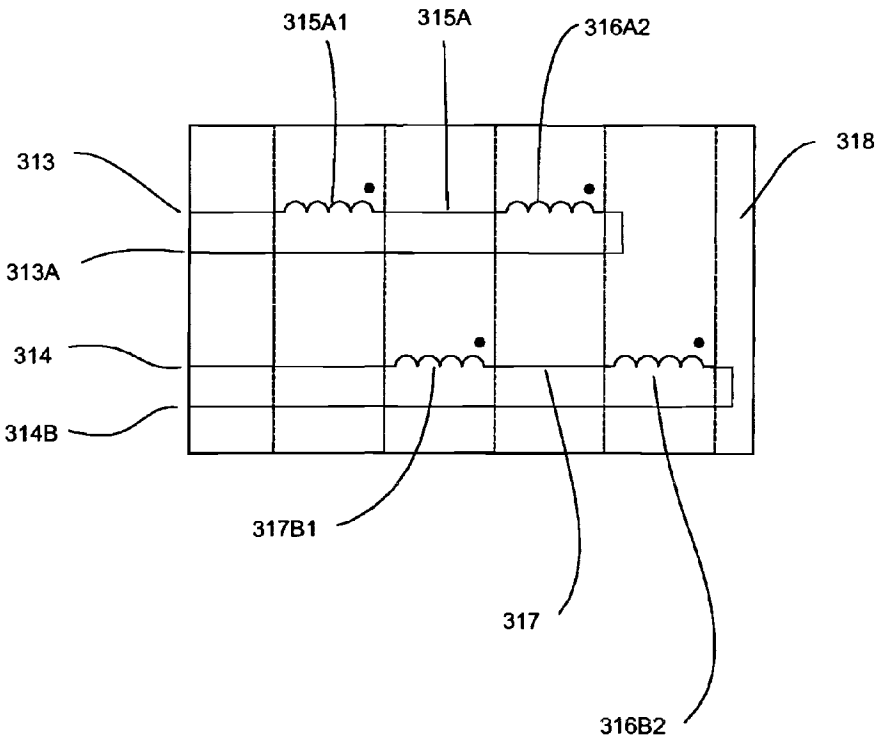
Figures 3, 4, 5, 6:
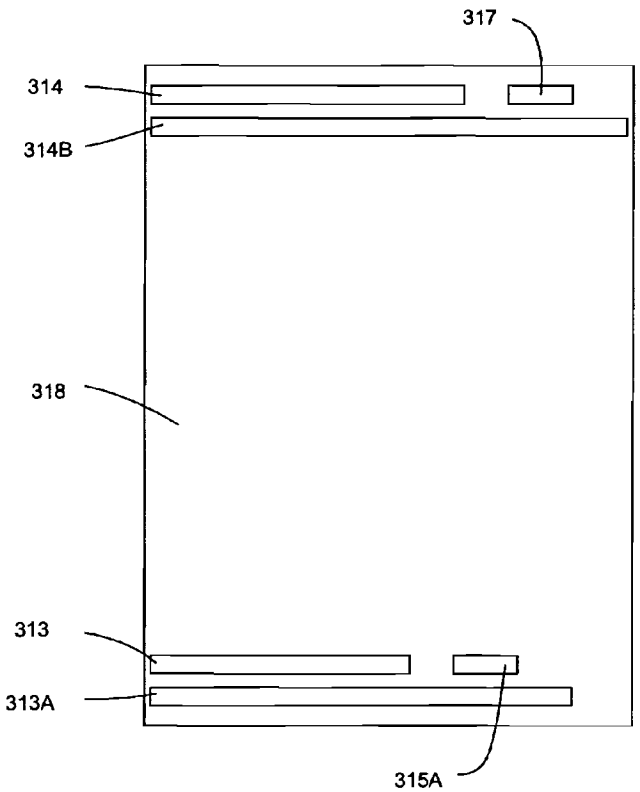
Figures 3, 4, 5, 6, 7:
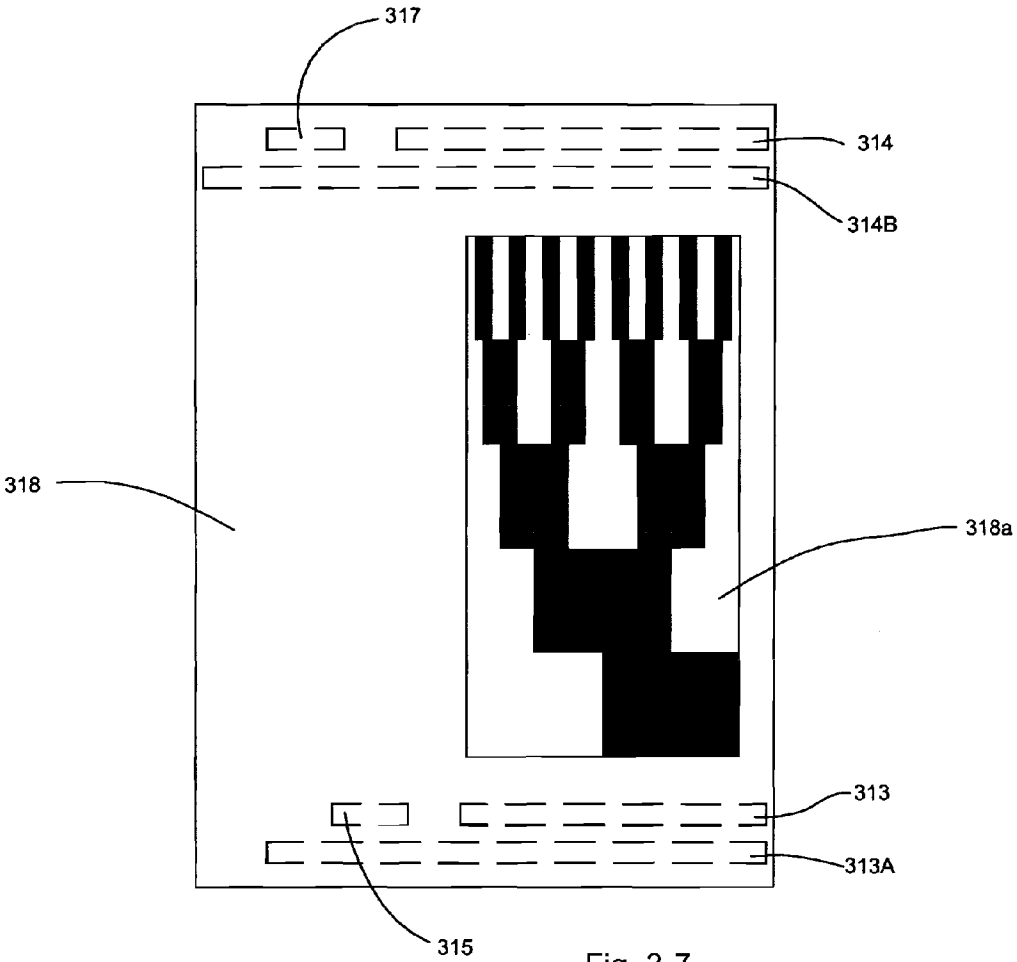
Figures 3, 4, 5, 6, 7, 8:
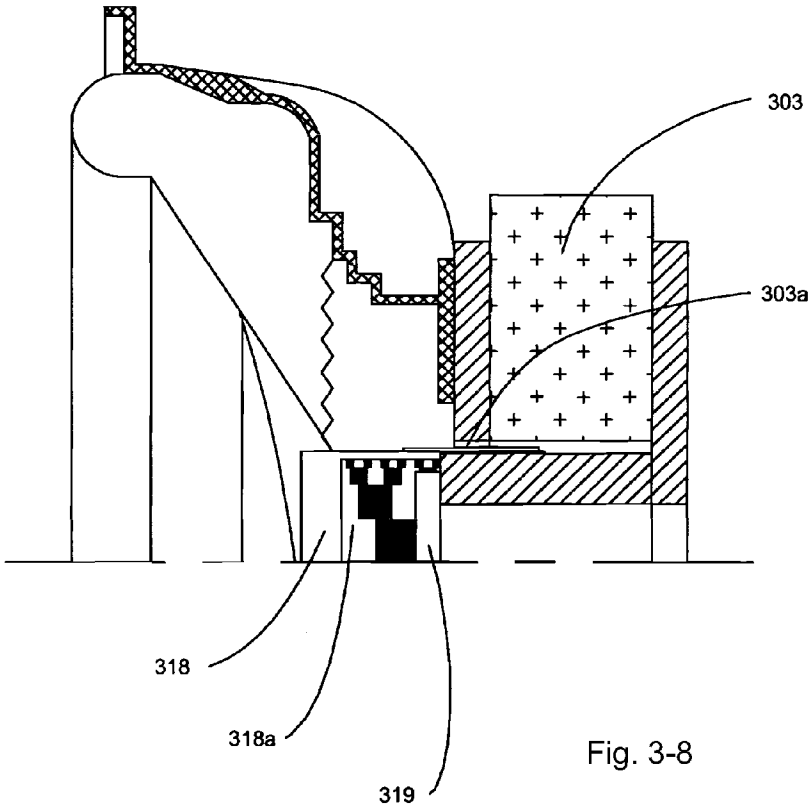
Figures 1, 4:
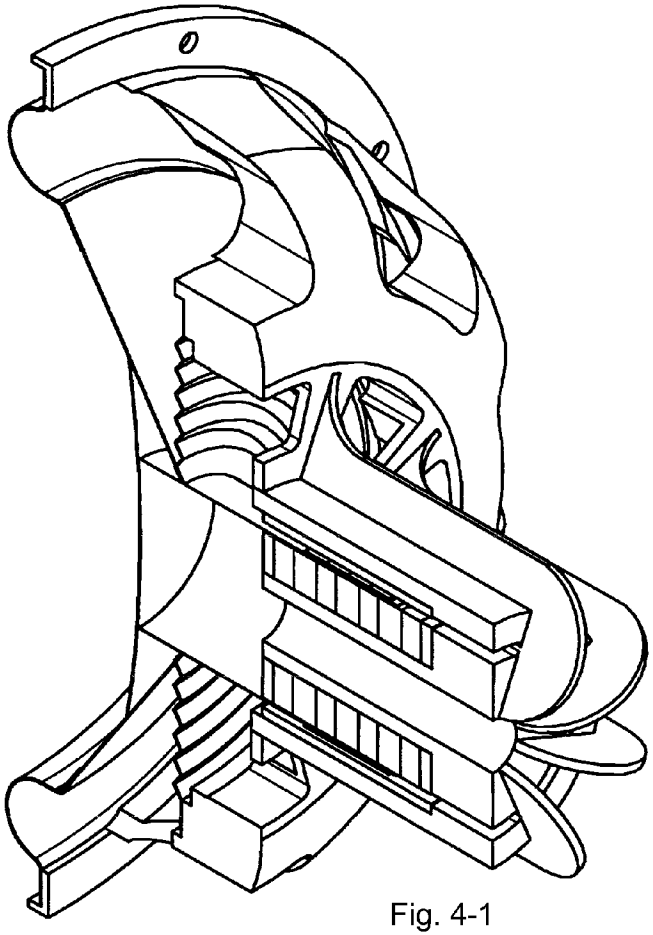
Figures 2, 4:
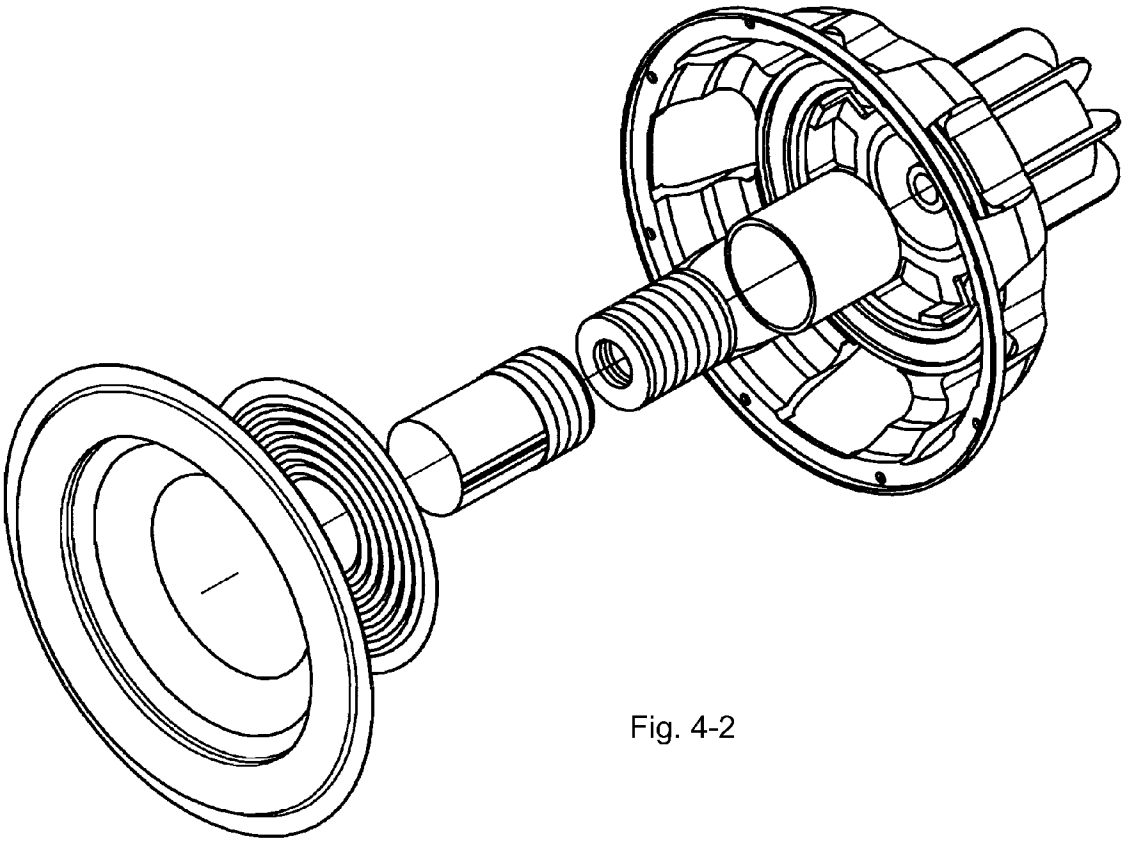
Figures 3, 4:
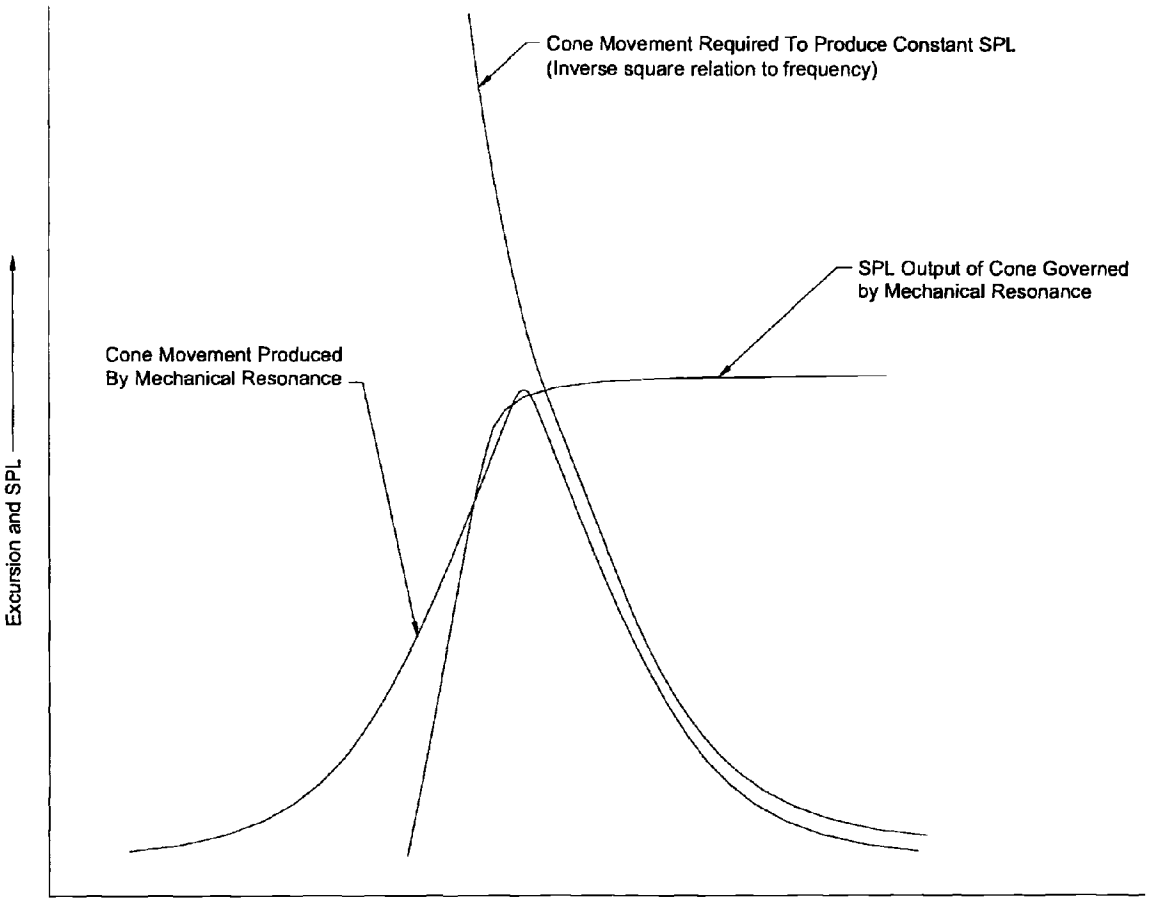
Figure 4:
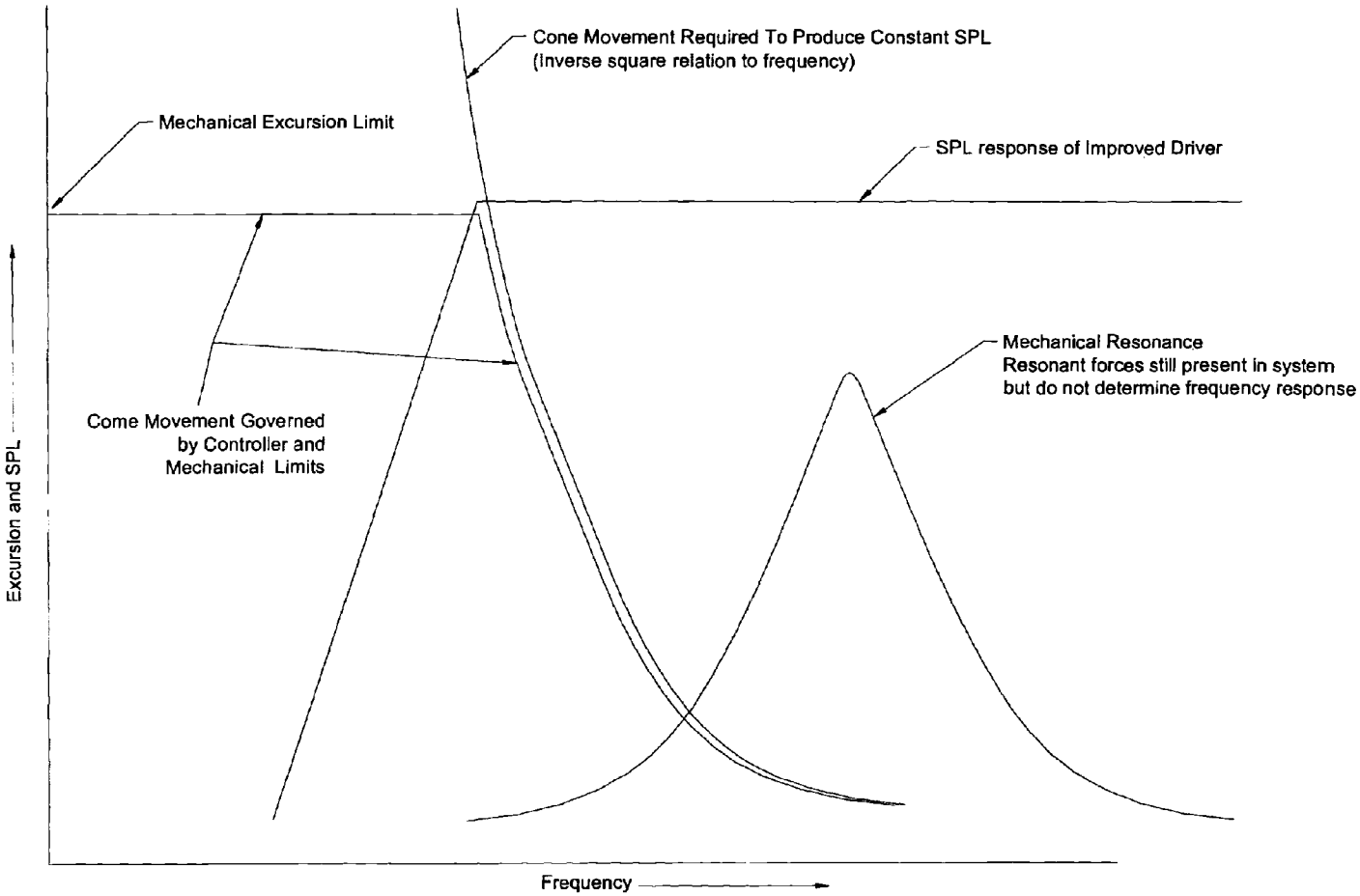
Figures 4, 5:
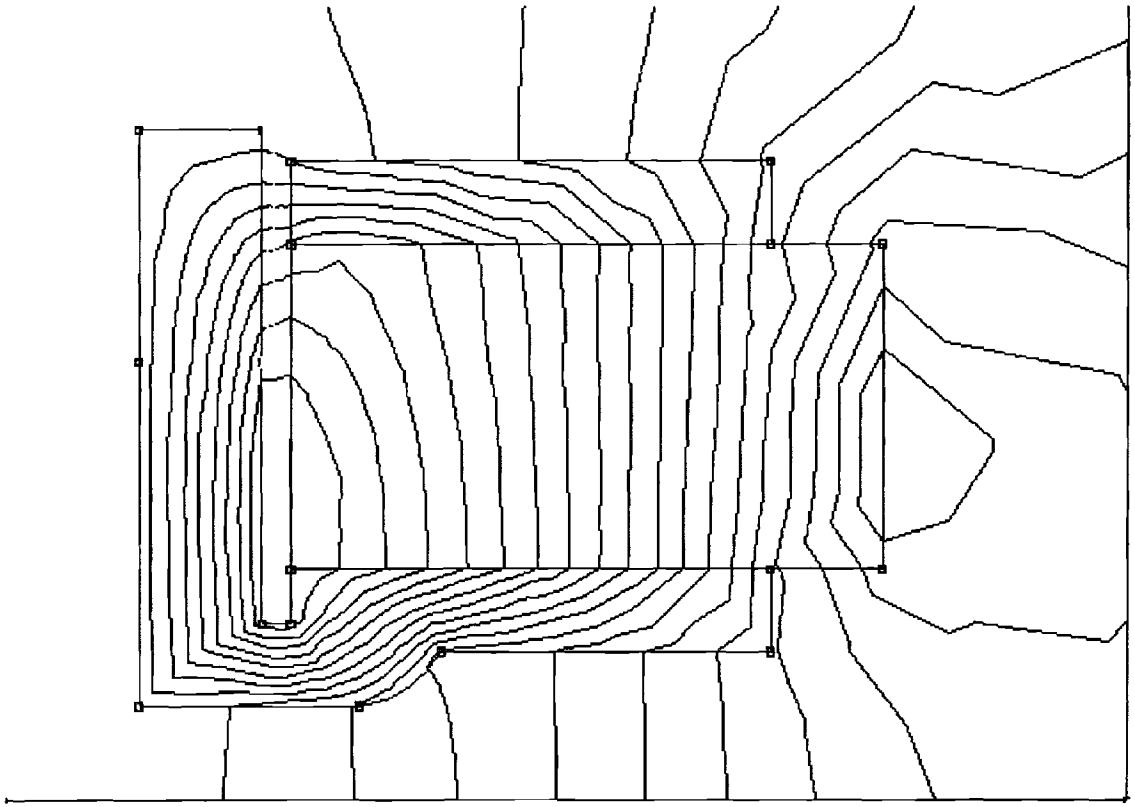
Figures 4, 5, 6:
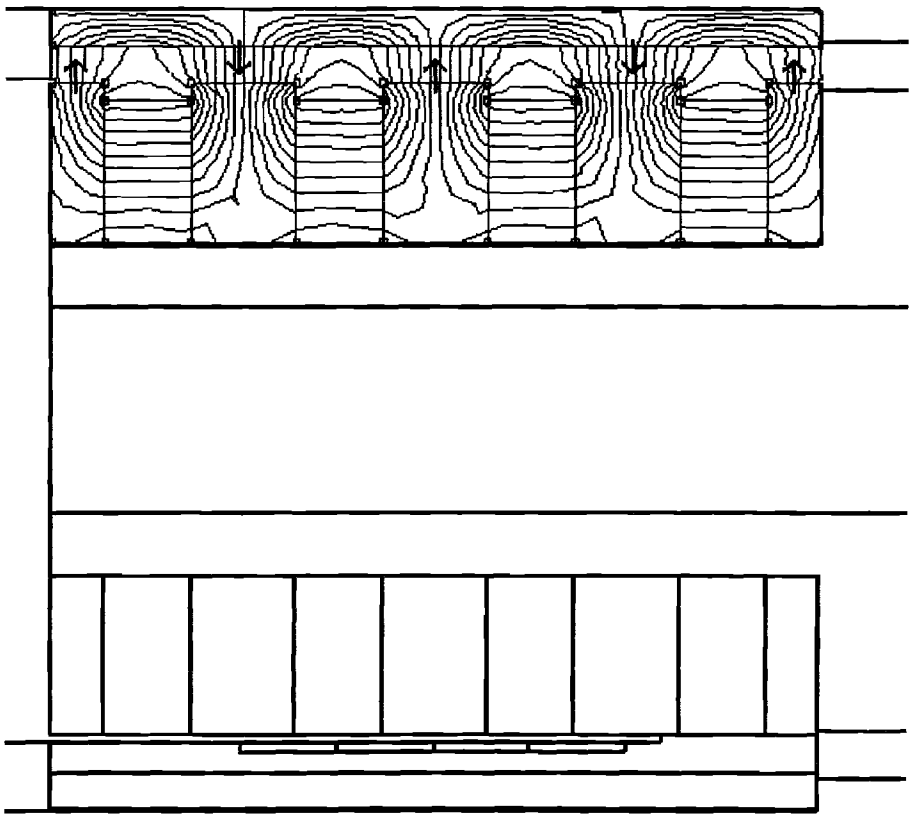
Figures 4, 5, 6, 7:
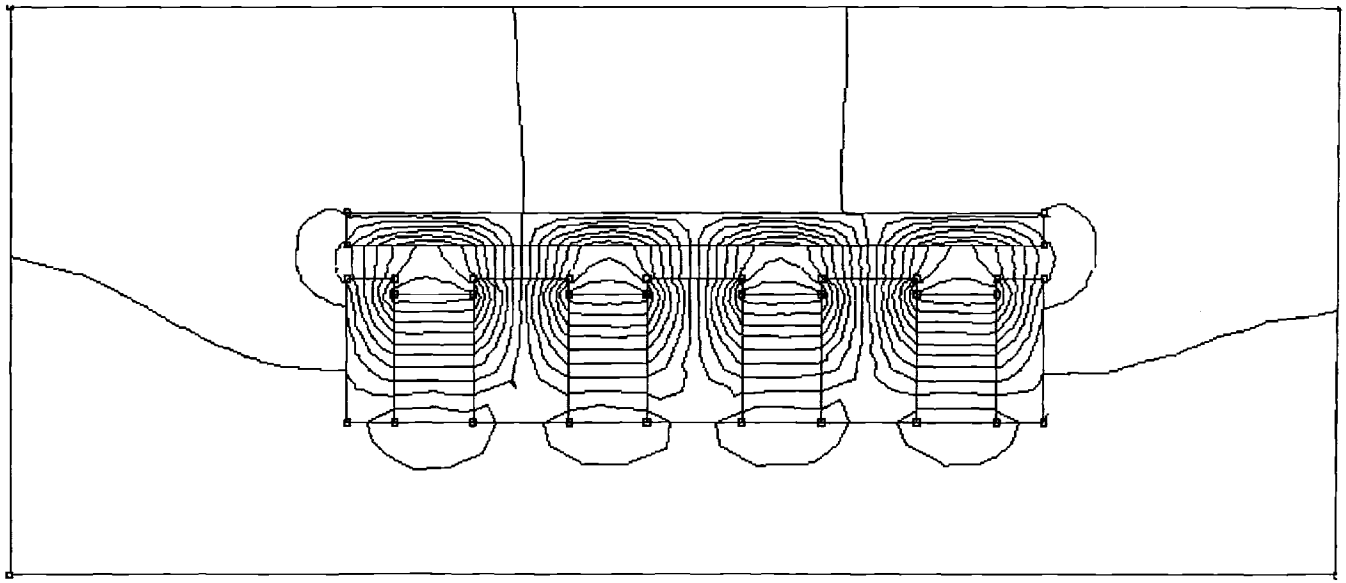
Figures 4, 5, 6, 7, 8:
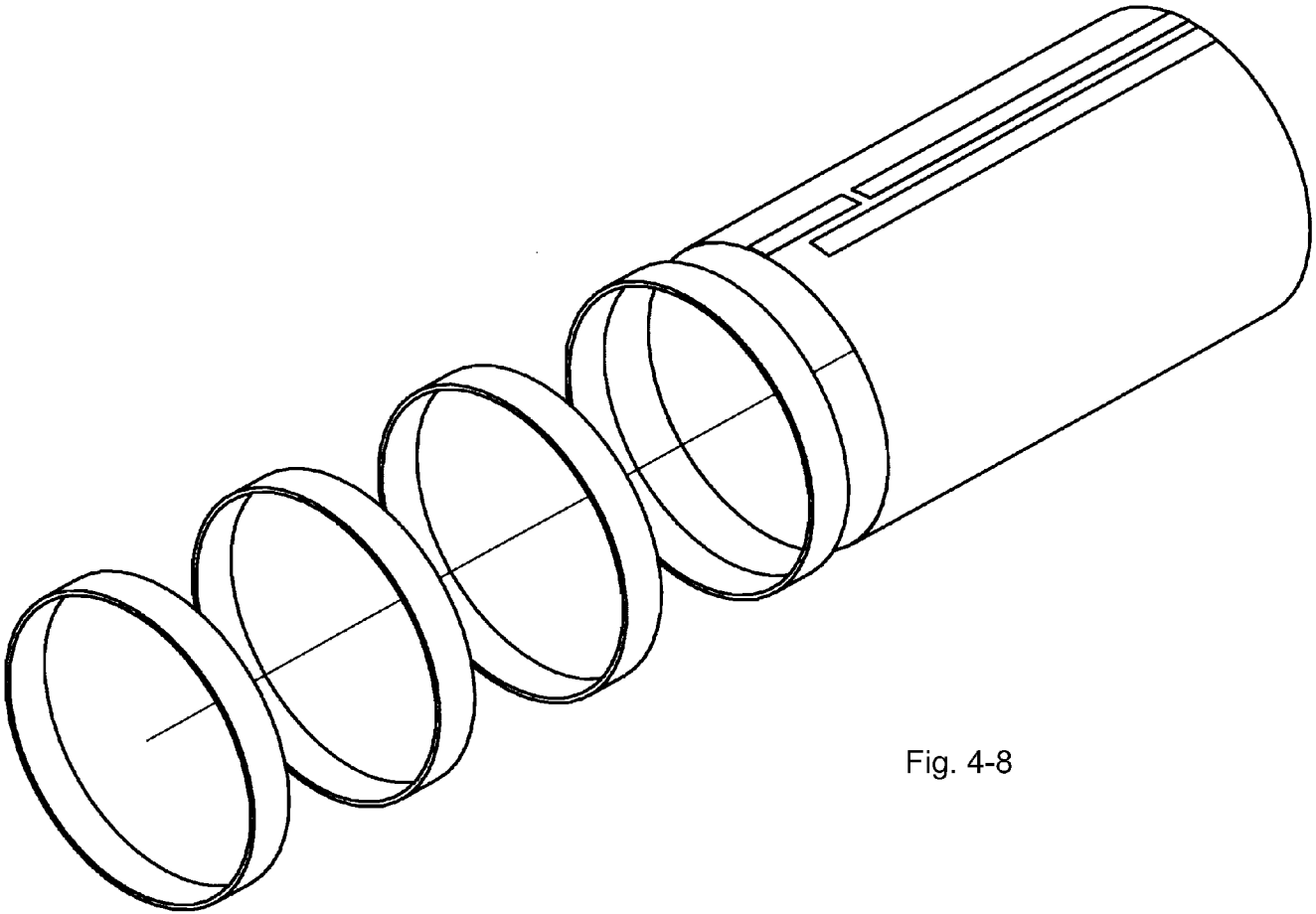

FIG. 3-4 shows an assembled view of another aspect of embodiments of the invention. The coils A1, A2, B1, B2 (315A1, 316A2, 316B2, 317B1) are shown in dashed lines so that the circuit connections may be seen. FIG. 3-5 shows the electrical schematic and layout of this same embodiment. This arbitrary four-coil arrangement was chosen as an example to show the ability of the invention to handle multiple coils in multiple circuits, but the invention applies to any number of coils and/or circuits.

The leads (313, 313A, 314, 314B) and interconnects (315, 317) may be formed in a variety of ways, perhaps such as of a conductive foil, such as copper. They may also be bonded or otherwise affixed to the voice coil former 180. The surface leads may be bonded surface leads, printed circuit board leads, deposition formed leads, flexible surface leads, flexible printed circuit board leads, or otherwise. The coils (315A1, 316A2, 316B2, 317B1), which may be made of ordinary magnet wire or other conductor, are electrically connected by solder or other means to the leads and interconnects (313, 313A, 314, 314B, 315A, 317). The flying leads may be connected in a similar manner. The coils (315A1, 316A2, 316B2, 317B1) may either be wound on the former 318 or made separately and later assembled and connected to the former 318.

FIG. 3-6 shows a plan view of the voice coil former (318) when it has been unwrapped, so that it is in sheet form rather than tubular, as shown in FIG. 3-4. In FIG. 3-6 the outer radial surface of the former is facing the reader. Here it can easily be seen that the voice coil former might be made easily using conventional flexible printed-circuit techniques. As shown, the leads can be designed as axially interrupted traces and may even be parallel traces.

FIG. 3-7 shows a similar plan view of one type of voice coil former 318 when it has been unwrapped, so that it is in sheet form rather than tubular, as shown in FIG. 3-4. In FIG. 3-7 the inner radial surface of the voice coil former is facing the reader. The leads and interconnects (313, 313A, 314, 314B, 315A, 317) are shown in dashed lines to show that they are on the opposite side of the former 318 sheet. FIG. 3-7 shows how a linear encoding track 318*a* may be printed or otherwise applied such as to the inner surface of the voice coil former. If the former is translucent, such as a translucent voice coil former, the encoding track, or more generally position encoding indicia, could also be applied on the outer surface of former 318. The encoding tracks may be dark or reflective, or even possibly made of some alternative material such as ferrite paste for use as an inductive sensing track. The system may provide a digital position sensor or even a multi-bit digital position sensor. While a 5-bit gray scale absolute encoding track is shown, it should be understood that any type of linear or non-linear digital or analog encoding track may be used. It should also be understood that while an optical track or more generally, a optical position encoding indicia, is shown, any type of sensing method may be employed.

FIG. 3-8 shows a cut away of a loudspeaker utilizing the encoding track 318*a* of the improved voice coil former. FIG. 3-8 shows how a sensing element 319, such as an array of sensors or even array of optical transmitter-receiver pairs may be mounted on the inner pole piece. The sensing element 319 may be used to read the encoding track 318*a* during operation.

Surface leads such as the foil conductors (313, 313A, 314, 314B, 315, 317, FIG. 3-4) of such embodiments may be affixed to a voice coil former and may allow the interconnection of multiple coils (315A1, 316A2, 216B2, 317B1 FIG. 3-4) with minimal affect on the magnetic gap width (303*b*, FIG. 3-1) because the required conductor cross-sectional area may be achieved by using a conductor shape that is wide in the circumferential dimension but thin in the radial dimension.

Both having high aspect ratio current leads and the dual open ended cooling possibility can contribute to providing a narrow gap drive system, namely one that permits closer tolerances that the prior art. Because the magnet wire used in loudspeakers is generally of relatively small gage, the circumferential width of the conductors is relatively narrow, which permits a large number of conductors on any given voice coil assembly. By the same means, a single-coil system may have an odd number of winding layers with minimal impact on the magnetic gap width. The high aspect ratio current leads can have aspect rations that are greater than 1, such as greater than 2, 3, 5, 10, 100, or even up to 1000.

Because the leads and interconnects (313, 313A, 314, 314B, 315, 317, FIG. 3-4) of such an embodiment voice coil assembly may be affixed to the former (318, FIG. 3-4), rather than made of the magnet wired used for the coil, several assembly methods are convenient. The voice coil former may be mounted on a mandrel and the coils (315A1, 316A2, 316B2, 317B1 FIG. 3-4) may be wound directly onto the former 318. Alternatively, the coils (315A1, 316A2, 316B2, 317B1 FIG. 3-4) could be wound separately in such a way that their shape is maintained during handling, such as with bondable magnet wire. These pre-formed coils may then be assembled and connected to the assembly in a later manufacturing step. The foil conductors (313, 313A, 314, 314B, 315A, 317, FIG. 3-4) may be affixed or applied to a flexible substrate that may be flexibly applied, such as polyimide, and later formed into a tubular shape. This means it is also possible to manufacture the former 318 by utilizing conventional flexible printed circuit techniques.

The applied encoding track 318*a* may allow the improved voice coil assembly to function as part of a position transducer. This position transducer can even have inherent advantages over conventional position measurement techniques. The relative position of the encoding track 318*a* may be closely coupled to the voice coil (315A1, 316A2, 316B2, 317B1 FIGS. 3-4) positions, which reduces error associated with drift, deflection, and cone wobble. Because both the coils (315A1, 316A2, 316B2, 317B1 FIGS. 3-4) and the encoding track 318*a* may be affixed to the same former 318, and assembly tolerances may be controlled, it may be possible to eliminate the position transducer calibration from the manufacturing process.

Many alternative embodiments are possible. The number of coils is arbitrary, as is the interconnection of the coils. There are many choices of voice coil former material, for example polyimide, aluminum, or paper. The assembly may be over-wrapped by an electrically insulating layer element or used without. There are also many choices of conductor material, bonding agents, and so forth. The assembly may start as a sheet form and then be formed into tubular form, or may start in tubular form. The encoding track may be digital or analog, absolute or incremental, optical in nature or otherwise. The encoding track may be applied to the inside or outside surface of the former. Various sensors and indicia can be used, including but not limited to a digital position sensor, an analog position sensor, a linear position sensor, a nonlinear position sensor, a dynamic model position sensor component, a software position sensor component, a memory based position sensor component, an acceleration position sensor, a controller calculated position sensor component, a dark indicia, a reflective indicia, a sensable material indicia, and even a ferrite paste indicia, to name a few.

To aid in understanding the foregoing, the following listing provides an indication of the various items shown in embodiments of the invention shown in various figures. These should be understood as merely particular examples and are not to be understood as limiting the more general characterizations provided elsewhere, particularly in the claims.

101 Voice coil former
102 Back plate
103 Magnetic leakage
104 Magnet
105 Spider
106 Surround
107 Magnetic circuit
108 Top place
109 Magnetic gap
110 Voice coil
111 Cone
112 Excursion limit
113 Magnet assembly
114 Traveling assembly
115 Pole piece
116 Magnet
117 Voice coil former
118 Cone assembly
119 Poston air gap
120 Voice coil assembly
120*b* Axial division line
120*b* Driver
121 U winding circuit
122 V winding circuit
124 Normally-wound U winding segment
124 Normally-wound U winding segment
125 Counter-wound U winding segment
126 Normally-wound V winding segment
127 Counter-wound V winding segment
128 Pitch between opposite-wound winding segments
129 Pitch between like-wound winding segments
130 Magnetic poles with outward flux
131 Magnetic poles with inward flux
135 Surround
135*b* U Winding segment
135*c* V Winding segment
136 Spider
137 Outer magnetic shorting element
138 Moving outer magnetic shoring element
120 U Winding circuit
120*b* Driver
122 V Winding circuit
139 Inner outer magnetic stator
140 Outer magnetic stator
144 V winding commutation function
145 U winding commutation function
151 Master current command
152*a* Sensor
152*b* Temperature calculation
152*c* Temperature protection algorithm
152*d* Current feedback input
152*f* Motion feedback input
152*e* Current sensor
153 Position calculation
157*b* Audio input
154 Motion control algorithm
157 Motional voltage compensation
158 Master voltage command
160 First traveling assembly
161 Second traveling assembly
162 Enclosure volume
163 Inner air passage
164 Outer air passage
165 Inner magnet assembly
166 Outer magnet assembly

180 Outer magnet ring
181 Outer pole piece
182 Inner magnet
183 Inner pole piece
184 inner magnetic shorting element
201 Surround (for conventional driver)
215 Basket (for conventional driver)
202 Top plate (for conventional driver)
202*b* Magnet (for conventional driver)
203 Back plate (for conventional driver)
203*b* Magnetic gap (for conventional driver)
204 Inner pole piece (for conventional driver)
204*b* Voice coil (for conventional driver)
205 Voice coil overhang (for conventional driver)
205*b* Voice coil former (for conventional driver)
206 Dust cap (for conventional driver)
206*b* Cone (for conventional driver)
207 Spider (for conventional driver)
210 Magnetic gap
210*b* Voice coil assembly
211U U Winding
211V V Winding
211W W Winding
211 Voice coil former
212 Cone
213 Control section
213*a* Audio input signal
213*b* Control algorithm
214 Acceleration command
214*b* State estimator
214*c* Position
215 Velocity
215*b* Dynamic model
215*c* Master force command
216 Force commutator
216U U winding force command
217V V Winding force command
217 W Winding force command
218U U speaker strength
218V V speaker strength
219Wa W speaker strength
219*a* Speaker strength look-up table
219*b* Voltage calculation
219U U winding voltage command
219V V winding voltage command
219Wb W winding voltage command
220U U Channel amplifier
220V V channel amplifier
220W W channel amplifier
220*a* Input signal
220*b* Voice coil assembly acceleration
220*c* Voice coil assembly velocity
220*d* Voice coil assembly position
221A Time A
221B Time B
222C Time C
223C Position A
224B Position B
224C Position C
226U U force commutation function
226V V force commutation function
227W W force commutation function
227 Voice coil assembly force
228U U winding force
228V V Winding force
229W W winding force
230U U winding current
230V V winding current
231W W winding current
232U U winding voltage
232V V winding voltage
233W W winding voltage
233U U winding speaker strength function
234V V winding speaker strength function
234W W winding speaker strength function
235 Control section
236U U channel amplifier
236V V channel amplifier
237U U1 winding
237V V winding
238 U2 winding
238U U force commutation function
239V V force commutation function
242 Magnet
244 Voice coil assembly
247 Magnetic gap
243 Top plate
343*b* Back plate
243*c* Inner pole piece
244 V1 winding
245U U1 winding
245V V2 winding
246U U2 winding
246V3 V3 winding
248V V1 switch
248U U1 switch
249V V2 switch
249U U2 switch
250 V3 switch
250*b* V channel amplifier
251 U channel amplifier
251 Control section
252U U force commutation
252V V force commutation
253V V1 switch state
253U U1 switch state
254V V2 switch state
254U U2 switch state
255V V3 switch state
301 Surround
301*b* Basket
302*a* Top plate
302*b* Magnet
303 Back plate
303*c* Magnet structure
303*b* Magnetic gap
304 Inner pole piece
304*b* Voice coil
305*a* Flying leads
305*b* Terminals
305*c* Voice coil assembly (prior art)
306*a* Dust cap
306*b* Cone
308*a* Former (prior art)
308*b* Wrap
308*b* Intermediate wrap
309 Source lead
309*a* Return lead
310 Coil A return lead
310A Coil A source lead
311 Coil B return lead
311B Coil B source lead
312B Coil B
312A Coil A

313 Circuit A source lead
313A Circuit A return lead
314 Circuit B source lead
314B Circuit B return lead
315 Circuit A interconnect
315A1 Coil A1
316A2 Coil A2
316B2 Coil B2
317B Circuit B interconnect
317B1 Coil B1
318 Voice coil former
318*a* Encoding track
319 Sensing element As can be understood, embodiments of the invention have many potential applications, from auditorium speakers to portable music players. One example may illustrate. Suppose the goal is to provide a portable battery powered multi-media speaker with deep bass response but limited to a 4 inch driver. A conventional approach might require a typical 4-inch driver with 70 Hz resonance and it may need to have flat response to 20 Hz. If such were tried to operate the driver at its rated SPL all the way down to 20 Hz, the driver would likely be destroyed rapidly by contacting the back plate. It would likely have a lot of low frequency distortion, and would likely overheat quickly. Increasing the magnet size and improving the efficiency and/or linear excursion limit, would cause a weight penalty.

Using the present technology, however, may permit the 70 Hz resonance and perhaps that may be where most of the power is. This could minimize the overall heat dissipation and improve the battery life. If it were chosen to keep the speaker strength and linear excursion limit the same, (even though this will require less magnet), it would be possible with the teachings of the present invention to move the mechanical excursion limit well beyond the range needed to prevent the voice coil from contacting the back plate. Combined with software position limiting of the range of movement of the voice coil assembly or the like, an embodiment could be double-protected from the first destructive effect. The cooling would also be improved, so an embodiment could put more current through the speaker without overheating it, and with thermal control there could again be a double-protected driver. Further the design could substantially eliminate some of the distortion with linearity and thermal compensation. Note that the speaker strength of the improved driver in this example could be the same, but because of commutation the effective resistance would be less. Not only would this inventive driver be better cooled and thermally protected, but it would also generate less heat. This would improve the battery life, and would also allows pushing the driver even harder.

Note that in this example, the speaker strength and excursion limits were the same as for the more traditional driver being replaced. The design could, of course, have more speaker strength and linear excursion by adding another set of magnet poles to the driver to perhaps add a centimeter of driver length. This additional length could increase the speaker strength by about 50 percent. Or this length could increase the linear excursion limit. There would be a very low weight penalty for so increasing the speaker strength and linear excursion limit, thus the new technology may enable making a loudspeaker that may substantially outperform a traditional design.

Examples of embodiments of the present invention configured as a single magnet and 5-magnet system using mechanicals of a conventional 400 W, 12" loudspeaker as a comparison with all other factors (size, wire gauge, total flux, off-the-shelf parts, etc) being the same, the advantages can be easily understood from the following comparative table.

| | Efficiency, Newtons$^2$/Watt (kg/s) | Resistance per phase, ohm | Max Inductance per phase, millihenries (mH) | Peak Magnetic Force Density, Newtons/Weber @ 1 W (Oersteds) |
|---|---|---|---|---|
| Stock Unit | 25-70 | 4.88 | 10 | 19.2 |
| Single-pole commutated prototype | 40-95 | 2.6 | 7 | 22.4 |
| 5-pole commutated prototype | 80-120 | 3.6 | 1 | 28.4 |

The prototypes are all roughly the same mechanically as the convention 400 W, 12" design to facilitate comparison. Further it should be understood that even these prototypes are not optimized. The efficiency ranges are due to different like voice coil positions with peaks in the center. Inductance figures also change with position, however, the maximum per-phase is listed. Finally, the force is determined at 1 watt.

These are but a few examples of design optimization. Many optimization goals are possible. With increased efficiency, improved cooling, relaxed excursion limits, and the benefits of control this technology may give the designer the tools to create substantially improved products with benefits such as:

Improved efficiency

Better Cooling

Very long linear excursion limits

Very long mechanical excursion limits

Very high speaker strength

Software position limiting

Software thermal protection

Combinations that permit operation with reduced safety margin needs

Software magnetic, thermal, and mechanical linearization to reduce distortion

Thermal modeling and compensation to reduce thermal compression

As can be easily understood from the foregoing, the basic concepts of the present invention may be embodied in a variety of ways. It involves both sound generation techniques as well as devices to accomplish the appropriate sound generation. In this application, the speaker techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion is intended to serve as a basic description. The reader should be aware that the specific discussion does not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. The discussion is intended to support both apparatus claims and method or process claims.

It should also be understood that a variety of changes may be made without departing from the essence of the invention. Such changes are also implicitly included in the description. They still fall within the scope of this invention. A broad disclosure encompassing the explicit embodiment(s) shown, the great variety of implicit alternative embodiments, and the broad methods or processes and the like are encompassed by this disclosure. It should be understood that such language changes and broader or more detailed claiming may be accomplished at any time of pendency. With this understanding, the reader should be aware that this disclosure is to be understood to support any subsequently filed claims relative to as broad a base of claims as deemed within the applicant's right and covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the action or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of an "amplifier" should be understood to encompass disclosure of the act of "amplifying"—whether explicitly discussed or not—and, conversely, were there effectively disclosure of the act of "amplifying", such a disclosure should be understood to encompass disclosure of an "amplifier" and even a "means for amplifying". Such changes and alternative terms are to be understood to be explicitly included in the description.

Any patents, publications, or other references mentioned in this patent or listing of references filed with it are hereby incorporated by reference. In addition, as to each term used it should be understood that unless its utilization in this application is inconsistent with a broadly supporting interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in the List of References or other information statement filed with the application are hereby appended and hereby incorporated by reference, however, as to each of the above, to the extent that such information or statements incorporated by reference might be considered inconsistent with the patenting of this/these invention(s) such statements are expressly not to be considered as made by the applicant(s).

LIST OF REFERENCES

Hereby Incorporated by Reference

I. U.S. Patent Documents

| DOCUMENT NO. & KIND CODE (if known) | PUB'N DATE mm-dd-yyyy | PATENTEE OR APPLICANT NAME |
|---|---|---|
| U.S. Pat. No. 4,075,517 | 02-21-1978 | Adler, David George |
| U.S. Pat. No. 4,531,025 | 07-23-1985 | Danley, Thomas J. et al. |
| U.S. Pat. No. 4,564,727 | 01-14-1986 | Danley, Thomas J. et al. |
| U.S. Pat. No. 4,566,120 | 01-21-1986 | Nieuwendijk J. et al. |
| U.S. Pat. No. 5,345,206 | 09-06-1994 | Morcos, Anthony C. |
| U.S. Pat. No. 5,371,806 | 12-06-1994 | Kohara Rintaro et al. |
| U.S. Pat. No. 5,511,131 | 04-23-1996 | Kohara, Rintaro et al. |
| U.S. Pat. No. 5,682,436 | 10-28-1997 | Sakamoto Yoshio et al. |
| U.S. Pat. No. 5,748,753 | 05-05-1998 | Carver, Robert W. |
| U.S. Pat. No. 5,828,767 | 10-27-1998 | Button, Douglas J. |
| U.S. Pat. No. 5,872,407 | 02-16-1999 | Kitaoka, Toshio et al. |
| US 6,417,584 B1 | 07-09-2002 | Chitayat, Anwar |
| US 6,526,151 B1 | 02-25-2003 | Peng, Jack |
| US 6,700,227 B2 | 03-02-2004 | Hartramph, Ralf |
| US 6,756,705 B2 | 06-29-2004 | Pulford Jr. Robert |
| US 6,768,806 B1 | 07-27-2004 | Button, Douglas J. et al. |
| US 6,770,988 B2 | 08-03-2004 | Denne, Phillip |
| US 6,800,966 B2 | 10-05-2004 | Godkin, Mikhail |
| US 6,849,970 B2 | 02-01-2005 | Watanabe, Koji |
| US 6,919,660 B2 | 07-19-2005 | Godkin, Mikhail |
| US 7,057,314 B2 | 06-06-2006 | Moro, Jerry |

II. Foreign Patent Documents

| Foreign Patent Document Country Code, Number, Kind Code (if known) | PUB'N DATE mm-dd-yyyy | PATENTEE OR APPLICANT NAME |
|---|---|---|
| WO 92/09180 | 05-29-1992 | Wijnker, Eddy et al. |
| WO 94/03026 | 02-03-1994 | Paddock, Paul |
| WO 97/03536 | 01-30-1997 | Darlington, Paul |
| WO 97/22226 | 06-19-1997 | Ding, Chih-Shun |
| WO 97/25833 | 07-17-1997 | Larsen, P. |
| WO 99/31931 | 06-24-1999 | Zhang, Fan |
| WO 00/67523 A2 | 11-09-2000 | Bank, Graham et al. |
| WO 00/67523 A3 | 11-09-2000 | Bank, Graham et al. |
| WO 02/13573 | 02-14-2002 | Matsushita Electric Industrial Co. ltd. |

III. Non-Patent Literature

Bai, Mingsian R. et al. DSP-based Sensorless Velocity Observer with Audio Applications in Loudspeaker Compensation; Audio Engineering Society, Convention Paper 6424 May 28-31, 2005. Barcelona, Spain.

Beerling, Marcel A. H. et al. Reduction of Nonlinear Distortion in Loudspeakers with Digital Motional Feedback; University of Twente, Department of Electrical Engineering Laboratory for Network Theory, Enschede, The Netherlands Bright, Andrew Compensating Non-Linear Distortion in an 'Equal-Hung' voice coil; Audio Engineering Society Convention Paper 5411, Sep. 21-24, 2001. New York, N.Y. USA Bright, Andrew Simplified Loudspeaker Distortion Compensation by DSP; Nokia Corporation, Fin-00045, Helsinki, Finland, Section of Acoustic Technology, Technical University of Denmark, Lyngby, Denmark Klippel, Wolfgang Active Compensation of Transducer Nonlinearities Klippel GmbH, Dresden, 01277, Germany, www.kilppel.de Abstract.

Distortion Analyzer 2 (rev. 2.0/2.1), Digital Processor Unit of the Klippel Analyzer System Roland Amplifiers for Guitar & Bass; Celebrating Three Decades of a Classic, New-Generation of Amps for Better Bass, Power & Tone to Go, Specifications.

Schurer, Hans et al., Theoretical and Experimental Comparison of Three Methods of Compensation of Electrodynamic Transducer Nonlinearity; University of Twente, Laboratory for Network Theory and VLSI Design, 7500 AE Enschede, The Netherlands "Improved Loudspeaker System" the specification of which was filed as U.S. Provisional Application No. 60/779,846 filed 6 Mar. 2006

"Novel Loudspeaker System" the specification of which was filed as U.S. Provisional Application No. 60/845,930 filed 19 Sep. 2006

"Improved Voice Coil Assembly for Use in Loudspeakers" the specification of which was filed as U.S. Provisional Application No. 60/900,399 filed 9 Feb. 2007

Thus, the applicant(s) should be understood to have support to claim and make a statement of invention to at least: i) each of the loudspeaker devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) the various combinations and permutations of each of the elements disclosed, and xii) each potentially dependent claim or concept as a dependency on each and every one of the independent claims or concepts presented.

In addition and as to computer aspects and each aspect amenable to programming or other electronic activity or automation, the applicant(s) should be understood to have support to claim and make a statement of invention to at least: xiii) processes performed with the aid of or on a computer as described throughout the above discussion, xiv) a programmable apparatus as described throughout the above discussion, xv) a computer readable memory encoded with data to direct a computer comprising means or elements which function as described throughout the above discussion, xvi) a computer configured as herein disclosed and described, xvii) individual or combined subroutines and programs as herein disclosed and described, xviii) the related methods disclosed and described, xix) similar, equivalent, and even implicit variations of each of these systems and methods, xx) those alternative designs which accomplish each of the functions shown as are disclosed and described, xxi) those alternative designs and methods which accomplish each of the functions shown as are implicit to accomplish that which is disclosed and described, xxii) each feature, component, and step shown as separate and independent inventions, and xxiii) the various combinations and permutations of each of the above.

With regard to claims whether now or later presented for examination, it should be understood that for practical reasons and so as to avoid great expansion of the examination burden, the applicant may at any time present only initial claims or perhaps only initial claims with only initial dependencies. This is particularly true as to method claims where only initial independent claims are presented. A full spectrum of dependencies tracking the apparatus claim in a similar manner should be understood as supported as explicitly included in this specification. Support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to have available as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able or chosen to anticipate all eventualities; one skilled in the art, should not be reasonably expected to have drafted a claim that would have literally encompassed such alternative embodiments.

Further, the use of the transitional phrase "comprising" is used to maintain the "open-end" claims herein, according to traditional claim interpretation. Thus, unless the context requires otherwise, it should be understood that the term "comprise" or variations such as "comprises" or "comprising" or "having" or "has", are intended to imply the inclusion of a stated element or step or group of elements or steps but not the exclusion of any other element or step or group of elements or steps. Such terms should be interpreted in their most expansive form so as to afford the applicant the broadest coverage legally permissible.

Finally, the claims set forth now and at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

The invention claimed is:

1. A loudspeaker system comprising:

a. a loudspeaker enclosure;

b. an air movement element contained at least partially within said loudspeaker enclosure;

c. a movable transfer attached to said air movement element;

d. an electronically activated, positionally sequenced drive system to which said movable transfer is responsive;

e. a plurality of separately controllable electrical coils within said electronically activated, positionally sequenced drive system;

f. at least one magnet within said electronically activated, positionally sequenced drive system and adjacent said plurality of electrical coils;

g. a positionally sequential electronic commutation controller to which said electronically activated, positionally sequenced drive system is responsive.

2. A loudspeaker system as described in claim 1 wherein said at least one magnet within said electronically activated, positionally sequenced drive system and adjacent said plurality of electrical coils comprise a plurality of alternating pole adjacent magnets.

3. A loudspeaker system as described in claim 1 wherein said plurality of separately controllable electrical coils within said electronically activated, positionally sequenced drive system comprises a plurality of interleaved separately controllable electrical coils.

4. A loudspeaker system as described in claim 3 wherein said drive system comprises a plurality of switches responsive to said positionally sequential electronic commutation controller, and to which at least some of said plurality of interleaved separately controllable electrical coils are responsive.

5. A loudspeaker system as described in claim 4 wherein said plurality of interleaved separately controllable electrical coils comprise a plurality of opposing pairs of coaxial induction elements.

6. A loudspeaker system as described in claim 5 wherein said plurality of opposing pairs of coaxial induction elements comprise a plurality of opposite current flow direction coils.

7. A loudspeaker system as described in claim 6 wherein said plurality of opposite current flow direction coils comprise a plurality of counterwound coils.

8. A loudspeaker system as described in claim 5 wherein said positionally sequential electronic commutation controller comprises a drive efficacy lookup controller.

9. A loudspeaker system as described in claim 1 and further comprising at least one high aspect ratio current lead positioned adjacent said plurality of separately controllable electrical coils within said electronically activated, positionally sequenced drive system, and wherein said at least one high aspect ratio current lead is selected from a group consisting of:

a current lead having an aspect ratio of at least about 2,
a current lead having an aspect ratio of at least about 3,
a current lead having an aspect ratio of at least about 5,
a current lead having an aspect ratio of at least about 10,
a current lead having an aspect ratio of at least about 100,
a current lead having an aspect ratio of at least about 2 to about 1000.

10. A loudspeaker system as described in claim 9 wherein said at least one high aspect ratio current lead comprises an axially interrupted trace.

11. A loudspeaker system as described in claim 10 wherein said at least one high aspect ratio current lead is positioned on a voice coil former.

12. A loudspeaker system as described in claim 11 wherein said electronically activated, positionally sequenced drive system comprises a voice coil discrete resolution sensor drive system.

13. A loudspeaker system as described in claim 1 wherein said at least one magnet within said electronically activated, positionally sequenced drive system and adjacent said plurality of electrical coils comprises a single magnet element.

14. A loudspeaker system as described in claim 13 wherein said drive system comprises a plurality of switches responsive to said positionally sequential electronic commutation controller, and to which at least some of said plurality of separately controllable electrical coils are responsive.

15. A loudspeaker system as described in claim 14 wherein said plurality of separately controllable electrical coils within said electronically activated, positionally sequenced drive system comprise a plurality of common polarity, electronically activated, positionally sequenced coaxial electrical coils.

16. A loudspeaker system as described in claim 15 wherein said positionally sequential electronic commutation controller comprises a drive efficacy lookup controller.

17. A loudspeaker system as described in claim 13 and further comprising at least one high aspect ratio current lead positioned adjacent said plurality of separately controllable electrical coils within said electronically activated, positionally sequenced drive system, and wherein said at least one high aspect ratio current lead is selected from a group consisting of:

a current lead having an aspect ratio of at least about 2,
a current lead having an aspect ratio of at least about 3,
a current lead having an aspect ratio of at least about 5,
a current lead having an aspect ratio of at least about 10,
a current lead having an aspect ratio of at least about 100,
a current lead having an aspect ratio of at least about 2 to about 1000.

18. A loudspeaker system as described in claim 17 wherein said at least one high aspect ratio current lead comprises an axially interrupted trace.

19. A loudspeaker system as described in claim 17 wherein said at least one high aspect ratio current lead is positioned on a voice coil former.

20. A loudspeaker system as described in claim 17 wherein said electronically activated, positionally sequenced drive system comprises a voice coil discrete resolution sensor drive system.

21. A loudspeaker system comprising:

a. a loudspeaker enclosure;

b. an air movement element contained at least partially within said loudspeaker enclosure;

c. a movable transfer attached to said air movement element;

d. a high efficiency drive system to which said movable transfer is responsive comprising a plurality of separately controllable electrical coils; and e. a controller to which said high efficiency drive system is responsive, wherein said high efficiency drive system comprises a plurality of coaxial magnets, and wherein said plurality of separately controllable electrical coils comprise a plurality of coaxial, positionally sequenced electrical coils and wherein said controller comprises a commutation controller to which said plurality of coaxial, positionally sequenced electrical coils are responsive.

22. A loudspeaker system as described in claim 21 wherein said high efficiency drive system is configured to consume low power for a given sound pressure level output.

23. A loudspeaker system as described in claim 21 wherein said high efficiency drive system is configured to produce low heat for a given sound pressure level output.

24. A loudspeaker system as described in claim 21 wherein said high efficiency drive system is selected from a drive system having parameters selected from a group consisting of:

a greater than about 120 kg/s efficient drive system at a field centered location;

a greater than about 95 kg/s efficient drive system at a field centered location;

a greater than about 75 kg/s to about 200 kg/s efficient drive system at a field centered location;

a greater than about 80 kg/s efficient drive system at an off field location;

a greater than about 40 kg/s efficient drive system at an off field location;

a greater than about 30 kg/s to about 100 kg/s efficient drive system at a field centered location;

a greater than about 120 kg/s efficient drive system at a field centered location with mechanical parameters that generate about a 70 kg/s efficient drive system at a field centered location for a conventional design;

a greater than about 95 kg/s efficient drive system at a field centered location 70 kg/s efficient drive system at a field centered location;

a greater than about 80 kg/s efficient drive system at an off field location 25 kg/s efficient drive system at a field centered location;

a greater than about 40 kg/s efficient drive system at an off field location 25 kg/s efficient drive system at a field centered location;

a greater than about 120 kg/s efficient drive system at a field centered location with mechanical parameters that generate about a 70 kg/s efficient drive system at a field centered location for a conventional 400 W, 12" design;

a greater than about 95 kg/s efficient drive system at a field centered location 70 kg/s efficient drive system at a field centered location for a conventional 400 W, 12" design;

a greater than about 80 kg/s efficient drive system at an off field location 25 kg/s efficient drive system at a field centered location for a conventional 400 W, 12" design;

a greater than about 40 kg/s efficient drive system at an off field location 25 kg/s efficient drive system at a field centered location for a conventional 400 W, 12" design;

a greater than about 120 kg/s efficient drive system at a field centered location for a five magnet, multi coil system;

a greater than about 95 kg/s efficient drive system at a field centered location for a single magnet, multi coil system;

a greater than about 80 kg/s efficient drive system at an off field location for a five magnet, multi coil system;

a greater than about 40 kg/s efficient drive system at an off field location for a single magnet, multi coil system;

a greater than about 80 kg/s efficient drive system at a field centered location;

a greater than about 100 kg/s efficient drive system at a field centered location;

a greater than about 120 kg/s efficient drive system at a field centered location;

a greater than about 140 kg/s efficient drive system at a field centered location;

a greater than about 160 kg/s efficient drive system at a field centered location;

a greater than about 180 kg/s efficient drive system at a field centered location;

a greater than about 200 kg/s efficient drive system at a field centered location;

a greater than about 220 kg/s efficient drive system at a field centered location;

a greater than about 30 kg/s efficient drive system at a field centered location;

a greater than about 40 kg/s efficient drive system at an off field location;

a greater than about 50 kg/s efficient drive system at an off field location;

a greater than about 60 kg/s efficient drive system at an off field location;

a greater than about 70 kg/s efficient drive system at an off field location;

a greater than about 80 kg/s efficient drive system at an off field location;

a greater than about 90 kg/s efficient drive system at an off field location; and a greater than about 100 kg/s efficient drive system at an off field location.

25. A loudspeaker system as described in claim 21 wherein said drive system comprises:

a. a magnetic component; and b. at least one coil component to which said movable transfer is responsive; and c. at least one electronically activated coil switch to which said at least one coil component is responsive and which is responsive to said controller.

26. A loudspeaker system as described in claim 25 wherein said at least one electronically activated coil switch comprises at least one interleave electronically activated coil switch.

27. A loudspeaker system as described in claim 21 wherein said drive system comprises a position sensor.

28. A loudspeaker system as described in claim 21 wherein said plurality of electrical coils comprise a plurality of opposite current flow direction coils.

29. A loudspeaker system as described in claim 21 wherein said controller comprises an electronic compensator.

30. A loudspeaker system as described in claim 29 wherein said electronic compensator is selected from a group consisting of:

an acceleration calculation element, a positional audio sensitivity compensator, a motion effect compensator, a past activity effect compensator, a time of activity effect compensator, a length of activity effect compensator, a combined time and activity effect compensator, a historical memory compensator, a transient activity effect compensator, a sensor input compensator, a manufacturing effect compensator, a non-linear effect compensator, a non-sinusoidal effect compensator, a phase shift effect compensator, a position-dependent algorithm,
a motional voltage compensation algorithm,
a proportional algorithm,
an integral algorithm,
a derivative algorithm,
a proportional integral derivative algorithm, and
a position limit effect compensator.

31. A loudspeaker system as described in claim 29 wherein said electronic compensator comprises an out of field compensator.

32. A loudspeaker system as described in claim 31 wherein said out of field compensator comprises an intentionally magnetic suboptimal compensator.

33. A loudspeaker system as described in claim 29 wherein said electronic compensator comprises a positionally based compensator.

34. A loudspeaker system as described in claim 33 wherein said positionally based compensator comprises an actual position input.

35. A loudspeaker system as described in claim 34 wherein said positionally based compensator comprises a position sensor.

36. A loudspeaker system as described in claim 21 wherein said drive system comprises an intense power density drive system.

37. A loudspeaker system as described in claim 21 wherein said drive system comprises a low inductance drive system.

38. A loudspeaker system as described in claim 21 wherein said air movement element comprises a free movement element.

39. A loudspeaker system as described in claim 21 wherein said drive system comprises an intransigently extensile drive system.

40. A loudspeaker system as described in claim 21 wherein said controller comprises a drive efficacy lookup controller.

41. A loudspeaker system as described in claim 21 wherein said drive system comprises a low resistance drive system.

42. A loudspeaker system as described in claim 21 wherein said drive system comprises a narrow gap drive system.

43. A loudspeaker system as described in claim 21 wherein said drive system comprises an integrally sensed drive system.

44. A loudspeaker system comprising:
a. a loudspeaker enclosure;
b. an air movement element contained at least partially within said loudspeaker enclosure;
c. a hollow cylindrical voice coil assembly having multiple coils;
d. a current commutator to which said multiple coils are responsive;
e. a cylindrical magnetic structure having a magnetic field; and
f. a controller to which said current commutator is responsive,
wherein said cylindrical magnetic structure comprises alternating axial layers having permanent magnet material and magnetically permeable material, and wherein said alternating axial layers are polarized in at least one direction along an axis of said cylindrical magnetic structure.

45. A loudspeaker system as described in claim 44 wherein said cylindrical magnetic structure is surrounded by a coaxial annular gap and wherein said hollow cylindrical voice coil assembly is located within said coaxial annular gap.

46. A loudspeaker system as described in claim 44 having an annular gap and wherein said cylindrical magnetic structure comprises an outside gap polarity opposite an adjacent inside gap polarity.

47. A loudspeaker system comprising:
a. a loudspeaker enclosure;
b. an air movement element contained at least partially within said loudspeaker enclosure;
c. a movable transfer attached to said air movement element;
d. a high efficiency drive system to which said movable transfer is responsive comprising a plurality of separately controllable electrical coils;
e. a controller to which said high efficiency drive system is responsive; and
f. a commutator to which a plurality of electrical coils are responsive,
wherein said drive system comprises a plurality of coaxial magnets, each having a magnet pitch dimension, and wherein said commutator has a positional commutation function that acts with a positional period about equal to twice a magnet pitch dimension.

48. A loudspeaker system comprising:
a loudspeaker enclosure;
an air movement element contained at least partially within said loudspeaker enclosure;
a movable transfer attached to said air movement element;
an integrally sensed drive system to which said movable transfer is responsive; and
a controller to which said integrally sensed drive system is responsive,
wherein said closely coupled sensor drive system comprises:
a. a movable drive component to which said movable transfer is responsive; and
b. position indicia applied to said moveable drive component,
wherein said integrally sensed drive system comprises a closely coupled sensor drive system,
wherein said position indicia is attached to an outside of said movable drive component, and
wherein said movable drive component comprises a translucent voice coil former.

49. A loudspeaker system comprising:
a loudspeaker enclosure;
an air movement element contained at least partially within said loudspeaker enclosure;
a movable transfer attached to said air movement element;
an integrally sensed drive system to which said movable transfer is responsive; and
a controller to which said integrally sensed drive system is responsive,
wherein said drive system comprises a voice coil former,
wherein said drive system comprises a plurality of electrical coils,
wherein said drive system comprises a plurality of coaxial magnets,
wherein said plurality of electrical coils comprise a plurality of coaxial, positionally sequenced electrical coils and wherein said positionally sequential controller comprises a commutation controller to which said plurality of coaxial, positionally sequenced electrical coils are responsive.

* * * * *